US012433467B2

(12) United States Patent
Sack et al.

(10) Patent No.: US 12,433,467 B2
(45) Date of Patent: Oct. 7, 2025

(54) TWO IN ONE MOBILE CLEANING ROBOT

(71) Applicant: iRobot Corporation, Bedford, MA (US)

(72) Inventors: Michael G. Sack, Westford, MA (US); Erik Edward Steltz, Melrose, MA (US); Russell Walter Morin, Burlington, MA (US); Victor Puksta, Ayer, MA (US); Timothy R. Ohm, Grover Beach, CA (US); Brian Cleve Benson, Jr., Chelmsford, MA (US); Peter J. Lydon, Peabody, MA (US); Timothy James Haughton, Newton, MA (US); Fangzheng Guo, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 158 days.

(21) Appl. No.: 17/388,293

(22) Filed: Jul. 29, 2021

(65) Prior Publication Data

US 2022/0104677 A1 Apr. 7, 2022

Related U.S. Application Data

(60) Provisional application No. 63/088,544, filed on Oct. 7, 2020.

(51) Int. Cl.
*A47L 11/40* (2006.01)
*A47L 11/30* (2006.01)

(52) U.S. Cl.
CPC ..... *A47L 11/4069* (2013.01); *A47L 11/305* (2013.01); *A47L 11/4011* (2013.01); *A47L 11/4038* (2013.01); *A47L 2201/00* (2013.01)

(58) Field of Classification Search
CPC ..... A47L 11/4036; A47L 11/4038; A47L 11/4055; A47L 11/4063; A47L 11/4069;
(Continued)

(56) References Cited

U.S. PATENT DOCUMENTS 3,284,830 A * 11/1966 Kroll ..... A47L 11/24 15/82
3,376,597 A * 4/1968 Boyd ..... A47L 11/4072 15/401

(Continued)

FOREIGN PATENT DOCUMENTS

CN 116348024 A 6/2023
WO 2020125760 6/2020

OTHER PUBLICATIONS

"International Application Serial No. PCT US2021 052825, International Search Report mailed Jan. 14, 2022", 3 pgs.

(Continued)

*Primary Examiner* — Brian D Keller
*Assistant Examiner* — Sidney D Full
(74) *Attorney, Agent, or Firm* — Schwegman Lundberg & Woessner, P.A.

(57) ABSTRACT

A mobile cleaning robot can include a body, a pad assembly, and a pad drive system. The pad assembly can be connected to the body and can be movable relative thereto. The pad drive system can be connected to the body and can be operable to move the pad assembly relative to the body between a stored position and a cleaning position.

21 Claims, 39 Drawing Sheets

(58) Field of Classification Search
CPC ..... A47L 11/28; A47L 11/282; A47L 11/30; A47L 11/302; A47L 11/4052–4058; A47L 11/4011; A47L 11/203; A47L 2201/00; E01H 1/05; E01H 1/053; E01H 1/056; E01H 1/003; E01H 1/02; E01H 1/042; E01H 1/045; E01H 1/047; E01H 1/0818; E01H 1/0845; E01H 1/0854; E01H 1/0872; E01H 4/02; E01H 5/04; E01H 5/045; E01H 5/06; E01H 5/063; E01H 5/067; E01H 5/07; E01H 5/073; E01H 5/076; E01H 5/09; E01H 5/092; E01H 5/096; E01H 5/098; E01H 5/10; E01H 5/104; E01H 8/04; E01H 8/06; E01H 8/10; E01H 11/00; E01H 10/007; E01H 12/00
See application file for complete search history.

(56) References Cited

U.S. PATENT DOCUMENTS 3,597,985 A * 8/1971 Jeffrey ..... F16H 7/00 474/148
3,604,051 A * 9/1971 Wendel ..... E01H 1/0854 15/352
3,719,098 A * 3/1973 Graves ..... B65G 23/06 474/272
4,047,444 A * 9/1977 Jeffrey ..... F16H 7/023 474/148
4,471,713 A * 9/1984 Cote ..... A47L 11/4088 222/614
5,650,702 A * 7/1997 Azumi ..... A47L 9/2852 15/340.1
5,991,951 A * 11/1999 Kubo ..... A47L 11/16 15/49.1
7,059,004 B2 * 6/2006 Mitchell ..... A47L 11/4055 15/49.1
8,561,242 B2 * 10/2013 Brueckner ..... A47L 11/4083 15/50.1
8,961,695 B2 2/2015 Romanov et al.
8,997,905 B2 * 4/2015 Johnson ..... A47L 11/4013 15/340.1
9,265,396 B1 2/2016 Lu et al.
10,368,709 B2 * 8/2019 Baertsch ..... A47L 11/293
10,786,131 B2 * 9/2020 Robinson ..... A47L 11/30
11,401,670 B2 * 8/2022 Teixeira Goethel .. E01H 1/0845
2014/0371909 A1 12/2014 Lee et al.
2018/0172126 A1 * 6/2018 Zahner ..... F16H 7/06
2020/0000302 A1 * 1/2020 Morin ..... A47L 11/4088
2023/0180985 A1 * 6/2023 Bauer ..... A47L 11/4055 15/21.1

OTHER PUBLICATIONS

"International Application Serial No. PCT US2021 052825, Written Opinion mailed Jan. 14, 2022", 7 pgs.
"International Application Serial No. PCT US2021 052825, International Preliminary Report on Patentability mailed Apr. 20, 2023", 9 pgs.
"European Application Serial No. 21878258.9, Extended European Search Report mailed Oct. 14, 2024", 10 pgs.

* cited by examiner

TWO IN ONE MOBILE CLEANING ROBOT

CLAIM OF PRIORITY

This patent application claims the benefit of priority, under 35 U.S.C. Section 119(e), U.S. Patent Application Ser. No. 63/088,544, entitled "Two In One Mobile Cleaning Robot," filed on Oct. 7, 2020, which is hereby incorporated by reference herein in its entirety.

BACKGROUND

Autonomous mobile robots include autonomous mobile cleaning robots that can autonomously perform cleaning tasks within an environment, such as a home. Many kinds of cleaning robots are autonomous to some degree and in different ways. Some robots can perform vacuuming operations and some can perform mopping operations. Other mopping robots can include components or systems to perform both vacuuming and mopping operations.

SUMMARY

Some autonomous cleaning robots can include both a vacuum system and a mopping or cleaning system which can allow the robots to perform both mopping and vacuuming operations (such as simultaneously or alternatively), often referred to as two-in-one robots or vacuums. Some two-in-one robots include a pad type mopping system located rearward of a vacuum extractor that allows the robot to extract debris from a floor surface just prior to mopping the surface with the pad. These systems can be effective for cleaning hard surfaces that may require debris extraction and mopping. However, such two-in-one systems can struggle to clean fibrous surfaces, such as carpeting, where mopping is not required and where clearance between the mopping pad and the floor surface can prohibit travel of the robots onto fibrous surfaces, such as high pile carpeting. Use of mopping systems on carpeting can also lead to unwanted soiling of carpeting. Further, some mopping systems require users to manually adjust one or more mopping features between functions.

This disclosure helps to address these issues by providing a mobile cleaning robot including a mopping or cleaning system having a pad drive system, where the pad drive system can be operable to move the mopping pad assembly between a cleaning position and a stored position. That is, the pad drive system can move the pad into the cleaning position when the robot is on a hard surface (such as wood or tile) and the pad drive system can move the pad into a stored position before the robot moves to a carpeted surface. Such a pad drive system can help to allow the robot to vacuum carpeted surfaces and both vacuum and mop hard floor surfaces all during the same mission without requiring user intervention. Examples of pad drive systems are discussed in further detail below.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components. Like numerals having different letter suffixes may represent different instances of similar components. The drawings illustrate generally, by way of example, but not by way of limitation, various embodiments discussed in the present document.

DETAILED DESCRIPTION

Figure 1:
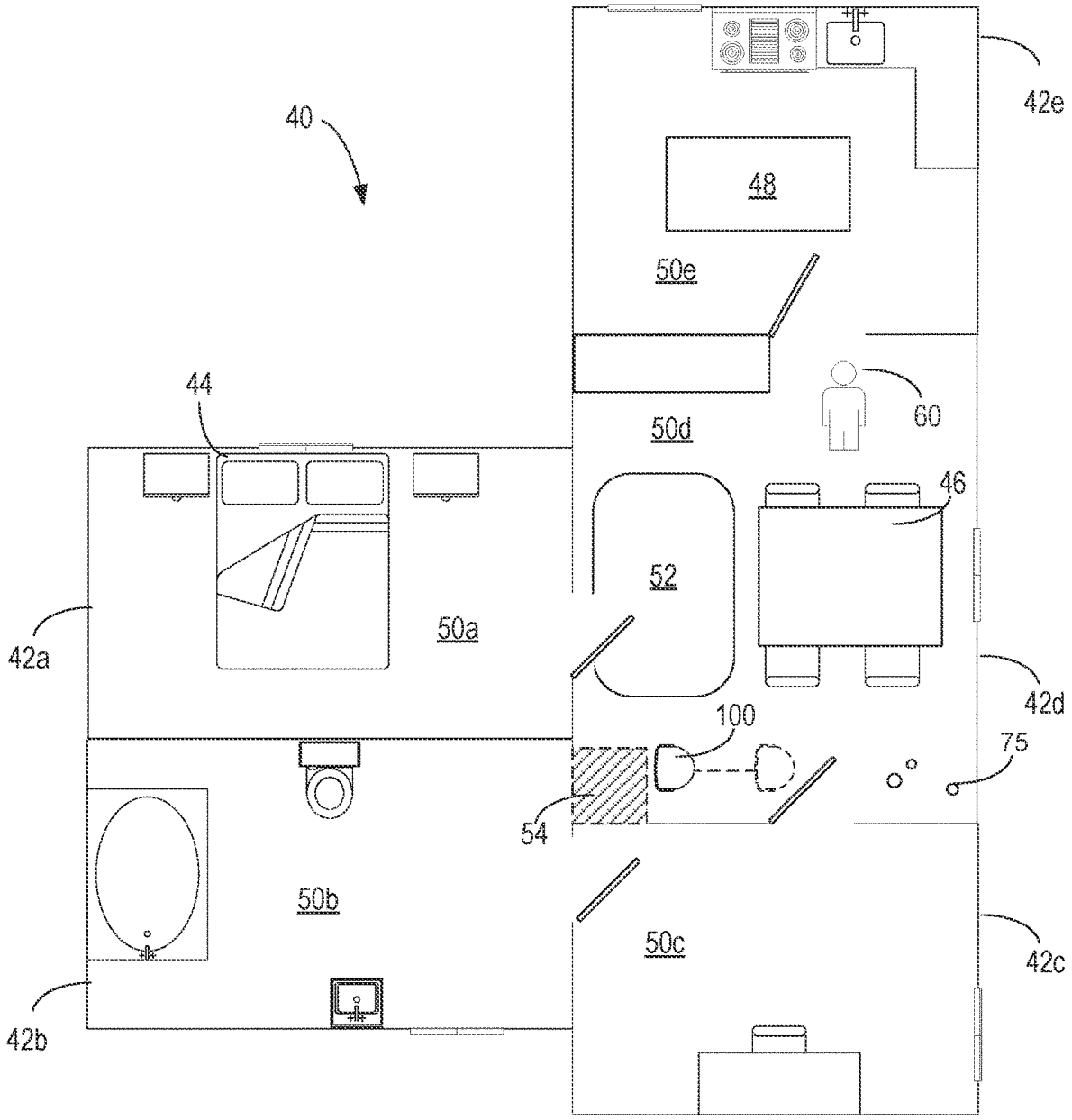
FIG. 1 illustrates a plan view of a mobile cleaning robot in an environment.

FIG. 1 illustrates a plan view of a mobile cleaning robot 100 in an environment 40, in accordance with at least one example of this disclosure. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*.

During cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

Also, during operation, the robot 100 can detect surface types within each of the rooms 42, which can be stored in the robot or another device. The robot 100 can update the map (or data related thereto) such as to include or account for surface types of the floor surfaces 50*a*-50*e* of each of the respective rooms 42 of the environment. In some examples, the map can be updated to show the different surface types such as within each of the rooms 42.

In some examples, the user 60 can define a behavior control zone 54 using, for example, the methods and systems described herein. In response to the user 60 defining the behavior control zone 54, the robot 100 can move toward the behavior control zone 54 to confirm the selection. After confirmation, autonomous operation of the robot 100 can be initiated. in autonomous operation, the robot 100 can initiate a behavior in response to being in or near the behavior control zone 54. For example, the user 60 can define an area of the environment 40 that is prone to becoming dirty to be the behavior control zone 54. In response, the robot 100 can initiate a focused cleaning behavior in which the robot 100 performs a focused cleaning of a portion of the floor surface 50*d* in the behavior control zone 54.

Robot Examples

Figure 2A:
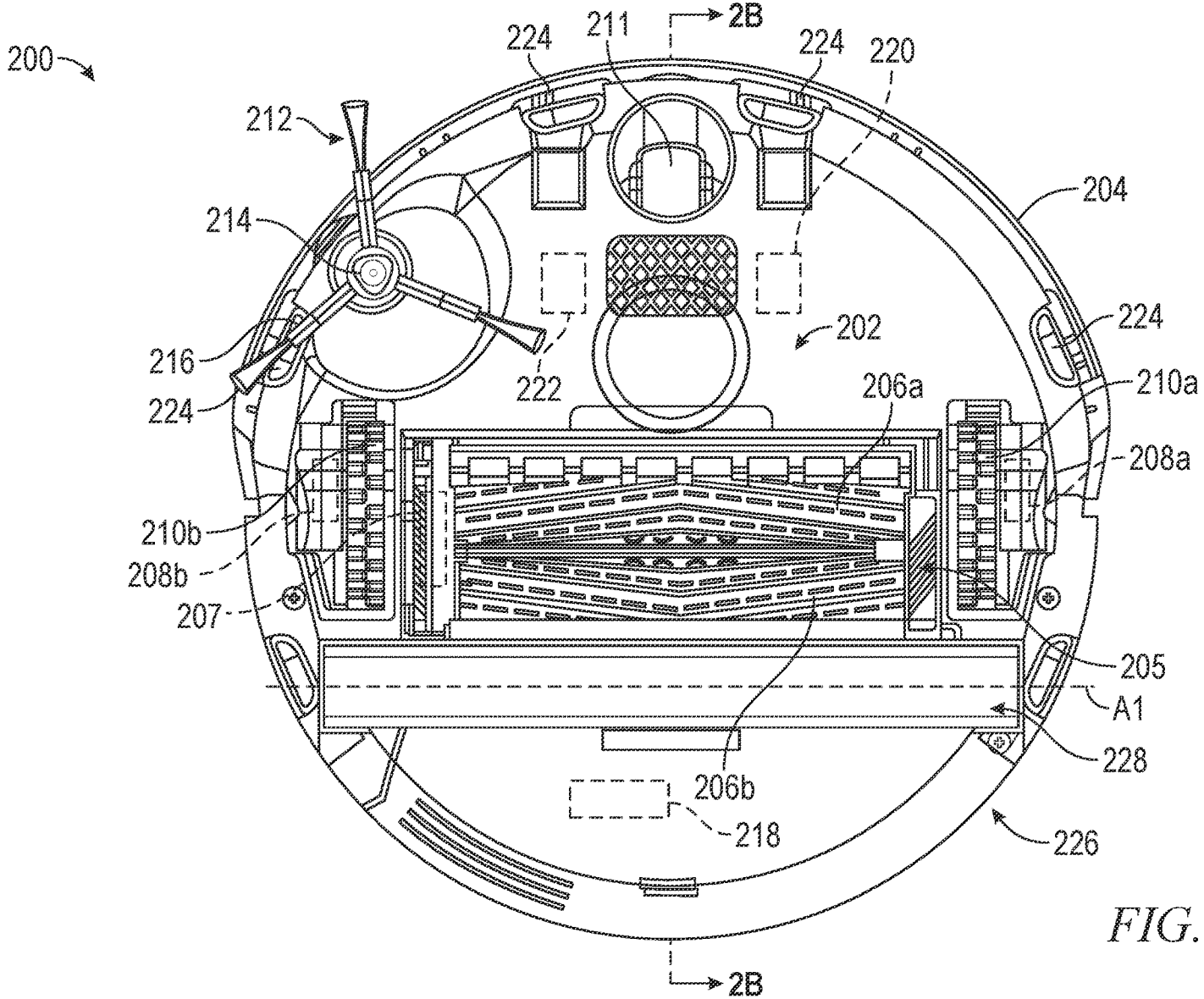
FIG. 2A illustrates a bottom view of a mobile cleaning robot.

FIG. 2A illustrates a bottom view of the mobile cleaning robot 200, which can include a body 202, a bumper 204, an extractor 205 (including rollers 206*a* and 206*b*), motors 208*a* and 208*b*, drive wheels 210*a* and 210*b*, a caster 211, a side brush assembly 212, a motor 214, a brush 216, a vacuum assembly 218, a controller 220, memory 222, sensors 224, a debris bin 226, a mopping system 228 (or cleaning system 228), a tank 233, and a pump 235.

The cleaning robot 200 can be an autonomous cleaning robot that autonomously traverses the floor surface 50 while ingesting the debris 75 from different parts of the floor surface 50. As shown in FIG. 2A, the robot 200 can include the body 202 that can be movable across the floor surface 50. The body 202 can include multiple connected structures to which movable components of the cleaning robot 200 are mounted. The connected structures can include, for example, an outer housing to cover internal components of the cleaning robot 200, a chassis to which the drive wheels 210*a* and 210*b* and the cleaning rollers 206*a* and 206*b* (of the cleaning assembly 205) are mounted, the bumper 204 mounted to the outer housing, etc. The caster wheel 211 can support the front portion 202*a* of the body 202 above the floor surface 50, and the drive wheels 210*a* and 210*b* support the rear portion 202*b* of the body 202 above the floor surface 50.

As shown in FIG. 2A, the body 202 includes a front portion that has a substantially semicircular shape that can be connected to the bumper 204, and a rear portion that has a substantially semicircular shape. In other examples, the body 202 can have other shapes such as a square front or straight front. The robot 200 can also include a drive system including the actuators 208*a* and 208*b*, e.g., motors. The actuators 208*a* and 208*b* can be mounted in the body 202 and can be operably connected to the drive wheels 210*a* and 210*b*, which are rotatably mounted to the body 202. The drive wheels 210*a* and 210*b* can support the body 202 above the floor surface 50. The actuators 208*a* and 208*b*, when driven, can rotate the drive wheels 210*a* and 210*b* to enable the robot 100 to autonomously move across the floor surface 50.

The vacuum assembly 218 can be carried within the body 202 of the robot 200, e.g., in a rear portion of the body 202, and can be located in other locations in other examples. The vacuum assembly 218 can include a motor to drive an impeller that generates the airflow when rotated. The airflow and the cleaning rollers 206, when rotated, can cooperate to ingest the debris 75 into the robot 200. The cleaning bin 226 can be mounted in the body 202 and can contain the debris 75 ingested by the robot 200. A filter in the body 202 can separate the debris 75 from the airflow before the airflow enters the vacuum assembly 218 and is exhausted out of the body 202. In this regard, the debris 75 can be captured in both the cleaning bin 226 and the filter before the airflow is exhausted from the body 202. In some examples, the vacuum assembly 218 and extractor 205 can be optionally included or can be of a. different type.

The cleaning rollers 206*a* and 206*b* can be operably connected to an actuator 207, e.g., a motor, through a gearbox. The cleaning head 205 and the cleaning rollers 206*a* and 206*b* can positioned forward of the cleaning bin 226. The cleaning rollers 206 can be mounted to an underside of the body 202 so that the cleaning rollers 206*a* and 206*b* engage debris 75 on the floor surface 50 during the cleaning operation when the underside faces the floor surface 50.

The controller 220 can be located within the housing and can be a programable controller, such as a single or multi-board computer, a direct digital controller (DDC), a programable logic controller (PLC), or the like. In other examples, the controller 220 can be any computing device, such as a handheld computer, for example, a smart phone, a tablet, a laptop, a desktop computer, or any other computing device including a processor, memory, and communication capabilities. The memory 222 can be one or more types of memory, such as volatile or non-volatile memory, read-only memory (ROM), random-access memory (RAM), magnetic disk storage media, optical storage media, flash-memory devices, and other storage devices and media. The memory 222 can be located within the housing 202, connected to the controller 220 and accessible by the controller 220.

The controller 220 can operate the actuators 208*a* and 208*b* to autonomously navigate the robot 200 about the floor surface 50 during a cleaning operation. The actuators 208*a* and 208*b* can be operable to drive the robot 200 in a forward drive direction, in a backwards direction, and to turn the robot 200. The controller 220 can operate the vacuum assembly 218 to generate an airflow that flows through an air gap near the cleaning rollers 206, through the body 202, and out of the body 202.

The control system can further include a sensor system with one or more electrical sensors. The sensor system, as described herein, can generate a signal indicative of a current location of the robot 200, and can generate signals indicative of locations of the robot 200 as the robot 200 travels along the floor surface 50.

The cliff sensors 224 (shown in FIG. 2A) can be located along a bottom portion of the housing 202. Each of the cliff sensors 224 can be an optical sensor that can be configured to detect a presence or absence of an object below the optical sensor, such as the floor surface 50. The cliff sensors 224 can be connected to the controller 220 and can be used by the controller 220 to navigate the robot 200 within the environment 40. In some examples, the cliff sensors can be used to detect a floor surface type which the controller 220 can use to selectively operate the mopping system 228.

The cleaning pad assembly 228 can be a cleaning pad connected to the bottom portion of the body 202 (or connected to a moving mechanism configured to move the assembly 228 between a stored position and a cleaning position), such as to the cleaning bin 226 in a location to the rear of the extractor 205. The cleaning pad assembly 228 is discussed in further detail below.

The tank 233 can be a water tank configured to store water or fluid, such as cleaning fluid, for delivery to the mopping pad 230. The pump 235 can be connected to the controller 220 and can be in fluid communication with the tank 233. The controller 220 can be configured to operate the pump 235 to deliver fluid to the mopping pad 230 during mopping operations.

Figure 2B:
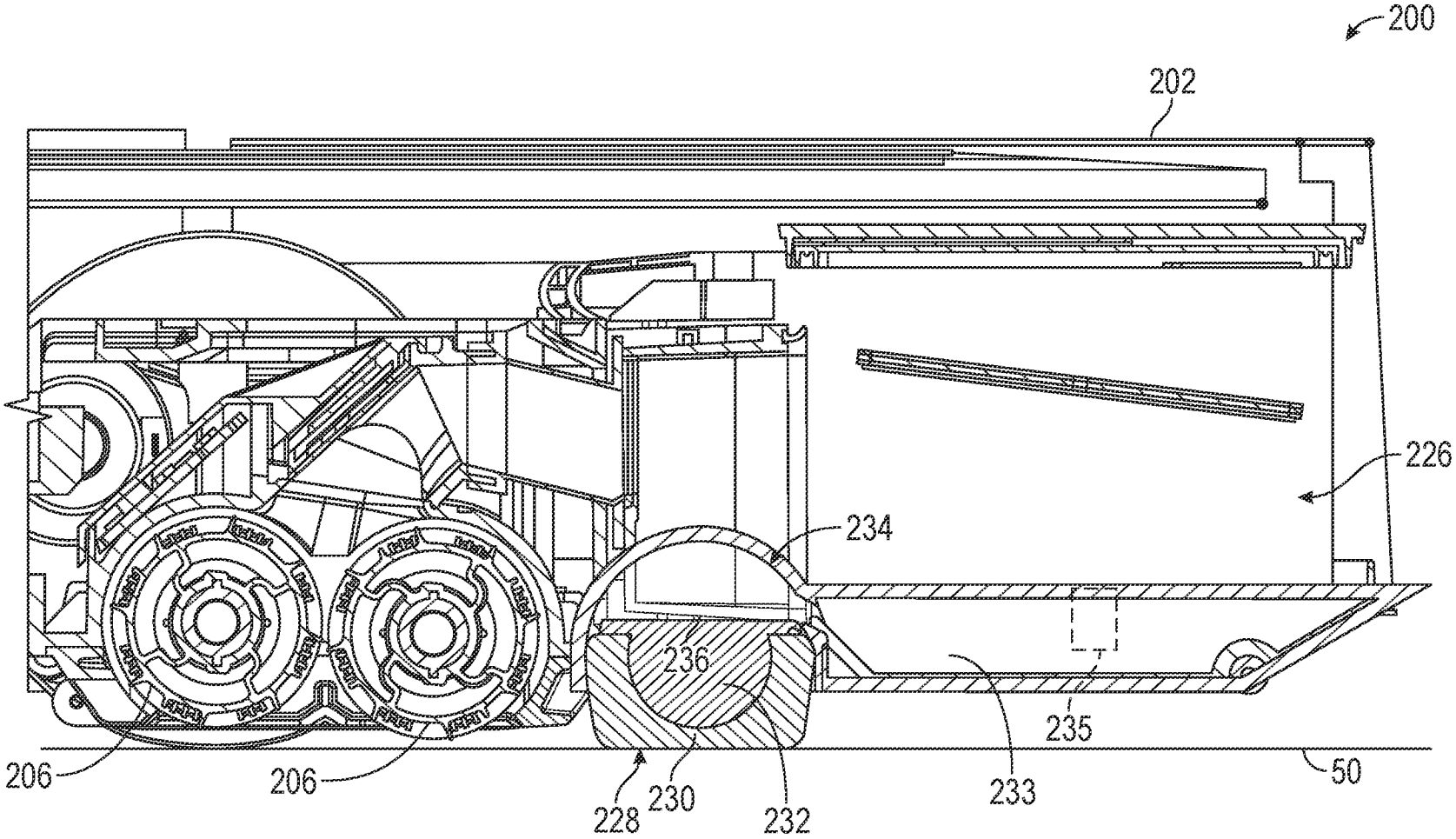
FIG. 2B illustrates a side cross-sectional view across indicators 2B-2B of FIG. 2A of a portion of a mobile cleaning robot.

FIG. 2B illustrates a side cross-sectional view across indicators 2B-2B of FIG. 2A of a portion of the mobile cleaning robot 200, which can be consistent with FIG. 2A discussed above: FIG. 2B shows additional details of the robot 200. For example, FIG. 2B shows that the mopping system 228 can include a cleaning pad 230 and a core 232 located in a pad housing 234 of the housing 202 of the robot 200.

The pad housing 234 can be shaped complimentary to the cleaning pad 230 such that the pad housing 234 can be circular or semi-circular (or round or the like). As discussed below, the pad housing 234 can receive the pad 230 therein when the pad is in a stored position. The pad housing 234 can also be shaped such that the pad 230 can extend below the pad housing 234 to engage the floor surface 50 when the pad 230 is in a cleaning position. The pad housing 234 can include a suspension to help provide compliance to the cleaning pad 230 relative to the floor surface 50 and body 202 of the robot 200, which can help the cleaning pad 230 to conform to changes in height and flatness of the floor surface 50, relative to the robot 200.

The core 232 can be a rigid or semi-rigid body made of materials such as one or more of metals, plastics, foams, elastomers, ceramics, composites, combinations thereof, or the like. The core 232 can be elongate, extending across a width of the body 202 along a longitudinal axis Al and can be connected to the body 202 of the robot 200, The core 232 can have a semi-circular cross-sectional shape including a cap 236 forming a dry side of the roller and helping to form a D-shaped roller. The cap 236 can be a substantially flat portion having a diameter smaller than a diameter of the pad housing 234 to allow the pad 230 and core 232 to freely rotate within the housing 234. The cap 236 can be oriented away from the floor surface when the pad 230 is in use, as shown in FIG. 2B.

The pad 230 can be an elongate member extending across the axis Al and can be a semi-rigid and porous material such as one or more of cloth, foam, polymer, or the like, such that the pad 230 can be configured to retain fluid and fine dust or debris. The pad 230 can be connected to the core 232 such that the pad 230 is connected to at least a portion of a radially outer portion of the core 232. In some examples, the pad 230 can extend around a circumference of the core 232 between 150 and 250 degrees. In some examples, the pad 230 can extend around the circumference of the core 232 between 150 and 180 degrees.

The pad 230 can be elastically deformable or compliant such that the pad 230 can conform to the floor surface 50, as shown in FIG. 2B when the pad 230 is in the cleaning position and is engaged with the floor surface 50. At least a portion of the pad 230 can remain in engaged with the floor surface 50 during mopping operations and the pad 230 can be rotated to partially engage the surface 50 during some operations, as discussed in further detail below.

In some examples, the pad 230 can be a dry pad such as for dusting or dry debris removal. The pad 230 can also be any cloth, fabric, or the like configured for cleaning (either wet or dry) of a floor surface.

Figure 3A:
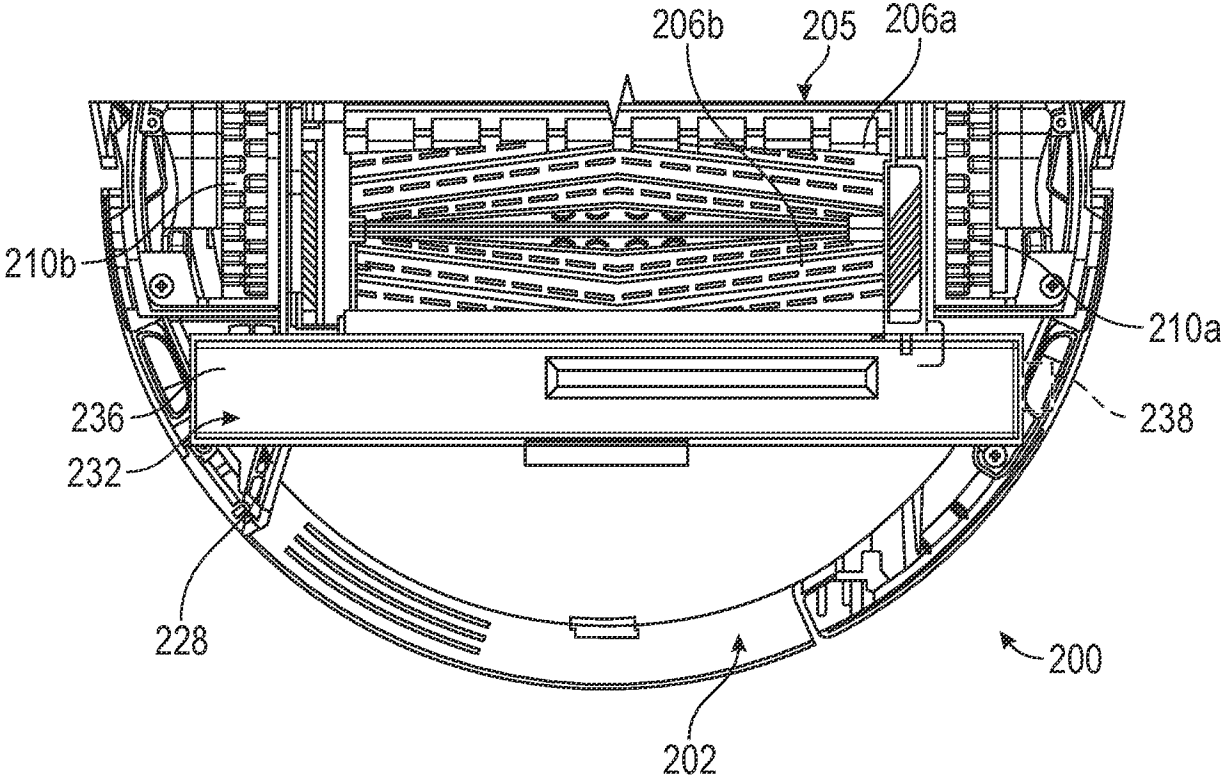
FIG. 3A illustrates a bottom view of a mobile cleaning robot.
Figure 3B:
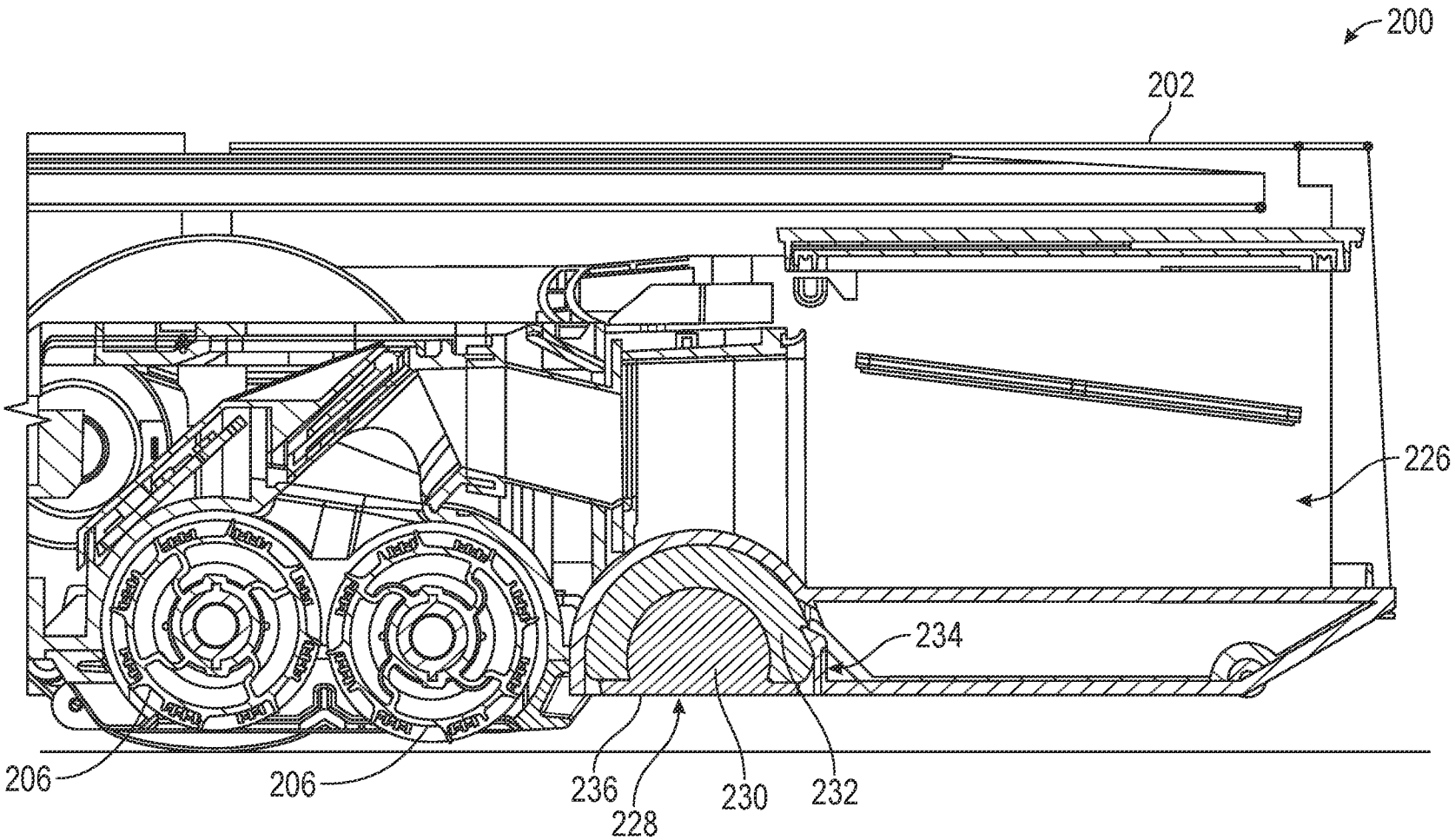
FIG. 3B illustrates a side cross-sectional view of a portion of a mobile cleaning robot.

FIG. 3A illustrates a bottom view of the mobile cleaning robot 200. FIG. 3B illustrates a side cross-sectional view of a portion of a mobile cleaning robot 200. The robot 200 of FIGS. 3A and 3B can be consistent with the robot 200 of FIGS. 2A-2B; FIGS. 3A-3B show the cleaning pad assembly 228 in a stored position and also show a pad motor 238 or pad drive system 238.

The pad motor 238 can be an actuator, motor, or the like connected to the mopping pad assembly 228, such as to the core 232 or a shaft connected thereto. The pad motor 238 can be connected to the body 202 and can be in communication with the controller 220 to operate the motor 238 to move the cleaning pad assembly 228 between the cleaning position and a stored position.

As shown in FIGS. 3A and 3B. when the robot 200 does not intend to perform a mopping operation (such as when planning to clean a carpeted floor surface), the controller 220 can operate the motor 238 to move the cleaning pad. assembly from the cleaning position shown in FIGS. 2A and 2B to the stored position shown in FIGS. 3A and 3B. In the stored position, the cap 236 can be oriented towards (such as parallel with) the floor surface 50 and can be configured to be flush with or not extend beyond a bottom surface of the body 202.

Also as shown in FIG. 3B), in the stored position, the pad 230 can be located within the pad housing 234 such that the pad 230 is not exposed to the environment, which can help keep the pad 230 wetted during vacuuming operations not involving mopping and can help to prevent the pad 230 from contacting carpeting during vacuuming operations of carpeted surfaces. When the robot 200 returns to a hard flooring surface (such as the flooring surface 250), the controller 220 can operate the motor 238 to rote the core 232. and the pad 230 such that the pad 230 moves out of the pad housing 234 and engages the floor surface 50. When the robot 200 returns to the hard flooring surface, the controller 220 can operate the motor 238 to return the pad 230 to its previous orientation before storage or to a new orientation to engage the surface 50 with a fresh portion of the pad.

Figure 4:
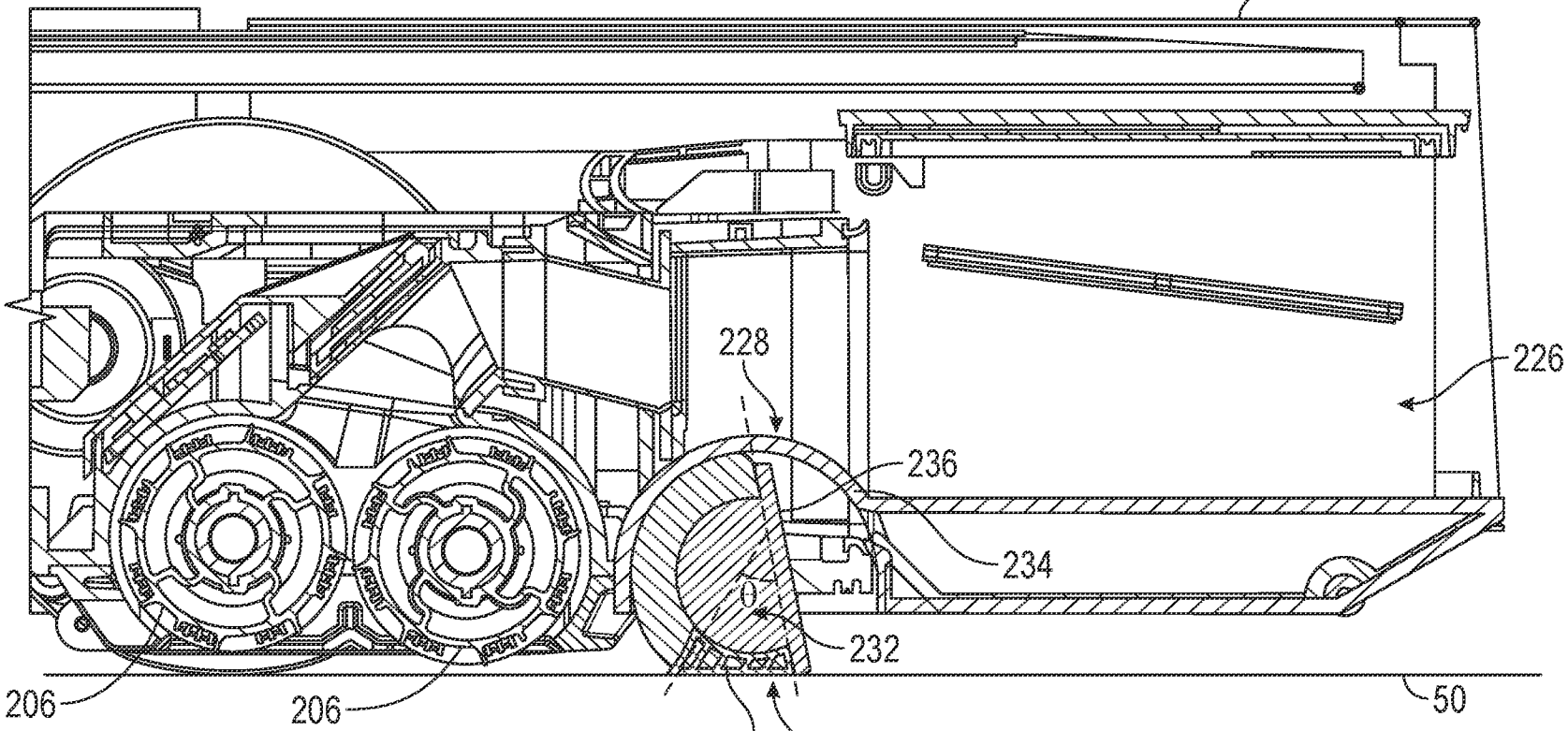
FIG. 4 illustrates a side cross-sectional view of a portion of a mobile cleaning robot.

FIG. 4 illustrates a side cross-sectional view of a portion of the mobile cleaning robot 200 where FIG. 4 shows the cleaning pad assembly 228 in a partially rotated position with respect to the body 202 of the robot 200 and with respect to the floor surface 50 such that only a portion 240 of the pad 230 engages the floor 50.

During mopping operations of the robot 200, the controller 220 can control the mopping pad assembly 228 to rotate through a range of rotation of the pad 230 and the core 232 with respect to the flooring surface 50 throughout a cleaning mission of the mobile cleaning robot 200. In some examples, the controller 220 can control the motor 238 to rotate the pad 230 to partially engage the cleaning surface 50, as shown in FIG. 4, such that a portion of the circumference, indicated by angle θ is engaged with the flooring surface 50.

The controller 220 can monitor the position of the pad 230 during mopping operations, such as by monitoring a rotational position of the core 232 (or a shaft connected thereto) using a sensor connected to the motor such as one or more of an encoder, end switches, a potentiometer, a Hall-effect sensor, or the like. The controller 220 can also monitor an amount of time the pad 230 is engaged with the floor surface 50 at each position of the range of rotation of the pad 230 that the pad is engageable with the floor 50. The controller 220 can simultaneously or alternatively monitor an amount of cleaned floor surface area the pad 230 engages at each range of rotation of the pad 230. The controller 220 can use such information to control the position of the pad 230.

For example, the controller 220 can slowly rotate the pad 230 during operation to attempt to evenly distribute time of contact between each portion of the pad 230 and the floor 50. To do so, the controller 220 can rotate the pad 230 to vary the angle θ that is engaged with the flooring surface 50 or can change the portion of the pad 230 that is engaged with the flooring surface 50. The controller 220 can rotate the pad 230 incrementally over time intervals. For example, every 60 seconds, the controller 220 can rotate the pad by 1, 2, 3, 4, 5, 6, 7, 9, 10 degrees, or the like. Also, the controller 220 can rotate the pad 230 continuously during operation where a rate of rotation can be selected, such as 1 degree per second or 1 degree per minute or the like.

In some examples, the controller 220 can operate the pad 230 to scrub the floor surface 50 during mopping operations. The scrubbing action by the pad 230 can be created by oscillating the roller position (angle θ) at a relatively higher speed (frequency). The scrubbing action by the pad 230 can also be created by vibrating the entire roller housing through an additional actuator for a temporary period of time after the robot has detected a stain or more difficult to clean area of the floor surface 50.

Figure 5:
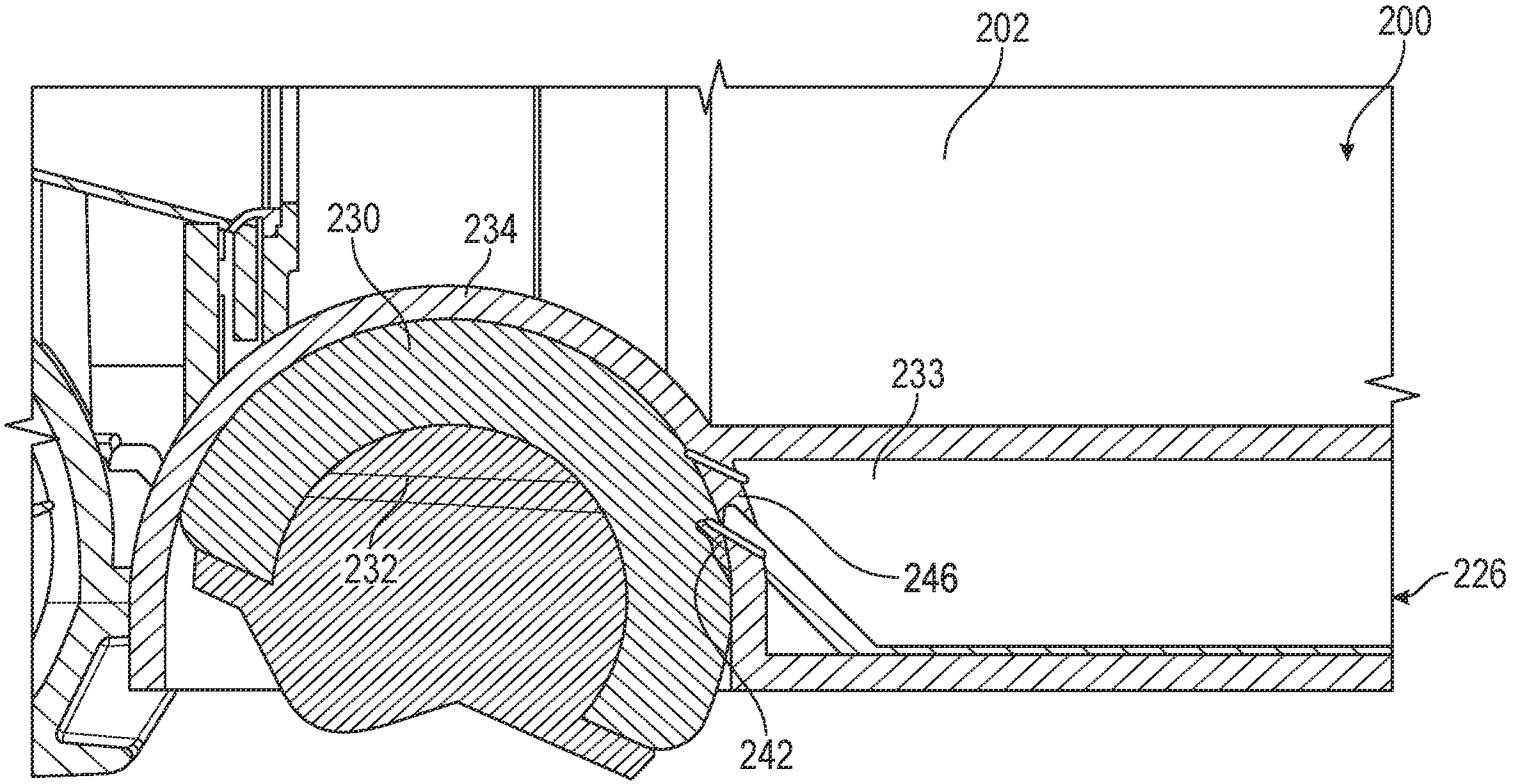
FIG. 5 illustrates a side cross-sectional view of a portion of a mobile cleaning robot.

FIG. 5 illustrates a side cross-sectional view of a portion of the mobile cleaning robot 200. The mobile cleaning robot 200 of FIG. 5 can be consistent with FIGS. 2A-4 discussed above, FIG. 5 shows that the housing 234 can include a. projection 242 that can be configured to engage the pad 230 as the pad 230 rotates into the housing 234. The projection 242 or scraper can compress the pad 230 as the pad 230 rotates into the housing 234 and engages the projection 242, compressing the pad 230 and causing fluid or water to move out of the pad 230. The projection 242 can also help to remove fine dust or debris from the pad 230 to help keep the pad 230 clean during engagement with the floor surface 50.

The fluid and debris can be collected into the tank or fluid chamber 233 (that can optionally be part of the debris bin 226) through a channel 246. In some examples, fluid can be reintroduced to the pad after engagement with the projections 242 to help replenish or refresh the pad 230 with new or clean fluid.

Figure 6:
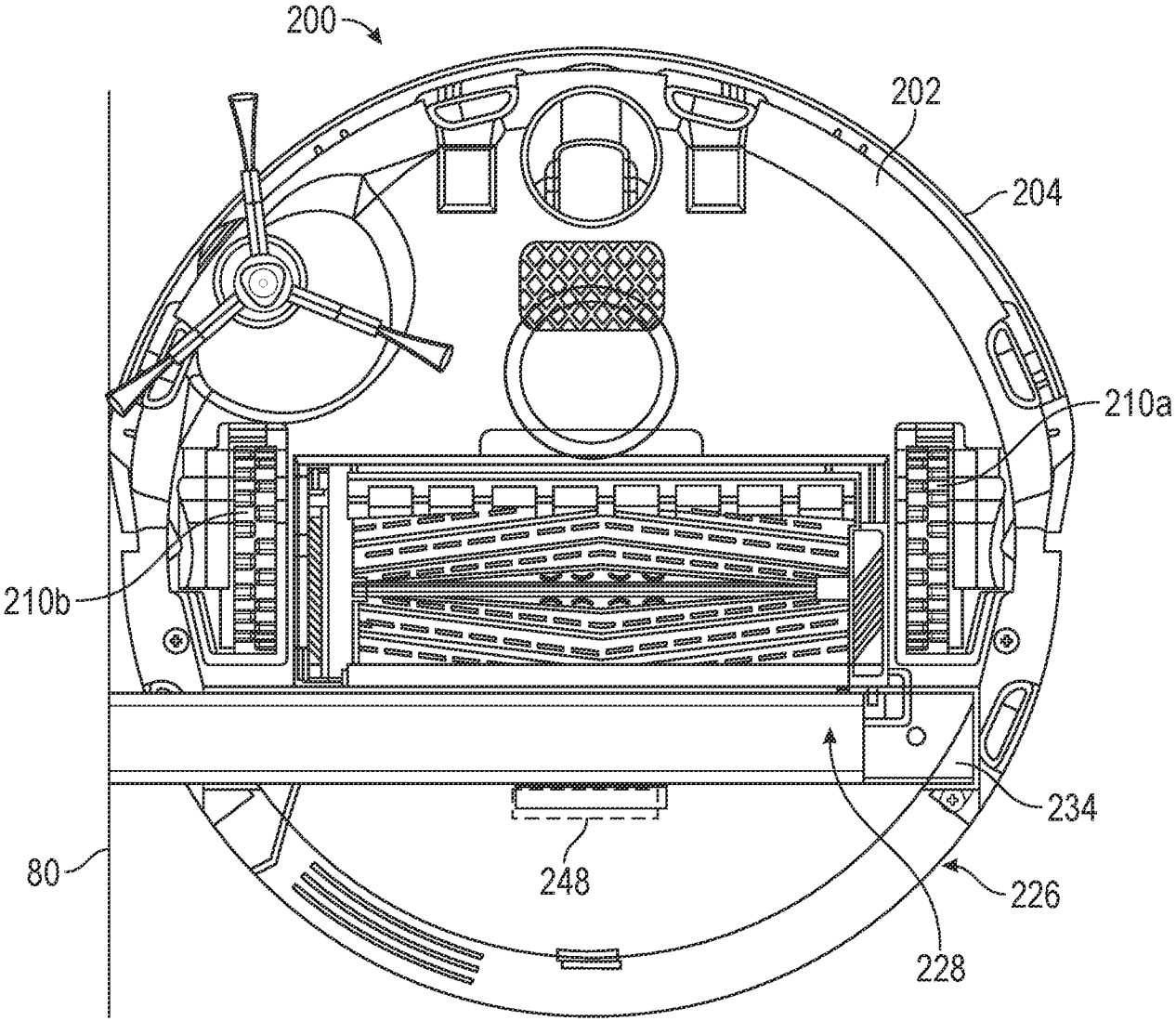
FIG. 6 illustrates a bottom view of a mobile cleaning robot.

FIG. 6 illustrates a bottom view of the mobile cleaning robot 200. The mobile cleaning robot 200 of FIG. 6 can be consistent with FIGS. 2A-4 discussed above, FIG. 6 shows that the housing 234 can include an actuator 248 that can be connected to the body 202 and to the pad assembly 228, such as to the core 232 or to a shaft hereof.

The actuator 248 can be in communication with the controller 220 where the controller 220 can transmit instructions to the actuator 248 to translate the pad assembly laterally outward for edge cleaning. For example, when the controller 220 detects an edge surface 80, the controller 220 can operate the actuator 248 to translate the pad assembly 228 outward to be positioned near or adjacent the edge surface 80 to help the robot 200 clean the edge surface 80 or to clean the floor surface 50 near the edge surface 80. When the controller 220 determines that an edge surface is no longer present, the controller 220 can operate the actuator 248 to reposition the pad assembly 228 in a center of the robot body 202.

Figure 7B:
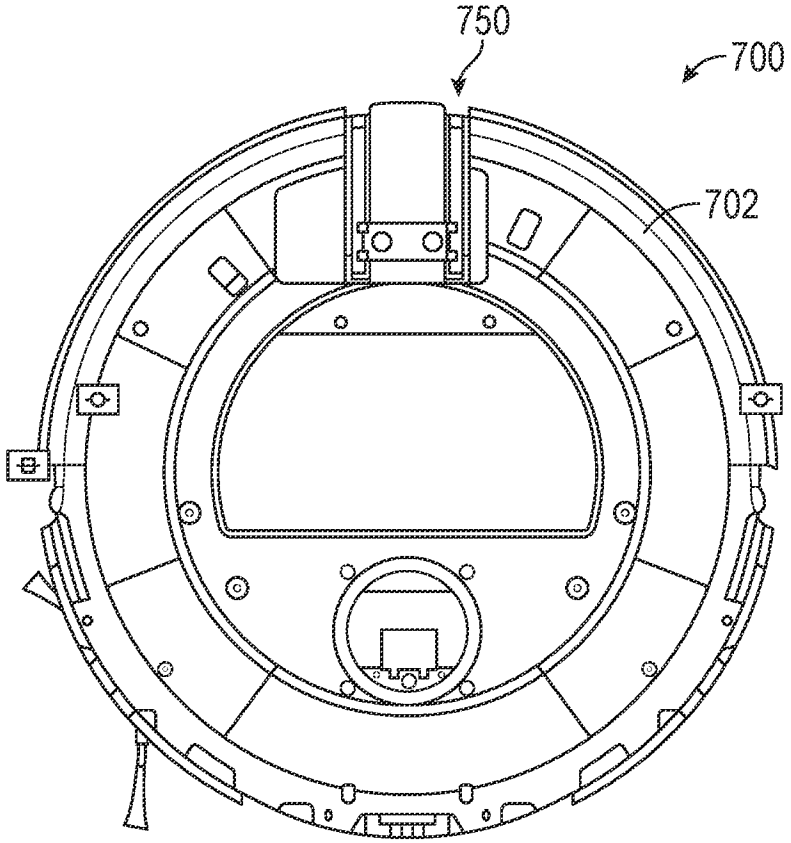
FIG. 7B illustrates a top view of a mobile cleaning robot.
Figure 7A:
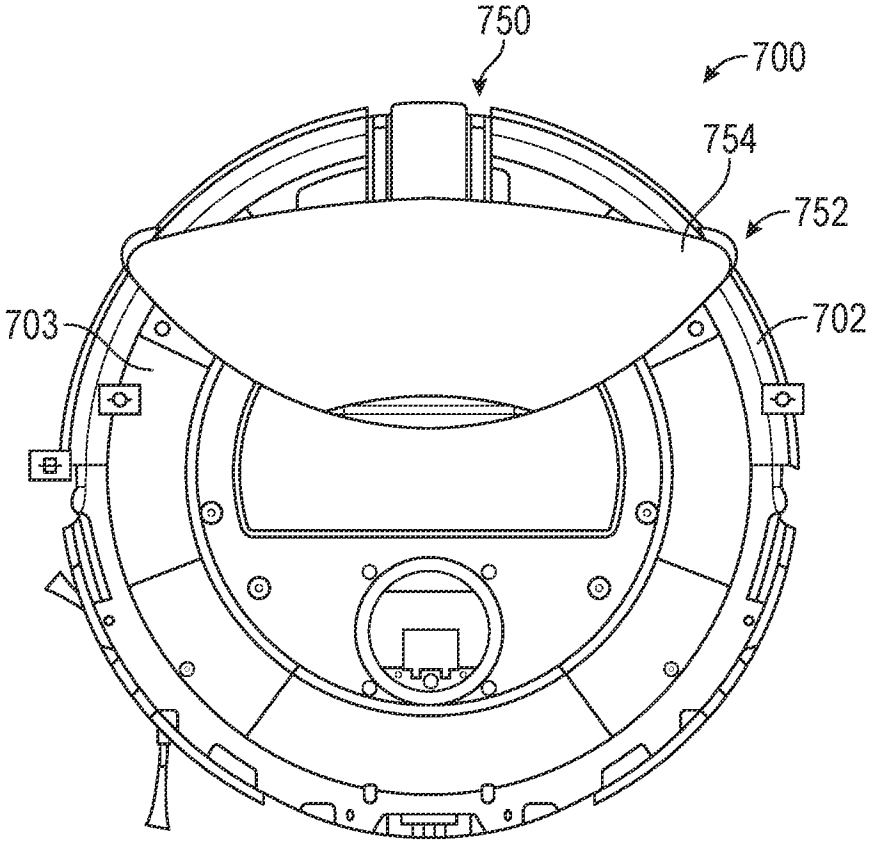
FIG. 7A illustrates a top view of a mobile cleaning robot.

FIG. 7A illustrates a top view of a mobile cleaning robot 700. FIG. 7B illustrates a top view of the mobile cleaning robot. FIGS. 7A and 7B are discussed together below.

The mobile cleaning robot 700 can be similar to the mobile cleaning robot 200 discussed above, in that the robot 700 can include a body 702, drive wheels, a controller, etc. The mobile robot 700 can include a pad drive system 750 connected to a pad assembly 752 (including a mopping pad 754) where the drive pad system 750 can be operable to move the pad assembly from a stored position at a top portion 703 of the robot 700, as shown in FIG. 7A, FIG. 7A, to a cleaning position underneath the body 702 of the robot 700 where the pad 754 can engage a flooring surface for mopping of the flooring surface. The robot 700 can optionally include a vacuum assembly. Additional details of the robot 700 are discussed below.

Figure 8A:
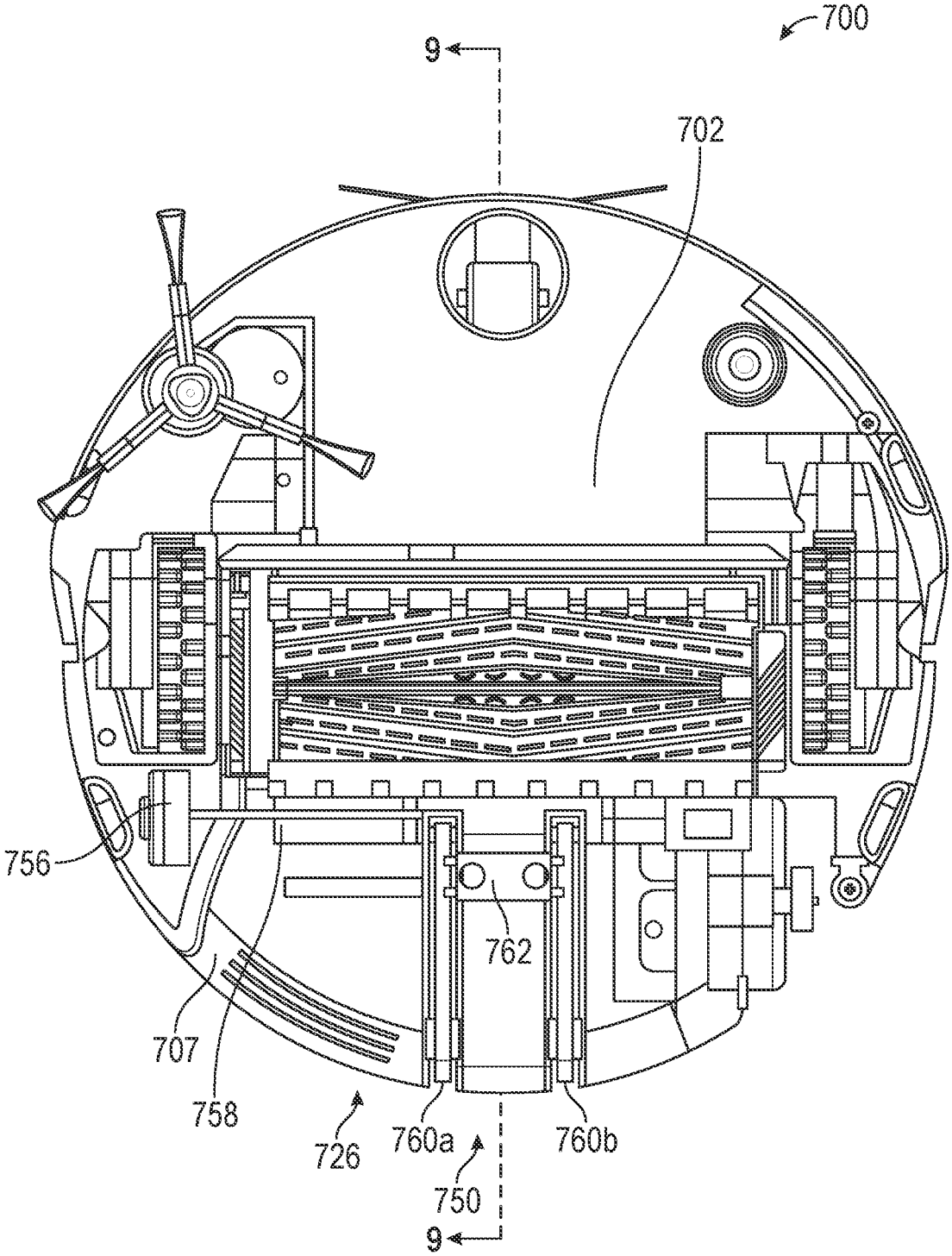
FIG. 8A illustrates a bottom view of a mobile cleaning robot.
Figure 8B:
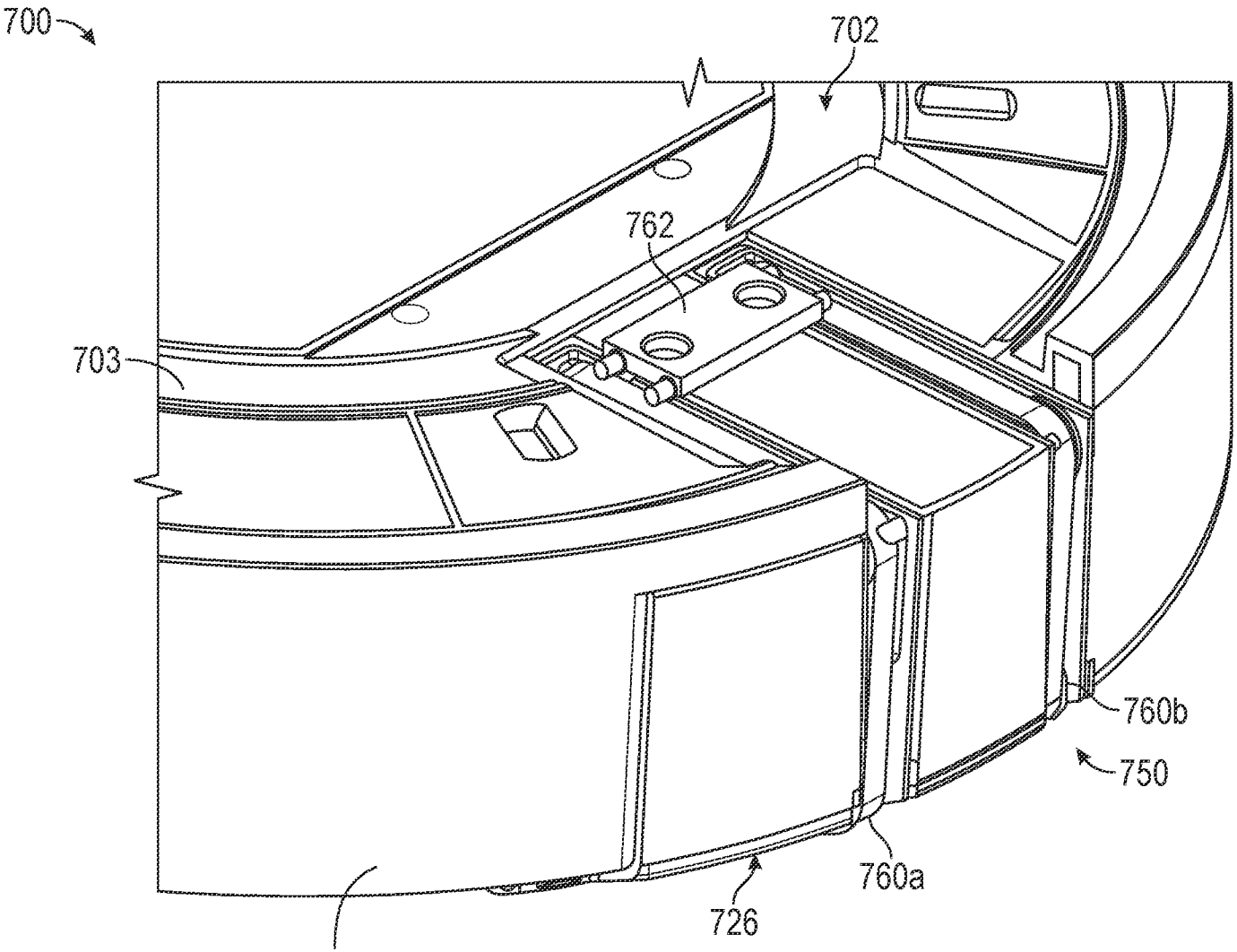
FIG. 8B illustrates a top isometric view of a portion of a mobile cleaning robot.

FIG. 8A illustrates a bottom view of the mobile cleaning robot 700 with the cleaning pad removed. FIG. 8B illustrates a top isometric view of a portion of the mobile cleaning robot 700. FIGS. 8A and SB show additional details of the robot 700.

For example, FIGS. 8A and 8B show how the pad drive system 750 can be connected to the debris bin 726 and can extend from the top portion 703 of the body 702, as shown in FIG. 8B, to a bottom portion 707 of the body 702, as shown in FIG. 8A. FIG. 8A also shows that the pad drive system 750 can include a motor 756, a shaft 758, drive tracks 760*a* and 760*b* (collectively referred to as drive tracks 760 or tracks 760 or belts 760), and a track connector 762 (or pad connect 762).

The motor 756 can be an electric motor connected to the shaft 758 and can be operable to drive the shaft 758 to rotate about an axis of the shaft 758. The motor 756 can be a fixed speed motor or a variable speed electric motor powered by a power source. The motor 756 can be in communication with a controller (such as the controller 220). The shaft 758 can be connected to the drive tracks 760 (such as through one or more pulley or gears) such that the motor 756 can be operated to rotate the tracks 760.

The drive tracks 760 can be connected to the body 702 (such as via pulleys and supports) and the drive tracks 760*a* and 760*b* can be connected to the mopping pad assembly 752 via the track connector 762, where the track connector 762. is secured to the drive tracks 760. The drive tracks 760 can extend from the bottom 707 of the body 702 around an outer edge 764 of the body 702 (such as the debris bin 726) and along a portion of the top 703 of the body 702.

In operation of some examples, the motor 756 can be operated by the controller 220 to rotate the shaft 758 to drive the drive tracks 760 to move the pad connect 762 and therefore the pad assembly 752 between the cleaning position (on an underside of the robot body 702) and between the stored position (above or on top of the robot body 702).

Figure 9:
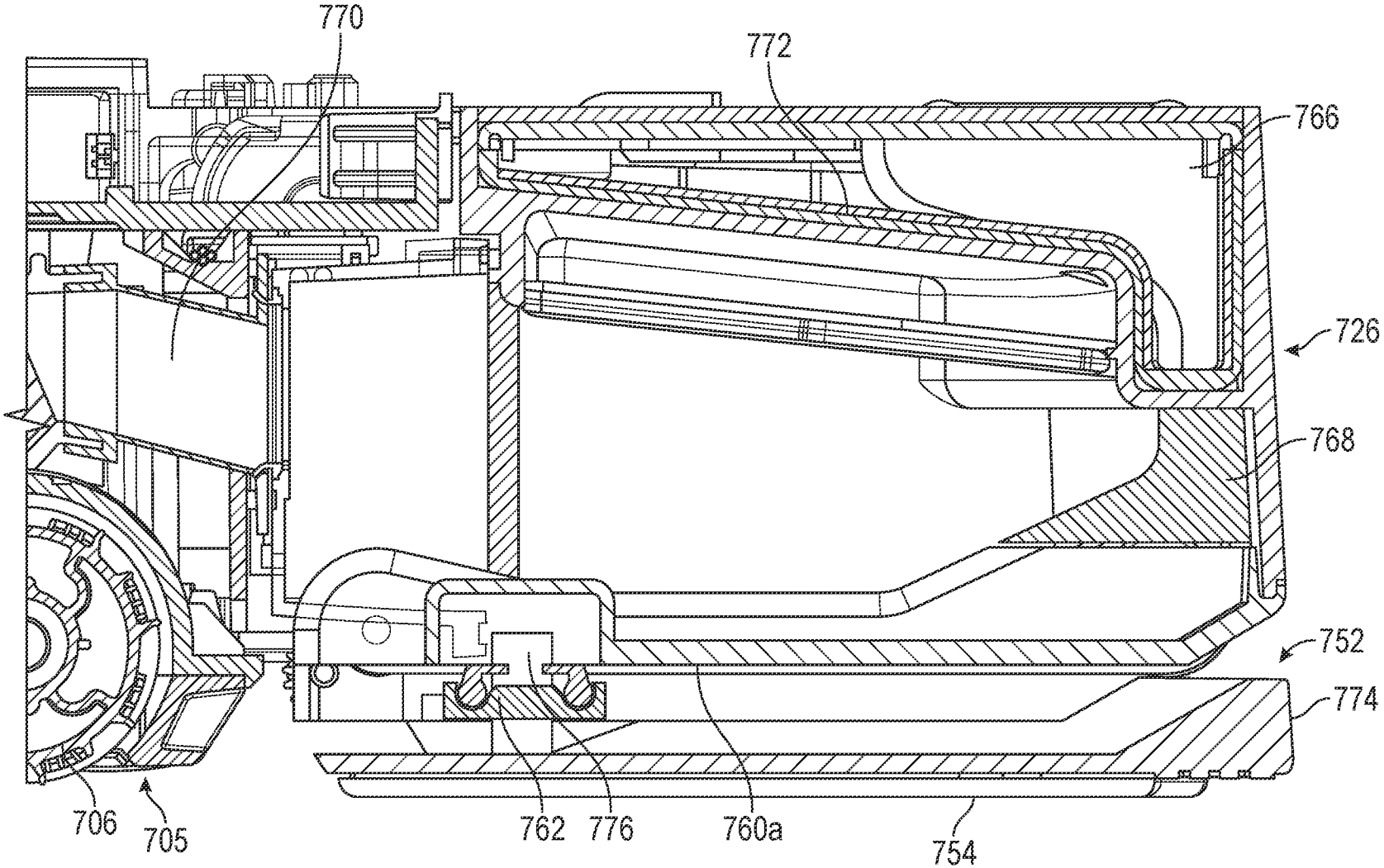
FIG. 9 illustrates a side cross-sectional view across indicators 9-9 of FIG. 8A of a portion of a mobile cleaning robot.

FIG. 9 illustrates a side cross-sectional view across indicators 9-9 of FIG. 8A of a portion of the mobile cleaning robot 700. FIG. 9 shows that the debris bin 726 can include a water tank 766 and a dry bin 768. The dry bin 768 can be connected to the extractor 705 (including the rollers 706 only one shown in FIG. 9) via a debris path 770 through the body 702 where the dry bin 768 can be configured to receive and store debris extracted from the extractor 705 during vacuum operations.

The water tank 766 can be configured to store cleaning fluid or water for replenishing of the cleaning pad 754 during mopping operations or during storage of the pad assembly 752 between mopping operations. The cleaning pad 754 can be a semi-rigid and porous material such as one or more of cloth, foam, polymer, or the like, such that the pad 754 is configured to retain fluid and fine debris or dust. In some examples, the pad 754 can be a dry pad such as for dusting or dry debris removal. The pad 754 can also be any cloth, fabric, or the like configured for cleaning (either wet or dry) of a floor surface. The water tank 766 can be separated from the dry bin 768 by a wall 772 to help keep the dry bin 768 and its contents from becoming wet during mopping operations and to help keep fluid in the water tank 766 from becoming dirty.

FIG. 9 also shows that the pad assembly 752 can include a pad tray 774 connected to the pad 754 and connected to the pad connector 762 via posts 776 of the pad tray 774. The pad tray 774 can be a rigid or semi-rigid member configured to support the cleaning pad 754 and to connect the cleaning pad 754 to the drive tracks 760.

Figure 10:
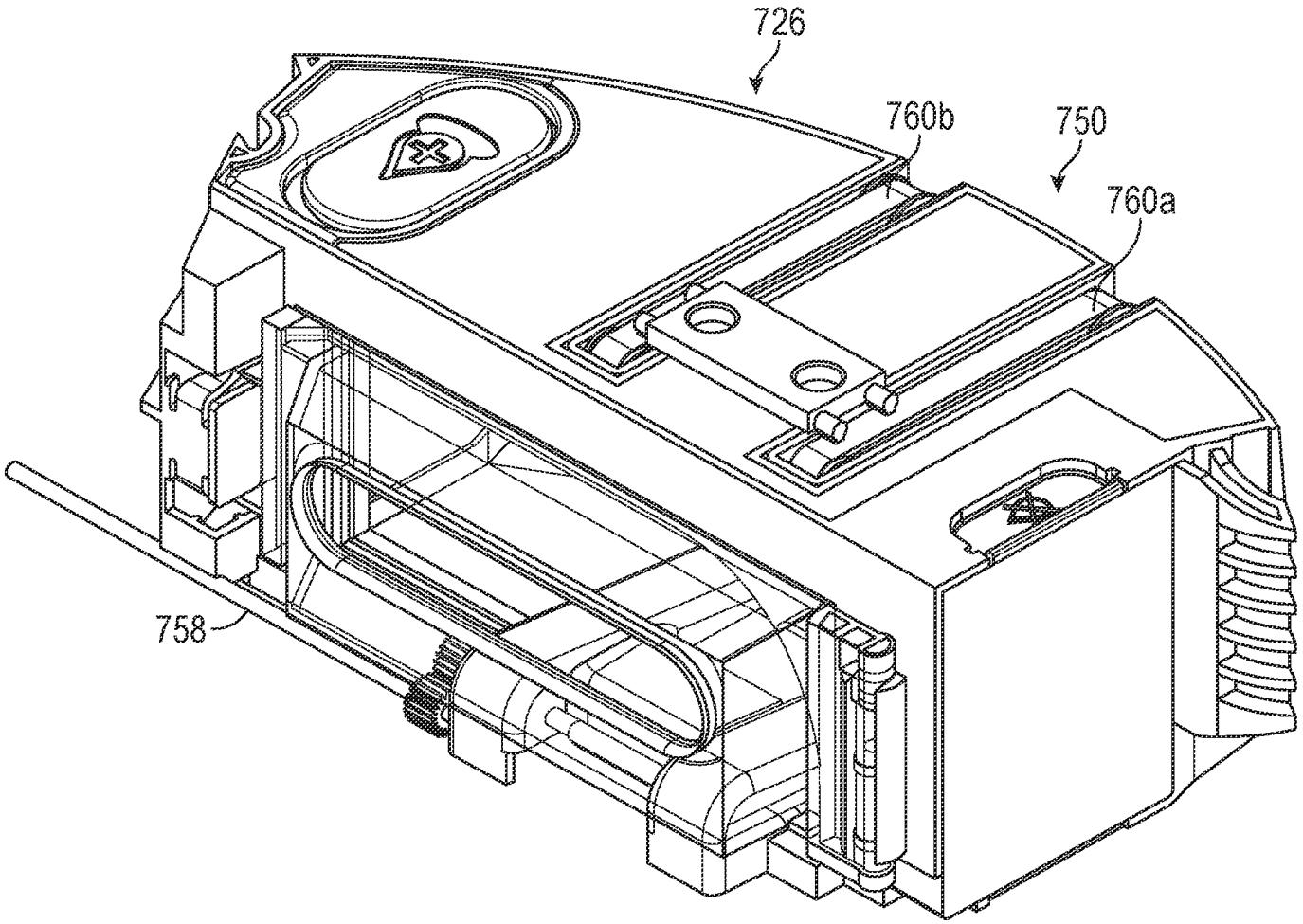
FIG. 10 illustrates an isometric view of a portion of a mobile cleaning robot.
Figure 11:
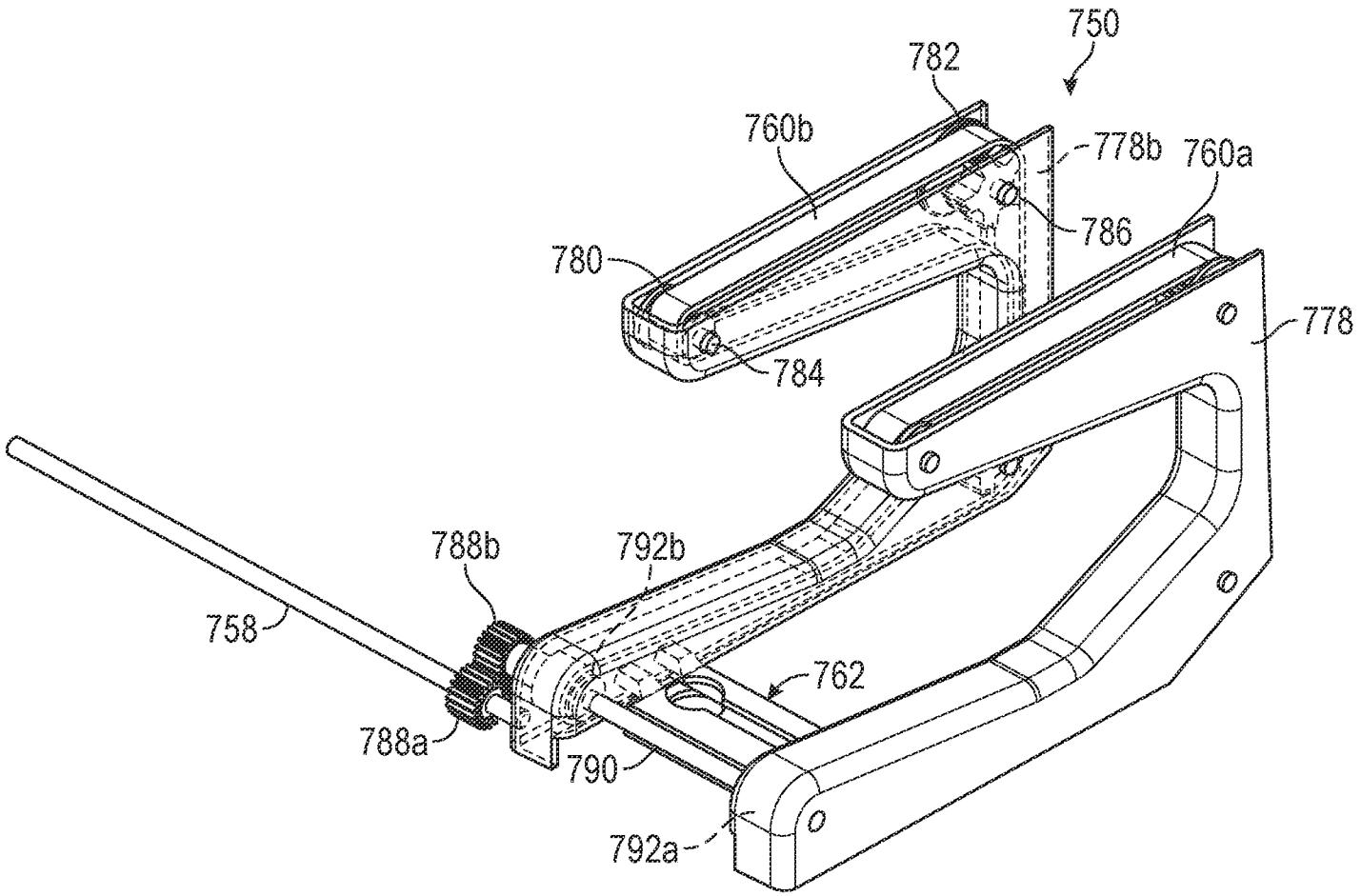
FIG. 11 illustrates an isometric view of a portion of a mobile cleaning robot.

NG. 10 illustrates an isometric view of a portion of the mobile cleaning robot 700. FIG. 11 illustrates an isometric view of a portion of the mobile cleaning robot 700. FIGS. 10 and 11 show additional details of the bin 726 and the pad drive system 750. For example, the pad drive system 750 can include frames 778, pulleys 780 and 782, pins 784 and 786, a drive gear 788*a*, a driven gear 788*b*, and a driven shaft 790.

FIG. 11 shows that the drive belts 760*a* and 760*b* can be connected to the drive frames 778*a* and 778*b*, respectively, and FIG. 10 shows that the frames 778 can be rigid members connected to the bin 726, which can connect the belts 760 to the bin 726 and the body 702 of the robot 700.

The drive gear 788*a* and the driven gear 788*b* can be spur gears, helical gears, bevel gears, or the like. FIG. 11 also shows that the drive shaft 758 (which can be connected to the motor 756—shown in FIG. 8A) can be connected to the drive gear 788*a* and the drive gear 788*a* can be coupled to the driven gear 788*b*. The driven gear 788*b* can be connected to the driven shaft 790, which can be connected to drive pulleys 792*a* and 792*b* secured to the frames 778*a* and 778*b*, respectively. When the bin 726 is removed, the drive gear 788*a* can separate from the driven gear 788*b* (such as by teeth of the gears disengaging) to help allow the pad drive system 750 and bin 726 to be removed from the body 702 of the robot for maintenance or cleaning.

The drive pulleys 792*a* and 792*b* can be engaged with the drive tracks 760*a* and 760*b*, respectively. The drive tracks 760*a* and 760*b* can also be supported on the frames 778 and 778*b*, respectively, by idler pulleys. For example, the drive track 760*b* can be connected to the frame 778*b* by pulleys 780 and 782, where the pulleys 780 and 782 can be connected to the frame 778*b* by pins 784 and 786, respectively. The frame 778*a* can be similarly configured; the frames 778*a* and 778*b* can include additional pulleys to guide rotation of the drive tracks 760*a* and 760*b* about the frames 778*a* and 778*b*, respectively.

In operation, the drive shaft 758 can be driven by the motor 756 to rotate about its axis, which can drive the drive gear 788*a* to rotate therewith. The drive gear 788*a*, being engaged with the driven gear 788*b*, can rotate the driven gear 788*b* 1 to drive the driven shaft 790. The driven shaft 790 can drive the drive pulleys 792*a* and 792*b* to rotate to drive the drive tracks 760*a* and 769*b* about the frames 778*a* and 778*b* to move the pad connect 762 (and therefore the pad assembly 752) between a cleaning position and a stored position.

Figure 12:
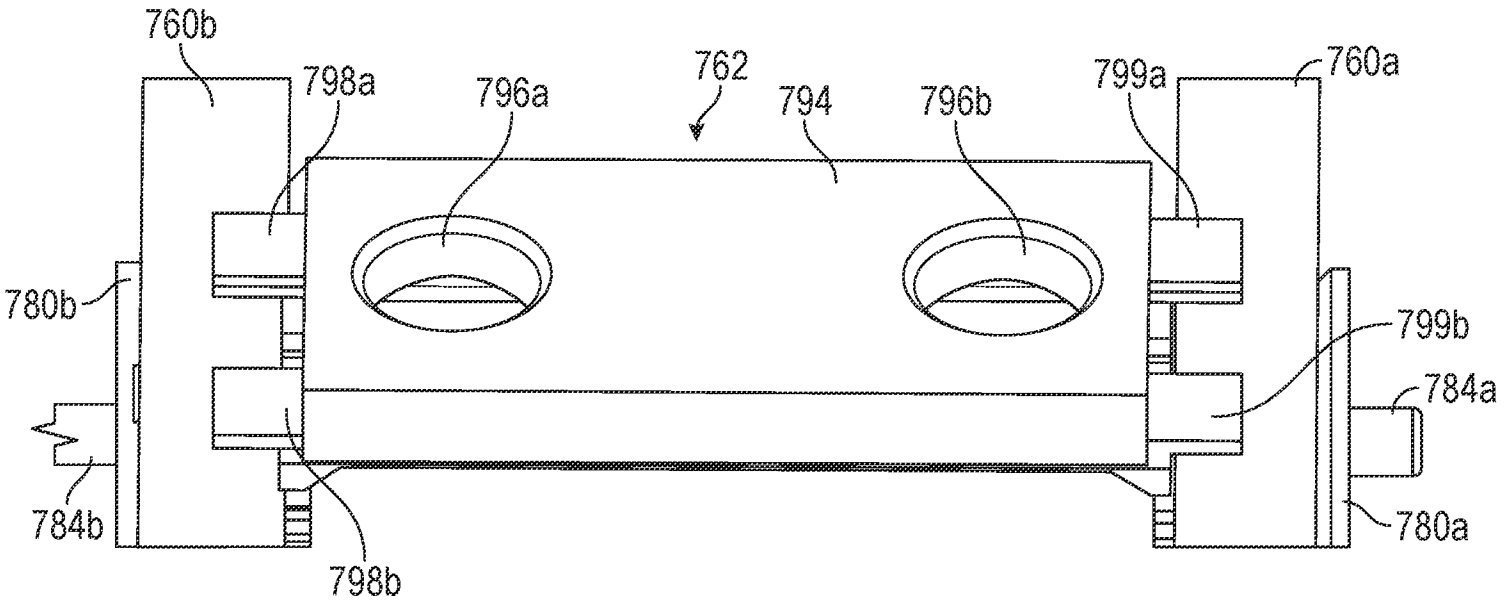
FIG. 12 illustrates an isometric view of a portion of a mobile cleaning robot.
Figure 13:
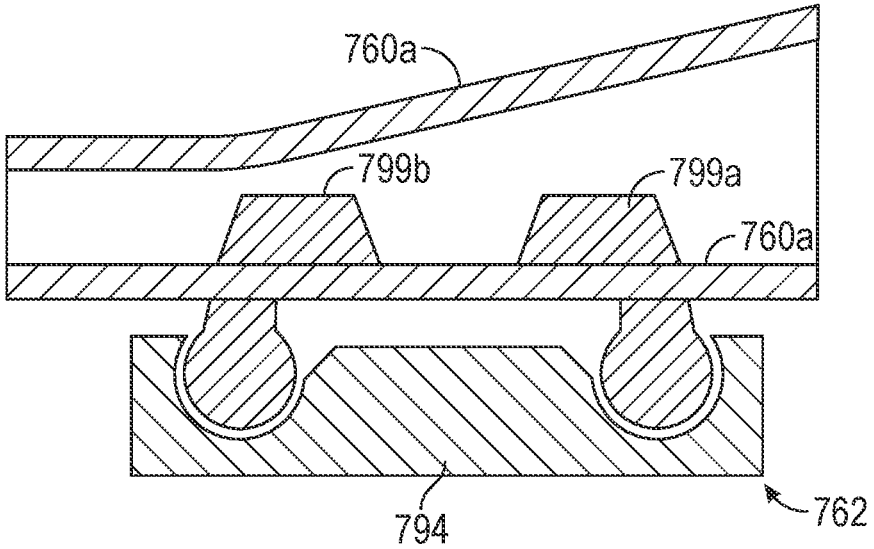
FIG. 13 illustrates a side view of a portion of a mobile cleaning robot.

FIG. 12 illustrates an isometric view of a portion of the mobile cleaning robot 700. FIG. 13 illustrates a side view of a portion of the mobile cleaning robot 700. FIGS. 12 and 13 are discussed together below.

FIG. 12 shows that the pad connect 762 can include a plate 794 including bores 796*a* and 796*b*, where the bores 796 can be configured to receive posts 776 of the pad tray 774 therethrough to secure the pad tray 774 to the plate 794 of the pad connect 762. FIGS. 12 and 13 also show that the pad connect 762 can include fingers 798*a* and 798*b* extending outward from the pad plate 794 that can be configured to connect the pad plate 794 to the drive track 760*b*. Similarly, the pad connect 762 can include fingers 799*a* and 799*b* extending outward from the pad plate 794 to connect the pad plate 794 to the drive track 760*a*. The fingers 798 and 799 can connect to the tracks 760 through a friction interface, fasteners, or the like. Also, the fingers 798 and 799 can include projections to engage with ribs or notches of the tracks 760 and to help limit relative movement of the tracks 760 with respect to the pad connect 762.

Figure 14:
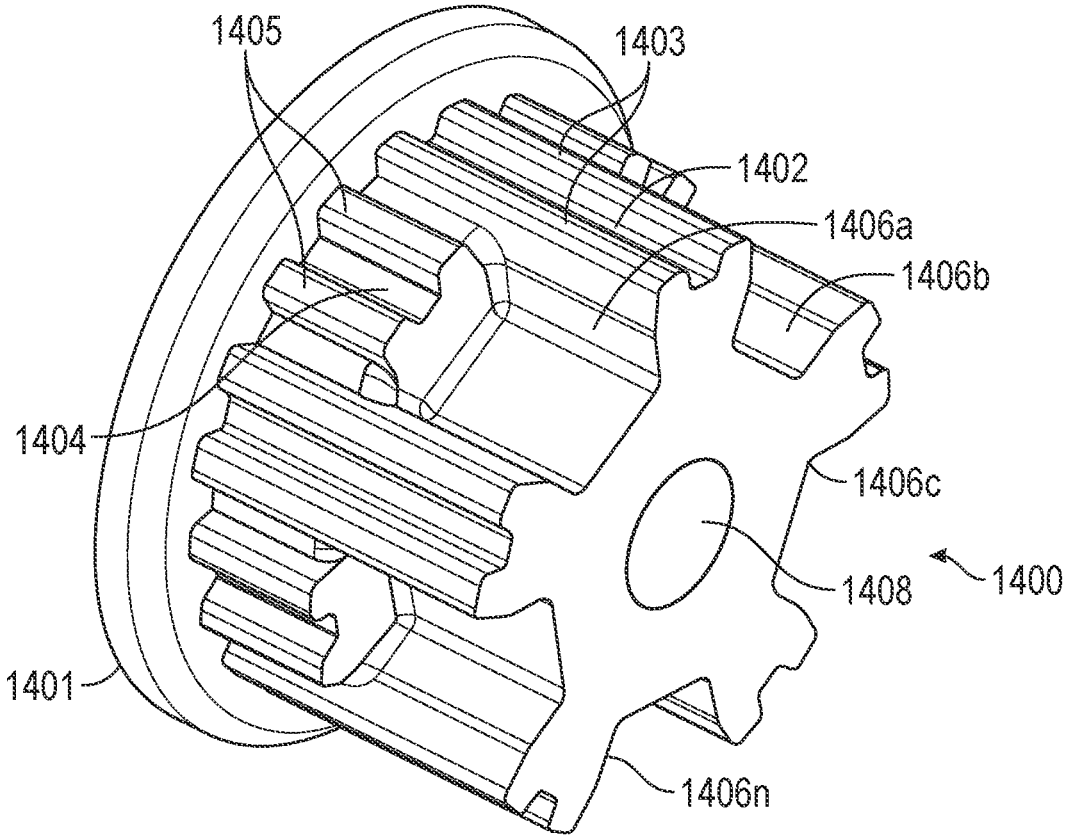
FIG. 14 illustrates an isometric view of a pulley of a mobile cleaning robot.

FIG. 14 illustrates an isometric view of a pulley 1400 of a mobile cleaning robot. The pulley 1400 can be any of the pulleys of the pad drive system 750 discussed above. The pulley 1400 can include a bore 1408 extending through a body 1401 of the pulley 1400. The bore 1408 can receive a pin or shaft (such as the pin 784*a* of FIG. 12) to secure the pin or shaft to the pulley 1400.

The pulley 1400 can also include long teeth 1403 separated by recesses 1404 and short teeth 1405 separated by recesses 1406. The pulley can also include notches 1406*a*-1406*n* that can be shaped to receive the fingers 798 or 799 of the pad connect 762 to allow the pad connect 762 to move pas the pulley 1400 when the tracks 760 are moved around the frames 778, which can help to move the pad. assembly 752 between the cleaning position and the stored position.

The short teeth 1405 and recesses 1404 can be circumferentially aligned with the notches 1406 and the long teeth 1403 and recesses 1402 can be located circumferentially between the notches 1406, which can help to allow the teeth 1403 and 1405 and notches 1402 and 1404 can remain in contact with the track(s) 760 when a finger (e.g., 798*a*) passes the pulley 1400 and enters a notch (e.g., 1406*a*).

Figure 15A:
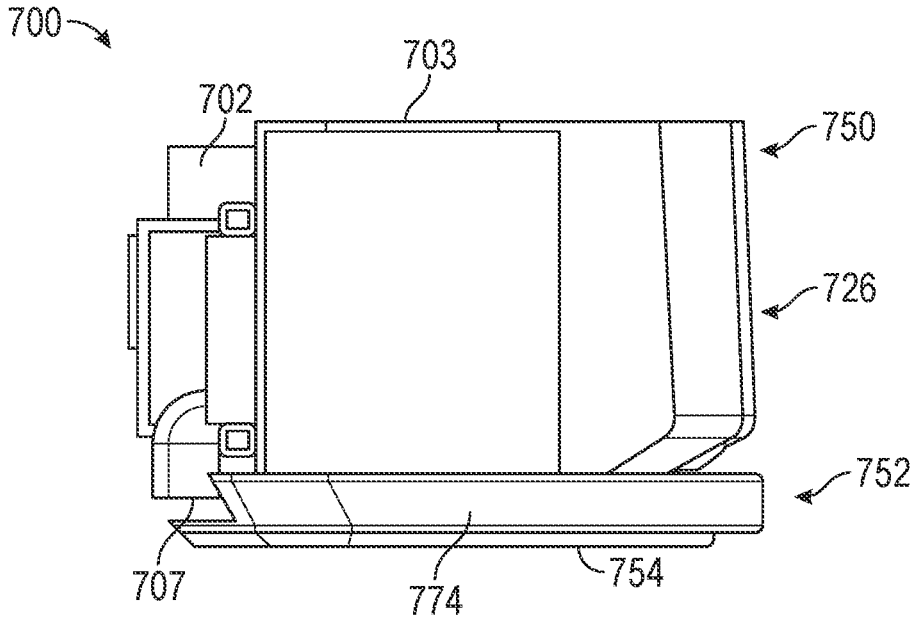
FIG. 15A illustrates a side view of a portion of a mobile cleaning robot.
Figure 15B:
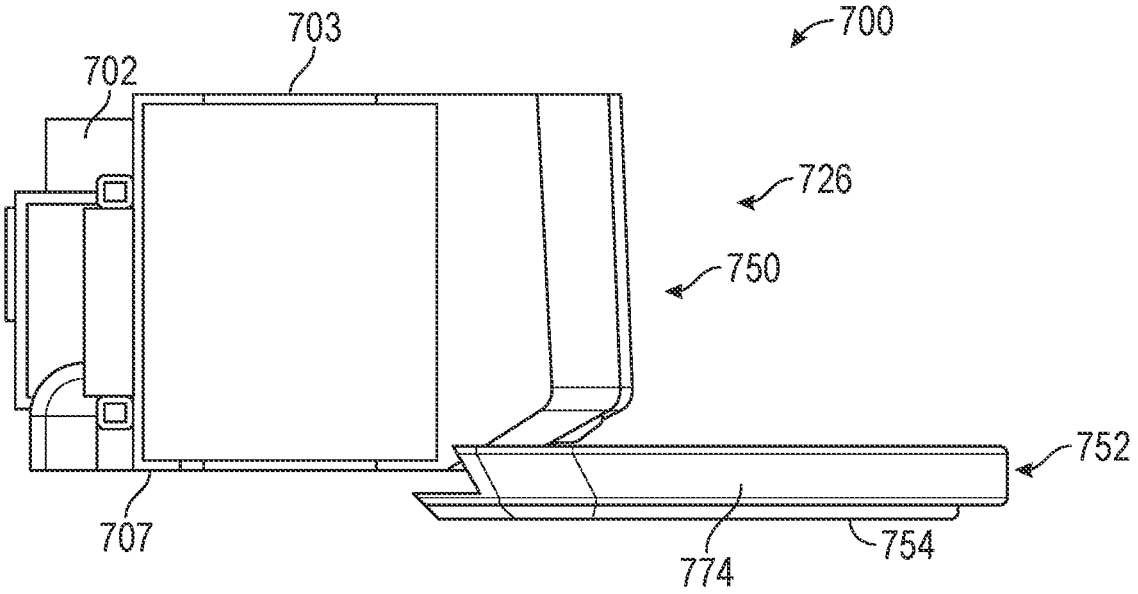
FIG. 15B illustrates a side view of a portion of a mobile cleaning robot.
Figure 15C:
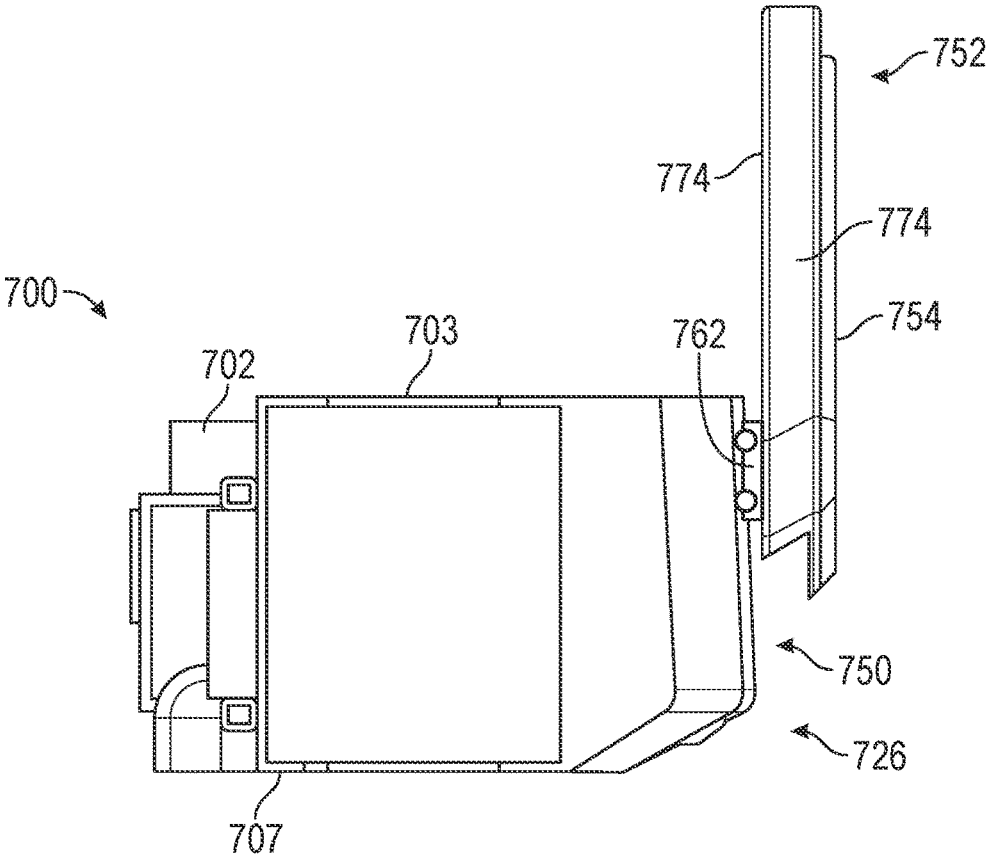
FIG. 15C illustrates a side view of a portion of a mobile cleaning robot.
Figure 15D:
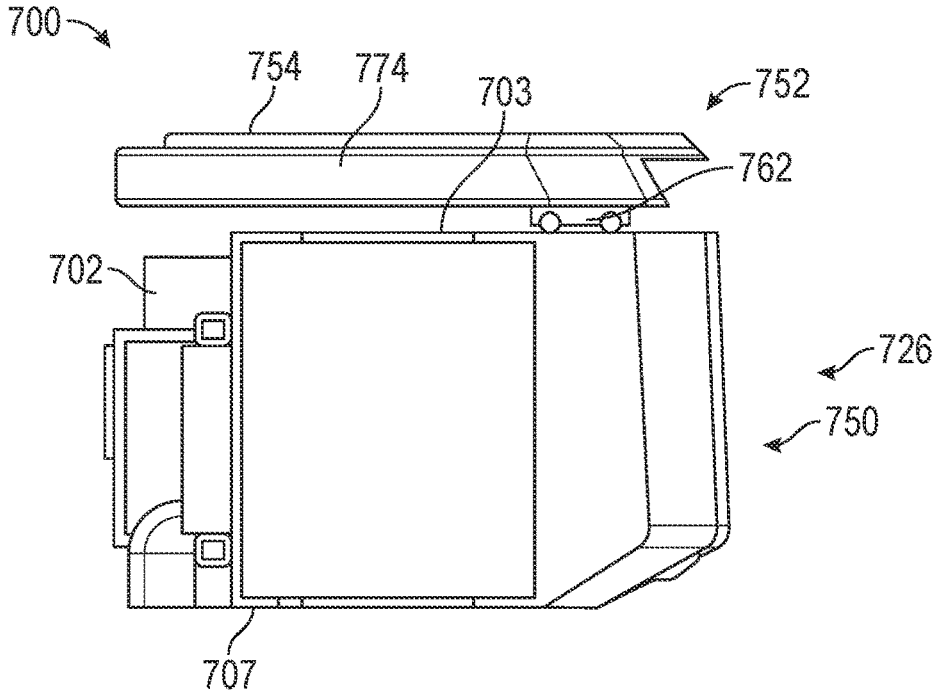
FIG. 15D illustrates a side view of a portion of a mobile cleaning robot.

FIG. 15A illustrates a side view of a portion of the mobile cleaning robot 700. FIG. 15B illustrates a side view of a portion of the mobile cleaning robot 700. FIG. 15C illustrates a side view of the portion of a mobile cleaning robot 700. FIG. 15D illustrates a side view of a portion of the mobile cleaning robot 700. FIGS. 15A-15D are discussed together below.

FIG. 15A shows that the pad assembly 752 can be below the robot body 702 when the pad assembly 752 is in a cleaning position, such that the pad 754 can be oriented toward and located near a cleaning surface. Then, when the robot 700 (such as the controller 220) determines that the mopping assembly 752 is required to move to the stored position (such as for docking or to clean a carpeted surface), the controller 720 can control the motor 756 to drive the drive shaft 758 to drive the tracks 760 (as discussed above) to move the pad connect 762 and the pad assembly 752 laterally, as shown in FIG. 15B.

An encoder, a Hall effect sensor, or one or more limit switches can be in communication with the controller (such as the controller 220) and can be used to detect a position of the tracks 760. The controller can select or stop the location of the mopping assembly 752 for service such as pad removal by a user or for automatic pad cleaning at a dock. The controller can also select the location of the mopping pad assembly 752 to be position outward for edge cleaning or other functions.

The motor 756 can continue to move the tracks 760 to bring the pad assembly 752 around pulleys of the drive assembly 750 and into a vertical position, as shown in FIG. 15C. The motor 756 can further move the pad assembly 752 from the vertical position of FIG. 15C to a horizontal position, as shown in FIG. 15D, where the pad assembly can the substantially parallel with the top surface 703 of the body 702 and where the pad assembly 752 is in a stored position. In such a position, the pad 754 can be oriented upwards, which can allow the pad to dry when the pad is in the stored position, such as when the robot 700 is docked after completing a mopping mission.

Figure 16A:
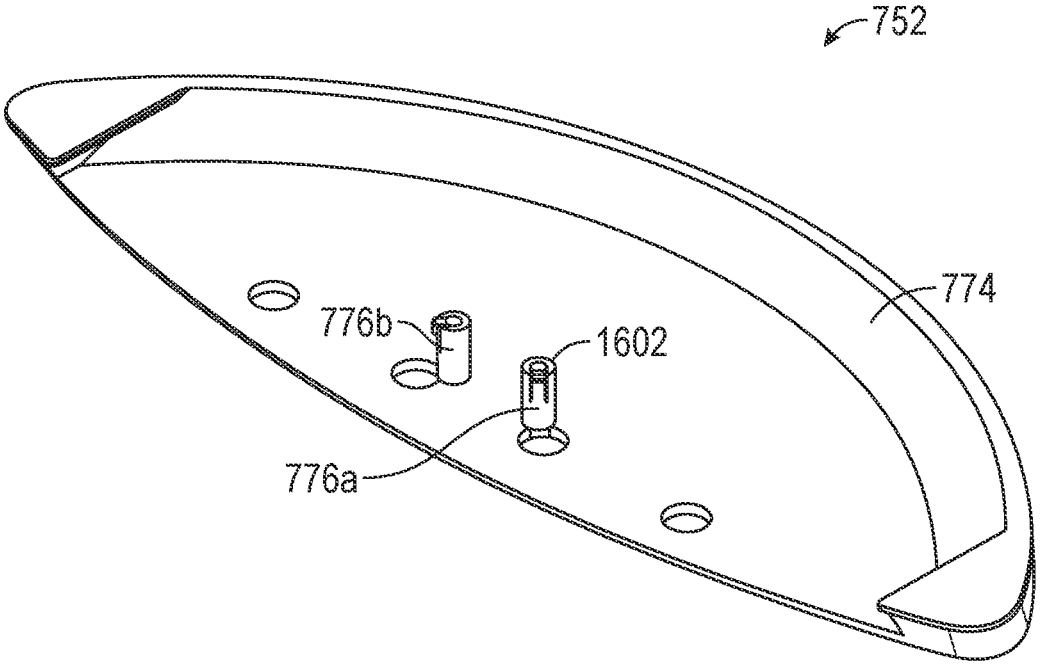
FIG. 16A illustrates an isometric top view of a pad assembly of a mobile cleaning robot.
Figure 16B:
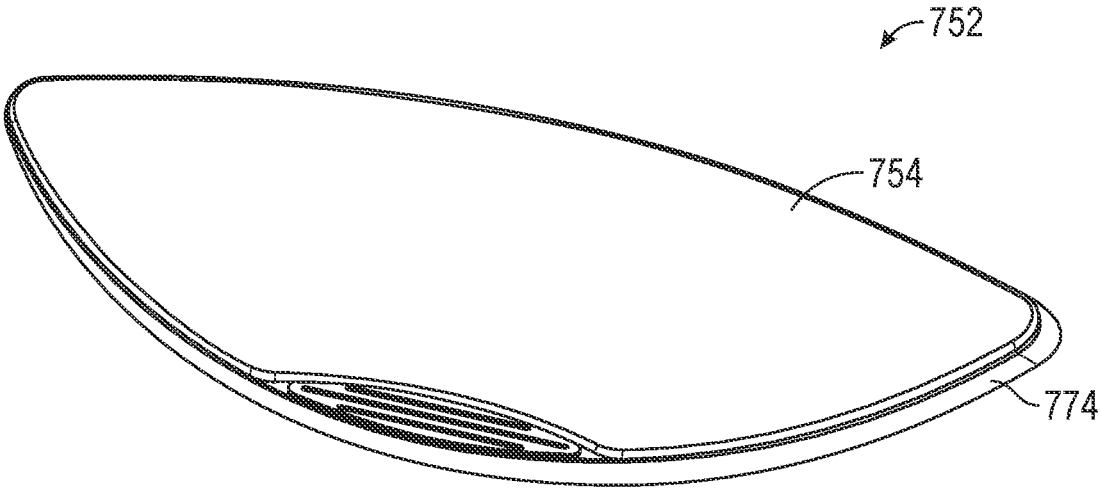
FIG. 16B illustrates an isometric bottom view of a pad assembly of a mobile cleaning robot.

FIG. 16A illustrates an isometric top view of the pad assembly 752 of the mobile cleaning robot 700. FIG. 16B illustrates an isometric bottom view of the pad assembly 752 of the mobile cleaning robot 700. FIGS. 16A and 16B are discussed together below.

FIG. 16A shows that the pad tray 774 can include bosses (or posts) 776*a* and 776*b* that can extend upward from a surface of the pad tray 774. Each post 776 can include projections 1602, which can be snap fit features where the projections 1602 can be deflected inward through engagement with the bores 796 of the plate 794 of the pad connect 762 during attachment of the pad connect 762 to the plate 794. Once the posts 776 are fully inserted into the bores 796, the projections 1602 can deflect outward. The projections 1602 (together with the posts 776, e.g., post 776*a*) can create a post diameter at the projection 1602 larger than the bores 796 to help limit the posts 776 from passing back through the plate 794 and disconnecting from the pad connect 762.

FIG. 16B shows the mopping pad 754 connected to the tray 774 on a side of the tray 774 opposite the posts 776 such that when the mopping pad 754 is oriented toward a flooring surface, the posts 776 can be oriented away from the pad 754 and the flooring surface.

Figure 17A:
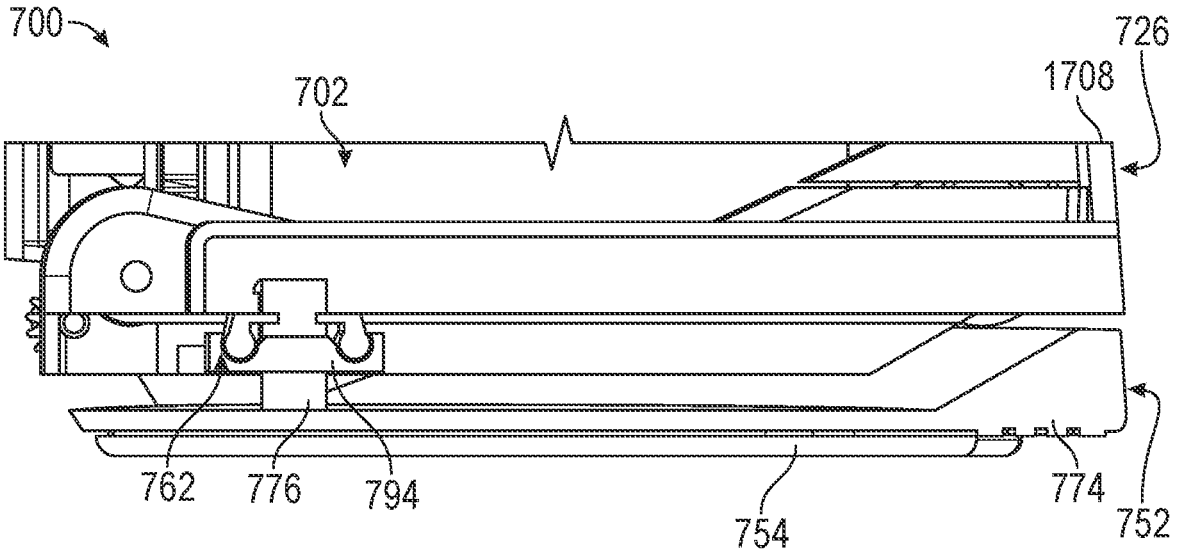
FIG. 17A illustrates a side cross-sectional view of a portion of a mobile cleaning robot.
Figure 17B:
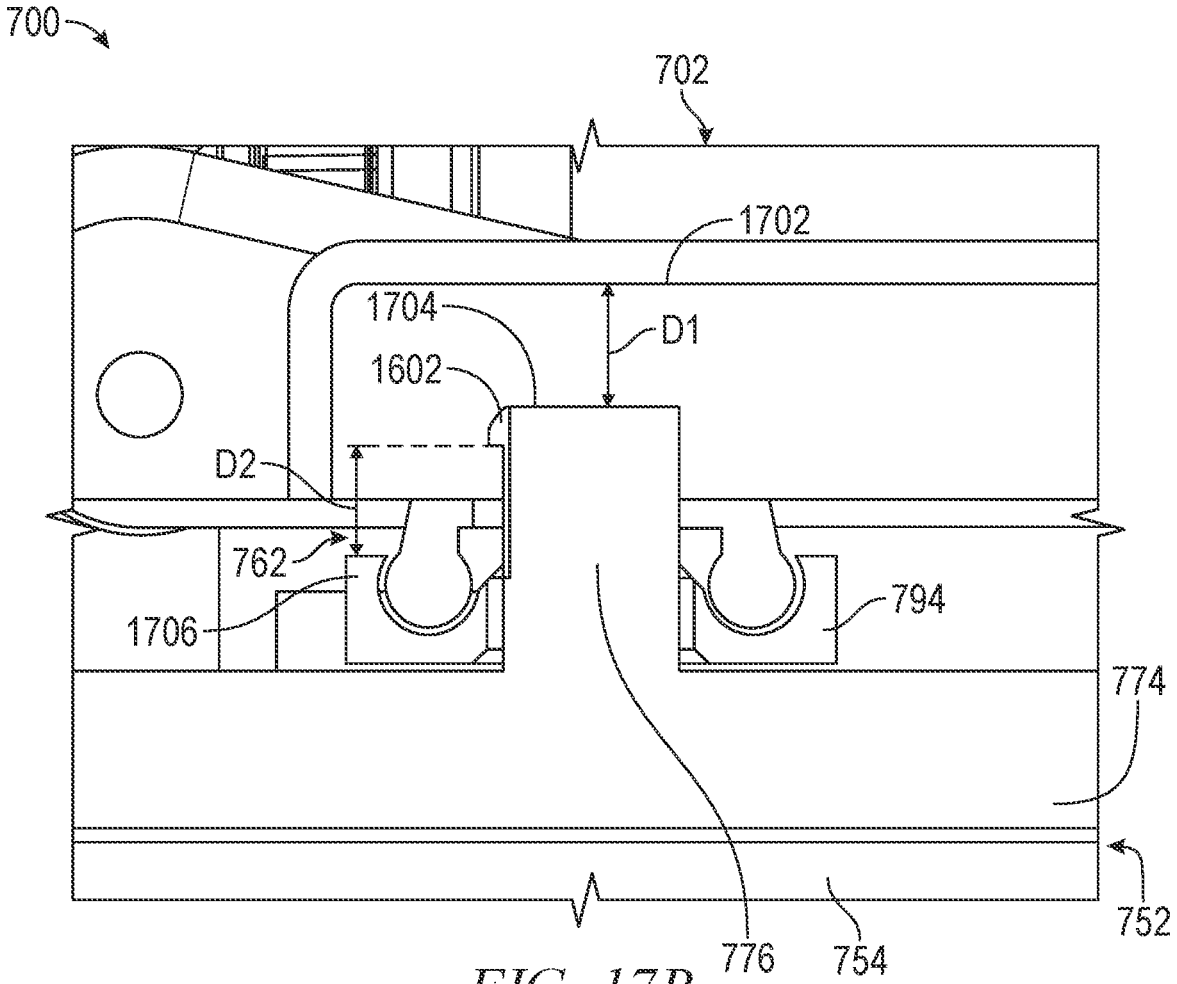
FIG. 17B illustrates a side cross-sectional view of a portion of a mobile cleaning robot.

FIG. 17A illustrates a side cross-sectional view of a portion of the mobile cleaning robot 700. FIG. 17B illustrates a side cross-sectional view of a portion of the mobile cleaning robot 700.

FIGS. 17A and 17B show the pad assembly 752 positioned below the body 702 of the robot 700 such that the pad 754 is located near or is contacting a flooring surface. FIG. 17B shows a focused view of FIG. 17A where FIG. 17B more clearly shows the post 776 of the pad tray 774 extending away from the cleaning pad 754. The post 776 can extend through the plate 794 of the pad attach 762. The projection 1602 can extend radially outward from the post 776.

FIG. 17B also illustrates a range of vertical travel of the pad assembly 752 when the pad assembly 752 is in the cleaning position. The pad tray 774 and the pad 754 can be normally biased towards the floor surface by the weight of the tray 774 and the cleaning pad 754 (and optionally by a biasing element), but can be free to move upward with respect to the body 702 and the pad connect 762, such as when the pad 754 encounters a bump (such as a threshold or floor transition). During such an instance, the pad assembly 752 can move upward as guided by the post 776 and the bores of the plate 794 until the post 776 engages a channel 1702, which can be a distance D1 away from a top 1704 of the post 776. The distance D1. can be between 1 and 10 millimeters depending on a desired travel upward of the pad assembly 752 In some examples, the distance D1 can be about 4 millimeters.

Similarly, the projection 1602 can be a distance D2 from a top 1706 of the plate 794, Engagement between the projection 1602 and the top 1706 of the plate 794 can define the distance D2, which can be a range of motion downward of the pad assembly 752 during operation. The distance D2 can be between 1 and 10 millimeters depending on a desired travel upward of the pad assembly 752. In some examples, the distance D2 can be about 4 millimeters. A total range of motion of the pad assembly 752 can be D1 plus D2, which can be between 2 and 20 millimeters. In some examples, the total range of motion of the pad assembly 752 can be D1 plus D2, which can be about 8 millimeters.

During bumps or pad assembly 752 movement, the pad assembly 752 can also rotate in pitch and roll directions in addition to translation, where pitch and roll can be guided by the post 776 and the bores of the plate 794 until a portion of the post 776 engages the channel 1702, which can be a distance D1 away from a top 1704 of the post 776. The post 776 and the channel 1702 can thereby set a limit for a combination of roll, pitch, and translation of the pad assembly 752 with respect to the body 702.

The channel 1702 can extend through a front portion 1708 of the bin 726 to help to allow the posts 776 to move with the pad assembly 752 as the pad assembly moves between the cleaning position (as shown in FIGS. 17A and 17B) and the stored position while allowing the pad assembly 752 to move through its vertical range of motion at any horizontal position before turning to a vertical position (as shown in FIG. 15C).

Figure 18:
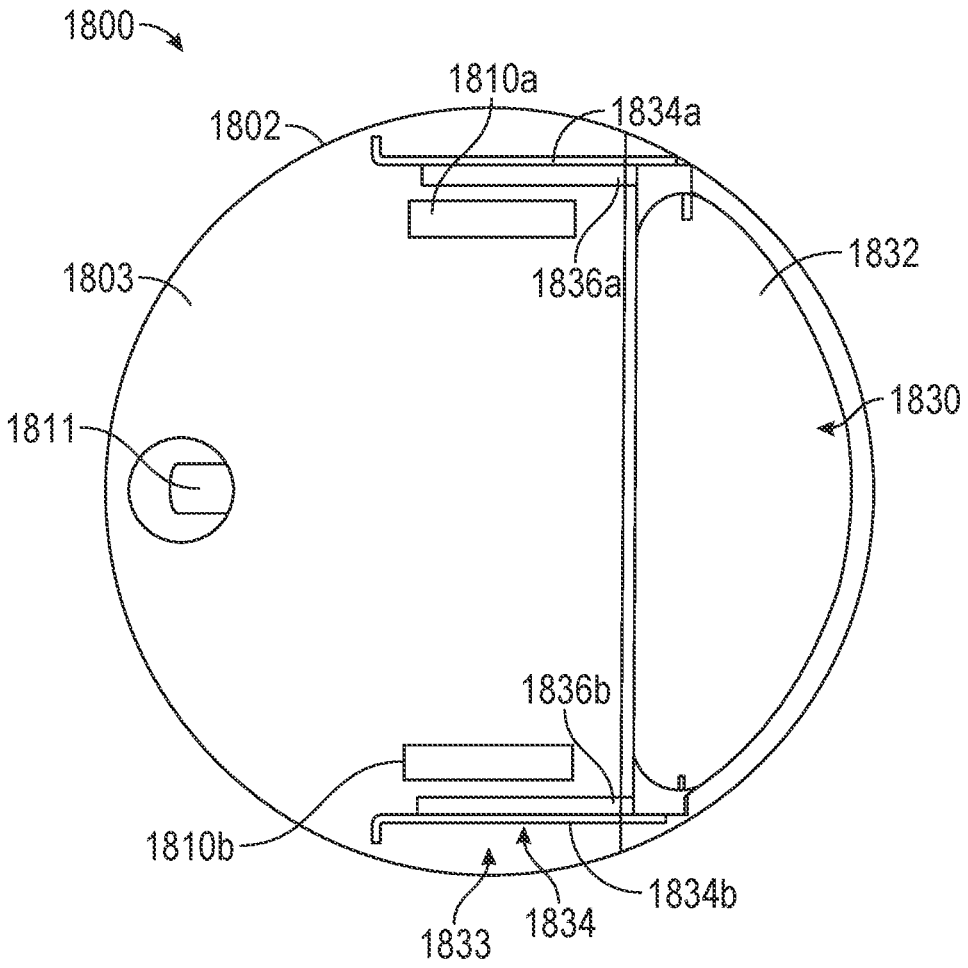
FIG. 18 illustrates a bottom view of a mobile cleaning robot.

FIG. 18 illustrates a bottom view of a mobile cleaning robot 1800. The robot 1800 can include a body 1802 having a bottom portion or surface 1803. The robot 1800 can also include drive wheels 1810 and a caster 1811, The body 1802 and wheels of the robot can be similar to the robots 200 and 700 discussed above.

The robot 1800 can also include a mopping system or assembly 1830 (or cleaning system 1830) that can be connected to the body 1802. The mopping assembly 1830 can include a mopping pad assembly 1832 and a link 1834 including link arms 1834*a* and 1834h. The link 1834 can be a semi-rigid member that is elastically deformable, made of materials such as one or more of polymer, metal alloys, or the like. In some examples, the link 1834 can be made of a steel alloy, such as a spring steel. In some examples, a vacuum assembly and extractor can be optionally included in the robot 1800.

The arms 1834*a* and 1834*b* can be connected to the pad assembly 1832, which can be engageable with a floor surface (e.g., the floor surface 50) when the mopping pad assembly 1830 is in a cleaning position. The arms 1834*a* and 1834*b* can also be connected to the body 1802 and connected to drive tracks 1836*a* and 1$36*b*, respectively, of a pad drive system 1833. The drive tracks 1836*a* and 1836*b* can be connected to the body 1802 and can be driven by motors of the pad drive system 1833, respectively, which can be in communication with a controller (such as the controller 220). The controller can operate the motors to drive the drive tracks 1836*a* and 1836*b* to move the mopping assembly 1830 between the cleaning position and the stored position, as discussed in further detail below.

Figure 19:
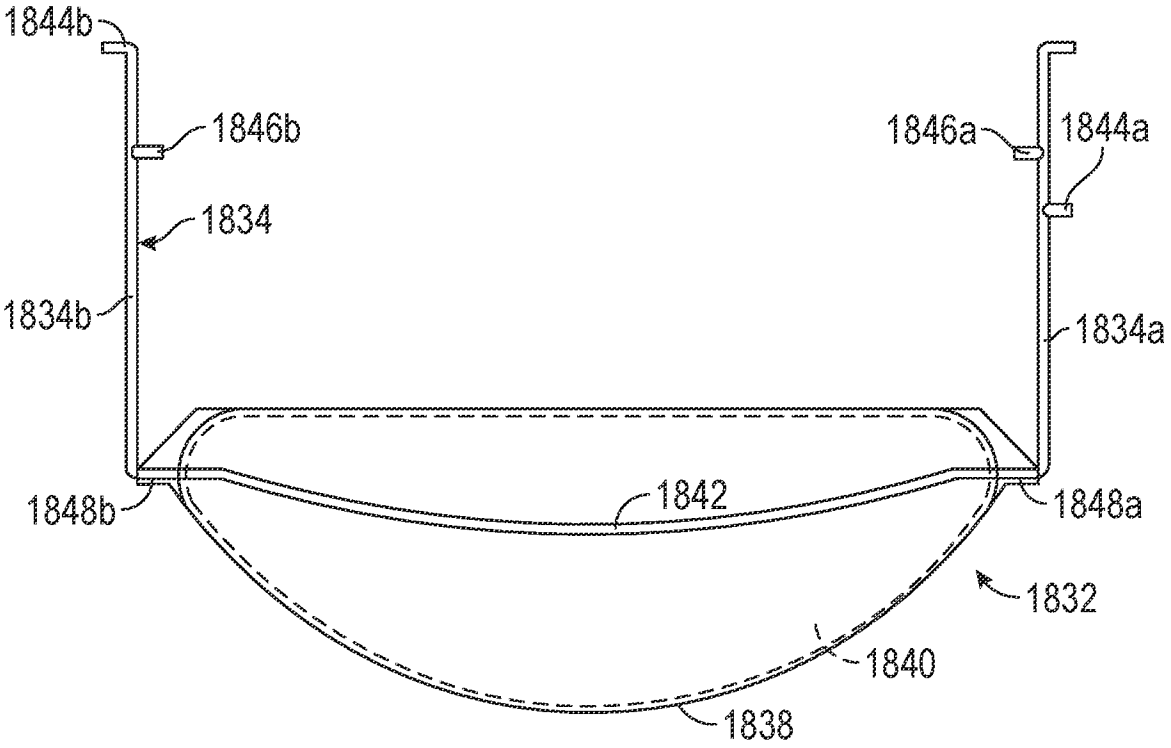
FIG. 19 illustrates a top view of a pad assembly of a mobile cleaning robot.

FIG. 19 illustrates a top view of the mopping assembly 1830 of the mobile cleaning robot 1800. FIG. 19 shows that the pad assembly 1832 can include a tray 1838 and a pad 1840 where the pad 1840 can be removably secured to the tray 1838. The pad 1840 can be a semi-rigid and porous material such as one or more of cloth, foam, polymer, or the like, such that the pad 1840 is configured to retain fluid or fine dust and debris, and apply fluid to the floor surface 50. In some examples, the pad 1840 can be a dry pad such as for dusting or dry debris removal. The pad 1840 can also be any cloth, fabric, or the like configured for cleaning (either wet or dry) of a floor surface. The tray 1838 can be a rigid or semi-rigid member configured to support the pad 1840 thereon and can be configured to transfer force from the link 1834 to the pad 1840.

FIG. 19 also shows that the link 1834 can include a connecting member 1842 connected to the first arm 1834*a* and the second arm 1834*b*. The connecting member 1842 can be engaged with the tray 1838 to transfer a downward force to the pad assembly 1830 when the mopping pad assembly 1832 is in the cleaning position. The connecting member 1842 can be a curved member configured to deflect in various directions and configured to allow relative movement between the first arm 1834*a* and the second arm 1834*b* and sides of the tray 1838. Also, the arms 1834*a* and 1834*b* and the connecting member 1842 can be configured to flex in response to the downward force to distribute the downward force to and on the pad assembly 1830. In another instance, springs, such as torsion springs, can be connected to the arms 1834*a* and 1834*b* and can be configured to provide the flex in response to the downward force.

In some examples, the arms 1834*a* and 1834*b* can be separate components. For example, the arms 1834*a* and 1834*b* can connecting member 1842 can be separate at the connecting member 1842 such that the arms 1834*a* and 1834*b* have mirrored geometry to control pad tray 1838 orientation and to help provide downforce to the floor surface 50 while allowing compliance.

The arms 1834*a* and 1834*b* can also include outer projections 1844*a* and 1844*b* extending outward from the arms 1834*a* and 1834*b* and can include inner projections 1846*a* and 1846*b* extending inward from the arms 1834*a* and 1834*b*. The projections can be used to drive and guide movement of the link 1834, as discussed in further detail below.

The tray 1838 can also include ears 1848*a* and 1848*b* that can be located at an outer portion of the tray 1838. The ears 1848*a* and 1848*b* can include or can be features to connect the tray 1838 to the arms 1834*a* and 1834*b*, respectively. In some examples, the ears 1848*a* and 1848*b* can be reteasably secured to the arms 1834*a* and 1834*b*, respectively.

Figure 20:
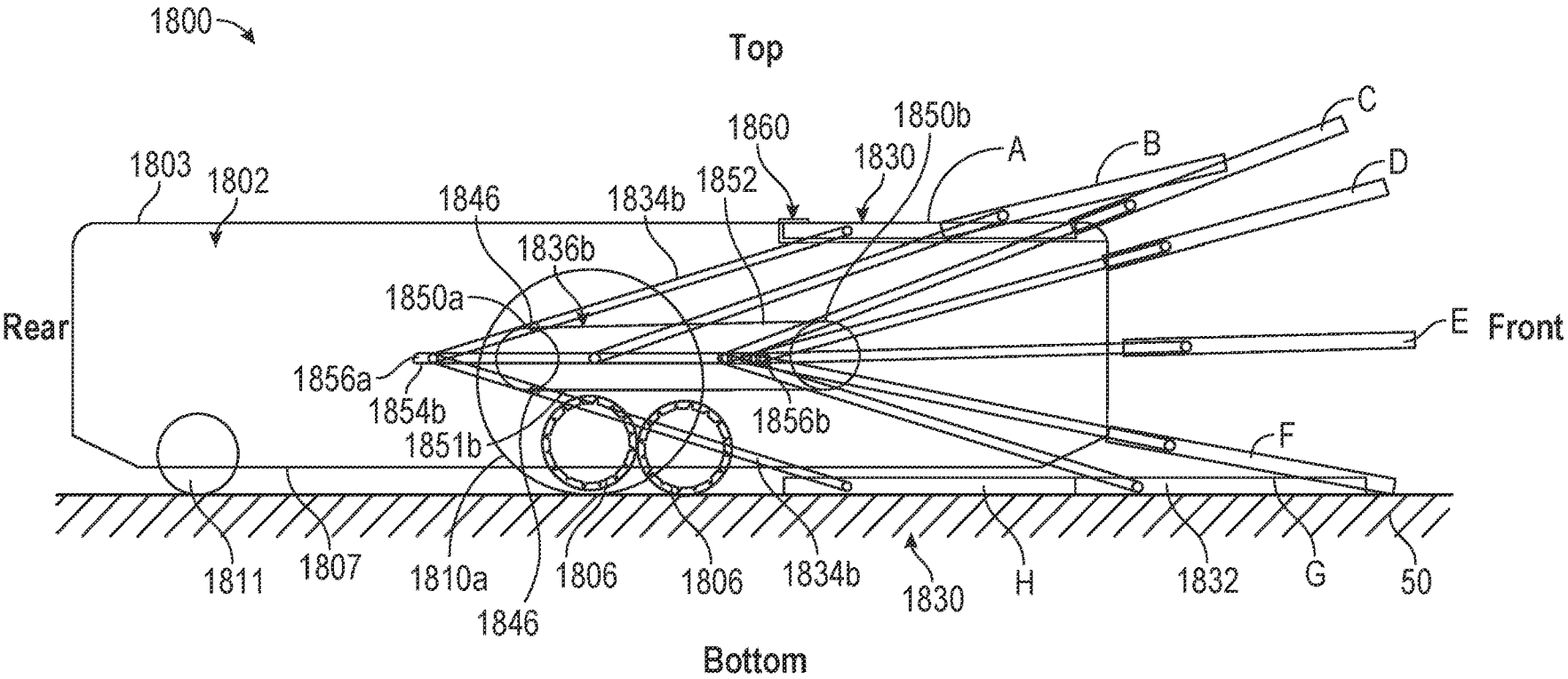
FIG. 20 illustrates a side view of a mobile cleaning robot.

FIG. 20 illustrates a side view of the mobile cleaning robot 1800 with the link 1834 and pad assembly 1830 in several positions A, B, C, D, E, F, G, and. H. FIG. 20 also shows the drive track 1836*b*, which can include a belt or track 1851 connected to pulleys 1850*a* and 1850*b* where one or more of the pulleys can be driven by a motor or actuator to drive the belt 1851 around the pulleys 1850. The inner projections 1846*a* and 1846*b* can be connected to the belts 1851*a* and 185 lb, respectively, such that movement of the belts 1851*a* and 1851*b* around the pulleys 1850 can cause movement of the link 1834.

The body 1802 can also include slots 1854*a* and 1854*b*, which can receive the outer projections 1844*a* and 1844*b*, respectively. The slots 1854*a* and 1854*b* can extend linearly along the body 1802 and can be located on opposite sides of the body 1802. The slots 1854*a* and 1854*b*, through their engagement with the outer projections 1844*a* and 1844*b*, respectively, can help to define a range of motion of the link 1834 and therefore the pad assembly 1832, such as through engagement between ends 1856*a* and 1856*b* of the slots 1854*a* and 1854*b*, and where vertical movement of the outer projections 1844*a* and 1844*b* can be limited by contact with the slots 1854*a* and 1854*b*, respectively.

FIG. 20 also shows how the link 1834 and the pad assembly 1832 move between the stored position (position A) at least partially above the body 802 and the cleaning position (position H) at least partially below the body 802. In some examples, the body 1802 can include a storage slot 1860 engageable with the link 1834 or the tray 1838 to guide the mopping pad assembly 1832 into and out of the stored position (position A). In the stored position (position A), the drive belt 1852 can apply a force on the link 1834 to pull the link 1834 towards the belt 1852 and the link 1834 can elastically deform (or can flex) to pull the pad assembly 1832 into the slot 1860 and parallel with the top surface 1803. In the position A, the inner projection 1846*a* can be at a top and forward position on the belt 1852 and in the H position, the inner projection 1846*a* can be at a bottom and forward position on the belt 1852 such that movement of the belt 1852 can move the inner projections 1846 between the top and rear position of position A and the bottom and forward position of position B to move the pad assembly 1832 between the A and. H positions. The pad assembly 1832 can be paused (such as by a controller) in any position such as for pad removal, pad cleaning, edge cleaning or pad drying.

When the controller (such as the controller 220) determines that a mopping action should be performed, the controller can drive a motor connected to one of the pulleys 1850 to rotate the one or more of the pulleys 1850 to rotate the pulley to drive the inner projections 1846*a* and therefore the link 1834 and the pad assembly 1832 toward the position B, as guided by the outer projections 1844 in the slots 1854, where the outer projections 1844 can be guided to move horizontally rearward. The controller can continue to operate the motor to drive the pulleys 1850 to rotate the tray through positions C, D, E, and F until the pad assembly 1832 contacts the floor surface 50, where the outer projections 1844 can be guided to move horizontally rearward until the belt 1852 drives the inner projections 1846 around the rearward pulley 1850 where the inner projections 1844 can be guided to move forward again to guide forward movement of the mop pad assembly 1832.

Once the pad assembly 1832 contacts the flooring surface, deflection of the link 1834 can occur as the belt 1852 is driver further to move the inner and outer projections (and link) forward, which can cause a downward force to be applied to the link 1834. The link 1834 can deflect or bend (elastically) and can apply a downward force on the pad assembly 1832 as the pad assembly moves from the position F to positions G and H, which can be the cleaning position. When it is determined that the pad assembly 1832 should be moved to the stored position, the controller can operate the motors to rotate the pulleys 1850 in the opposite direction to move the link 1834 and the pad assembly 1832 from the position H back to the position A. In this way, a controller can operate the drive system 1833 to move the pad assembly 1832 between the cleaning position H and the stored position A, as needed during a cleaning routine or mission.

Figure 21A:
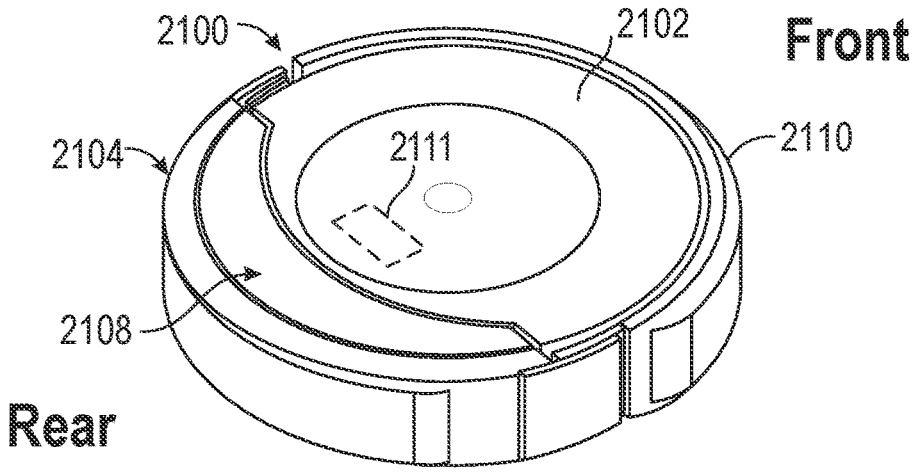
FIG. 21A illustrates a perspective view of a mobile cleaning robot.
Figure 21B:
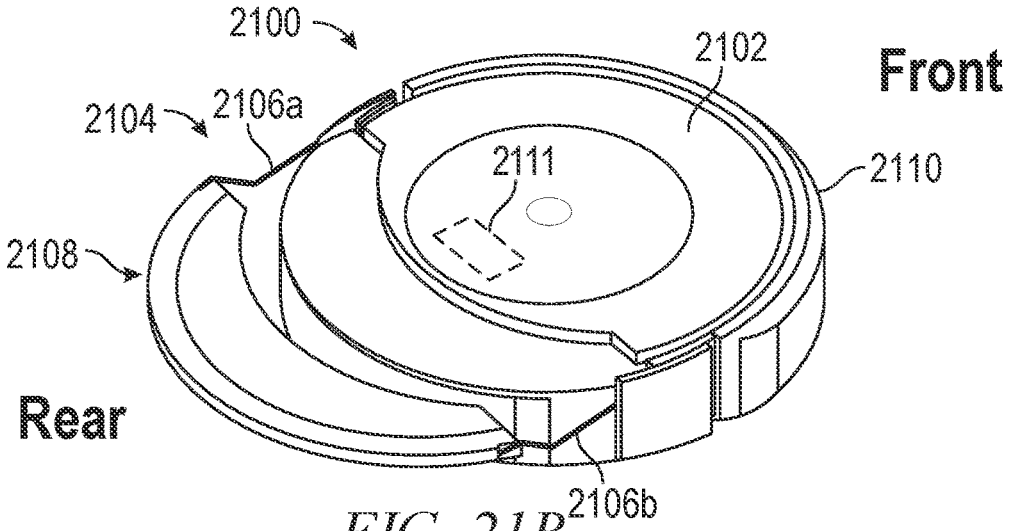
FIG. 21B illustrates a perspective view of a mobile cleaning robot.
Figure 21C:
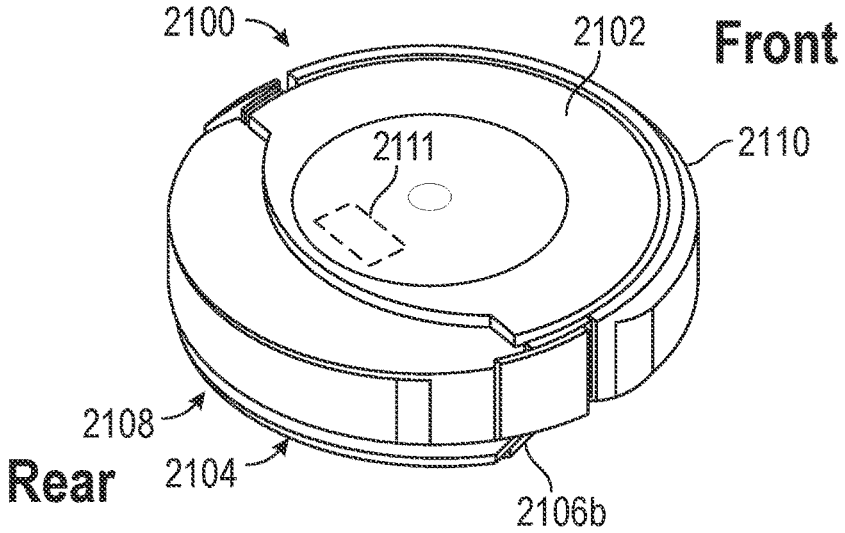
FIG. 21C illustrates a perspective view of a mobile cleaning robot.

FIG. 21A illustrates a perspective view of a mobile cleaning robot. FIG. 21B illustrates a perspective view of a mobile cleaning robot. FIG. 21C illustrates a perspective view of a mobile cleaning robot. FIGS. 21A-21C are discussed together below. The mobile cleaning robot 2100 can be similar to the robots discussed above and can include any of the components. Additionally, any of the robots discussed above or below can be modified to include the components of the robot 2100.

The mobile cleaning robot 2100 can include a body 2102 and a mopping system 2104. The mopping system 2104 can include arms 106*a* and 1066 (referred to together as arms 2106) and a pad assembly 2108. The robot 2100 can also include a bumper 2110 and other features such as an extractor (including rollers), one or more side brushes, a vacuum system, a controller, a drive system (e.g., motor, geartrain, and wheels), a caster, sensors, or the like, as discussed above. A proximal portion of the arms 2106*a* and 2106*b* can be connected to an internal drive system. A distal portion of the arms 106 can be connected to the pad assembly 2108, The robot 100 can also include a controller 2111 that can be located within the housing or body 2102 and can be a programable controller, such as a single or multi-board computer, a direct digital controller (DDC), a programable logic controller (PLC), or the like. In other examples the controller 111 can be any computing device, such as a handheld computer, for example, a smart phone, a tablet, a laptop, a desktop computer, or any other computing device including a processor, memory, and communication capabilities. The memory can be one or more types of memory, such as volatile or non-volatile memory, read-only memory (ROM), random-access memory (RAM), magnetic disk storage media, optical storage media, flash-memory devices, and other storage devices and media. The memory can be located within the housing 2102, connected to the controller 2111 and accessible by the controller 2111.

In operation of some examples, the controller 2111 can operate the arms 106 to move the pad assembly 2108 between a stored position (shown in FIG. 21A), an extended position (shown in FIG. 21B), and an operating or cleaning position (shown in FIG. 21C). In the stored position, the robot 2100 can perform vacuuming operations only. In the operating position, the robot can perform wet or dry mopping operations and vacuuming operations or can perform only mopping operations. In the extended position (and positions similar thereto), the robot 100 can change a cleaning pad of the pad assembly, as discussed in further detail below. The pad assembly can also be moved to the extended position for drying of the pad, such as during charging operations.

Figure 22:
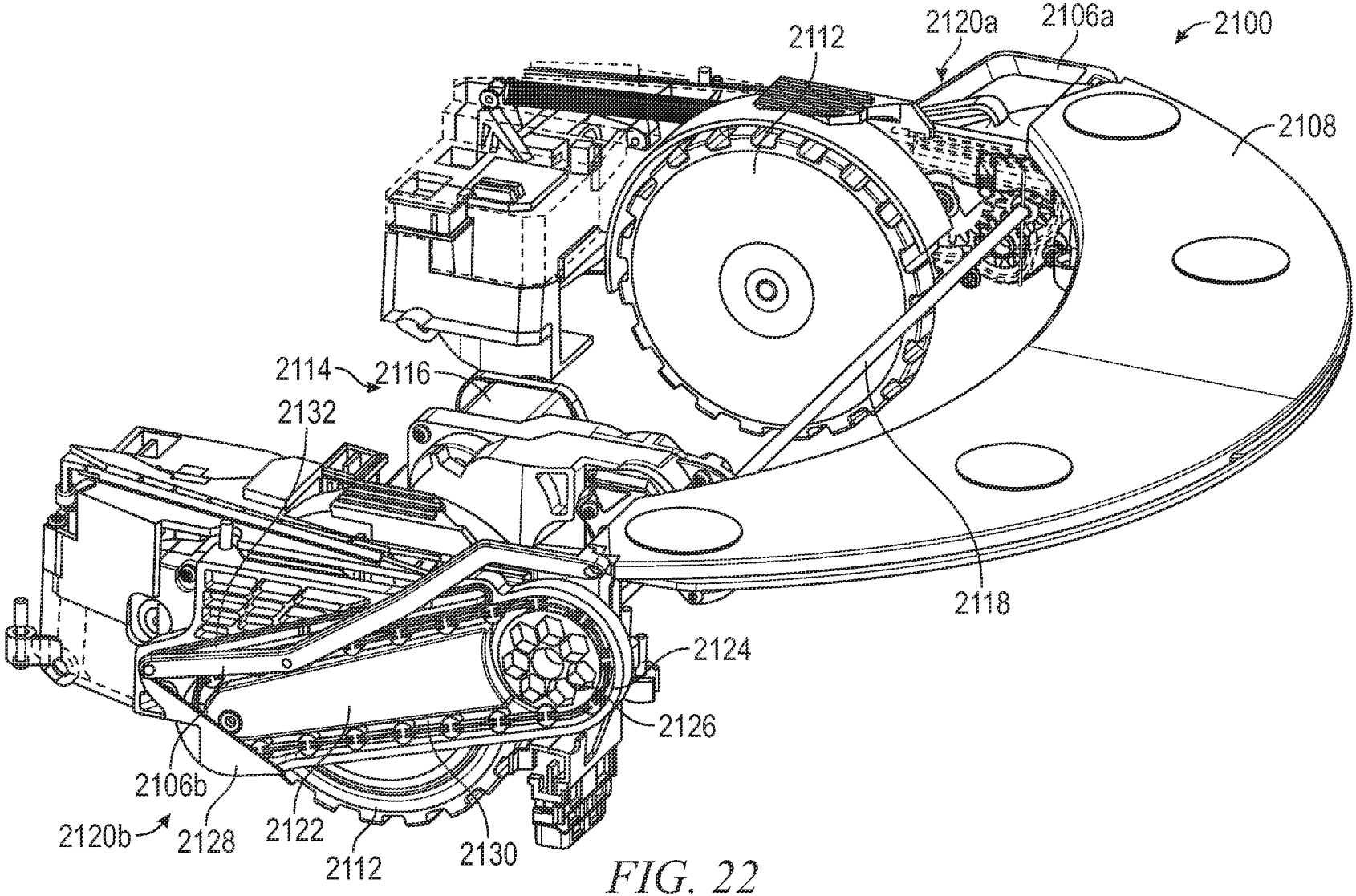
FIG. 22 illustrates an isometric view of a portion of a mobile cleaning robot.

FIG. 22 illustrates an isometric view of a portion of the mobile cleaning robot 2100. The robot 2100 can be similar to the robot 2100 (and others) discussed above; the robot 2100 can differ in that a pad drive system 2114 can be located on both sides of the robot 2100 to guide movement of the arms 2106 and the pad assembly 208. Any of the robots discussed above or below can be modified to include such a drive system.

Figure 23A:
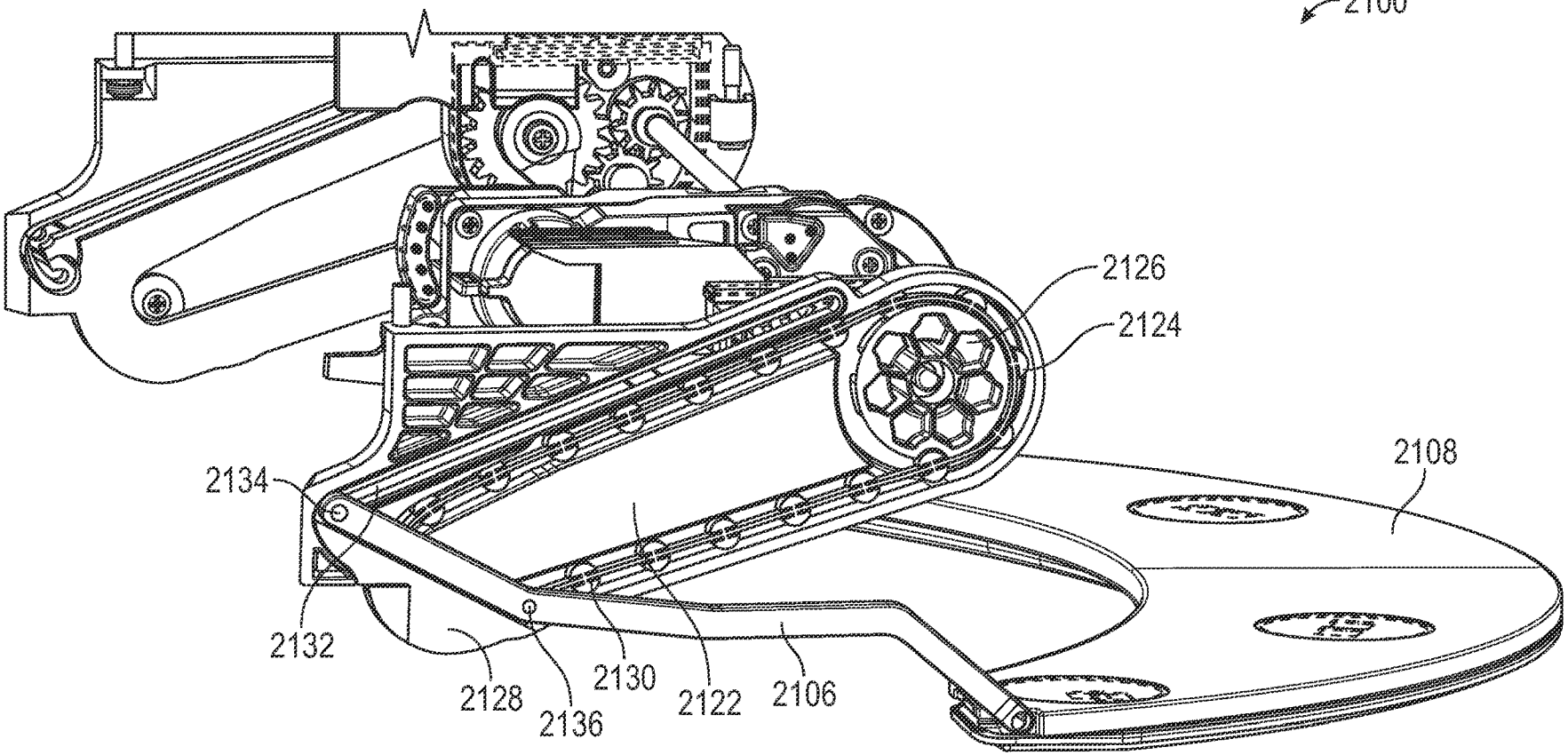
FIG. 23A illustrates an isometric view of a portion of a mobile cleaning robot.
Figure 23B:
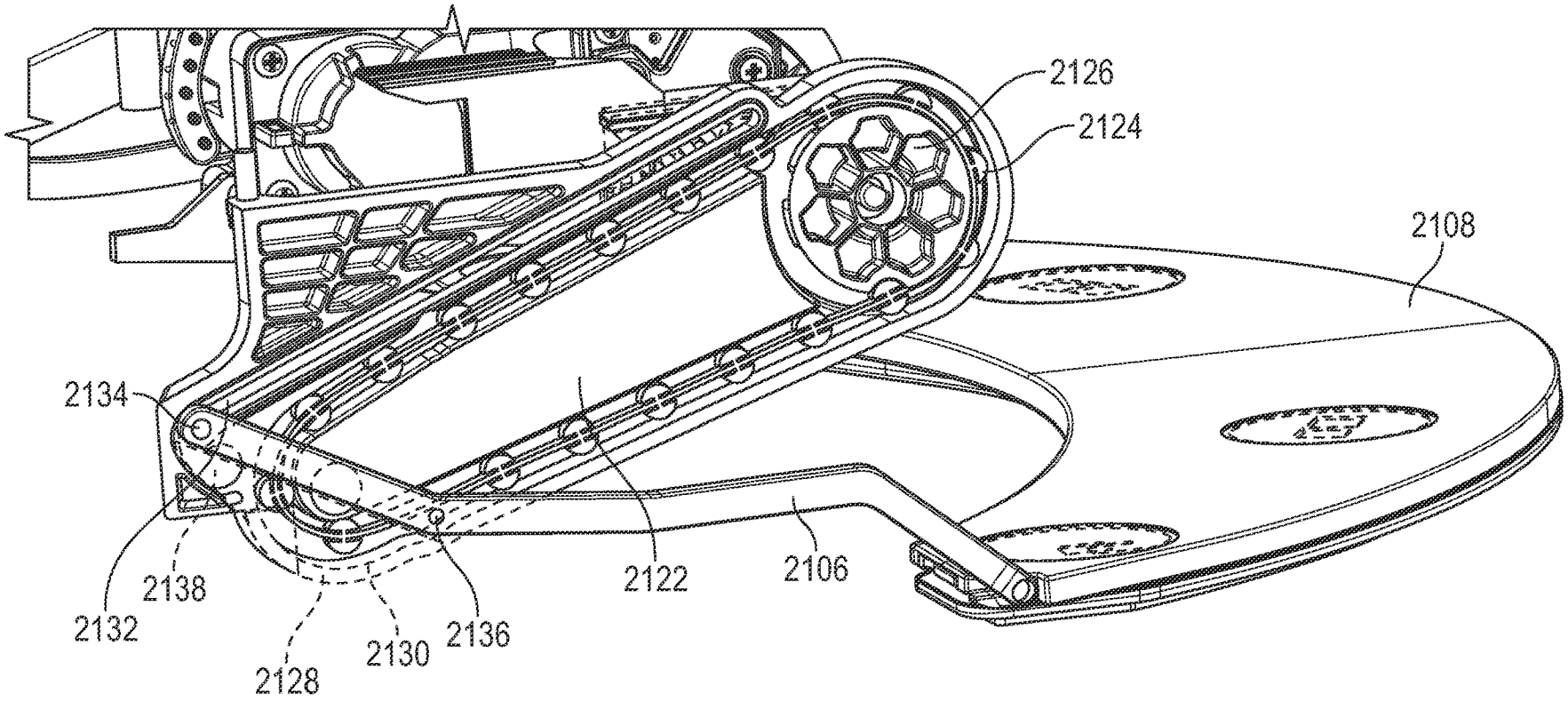
FIG. 23B illustrates an isometric view of a portion of a mobile cleaning robot.

The pad drive system 2114 can include a motor 2116, a cross-shaft 2118, and chain drive systems 2120*a* and 2120*b* (collectively referred to as drive systems 2120). The chain drive systems 2120 can be substantially the same but mirrored. The drive systems 2120 can be different in other examples. The drive chain system 2120*a* can connect to the arm 2106*a* and the chain drive system 2120*b* can connect to the arm 2106*b*. Both chain drive systems 2120 can be connected to the cross-shaft 2118 and therefore to the motor 2116 such that the motor 2116 can drive the drive systems 2120 to move. Operation of the chain drive systems 2120 can cause the arms 2106 to move the pad system 2108 between a stored position, as shown in FIGS. 21A and 22, and a cleaning position, as shown in FIGS. 21C, 23A, and 23B.

Each of the chain drive systems 2120 can include a guide 2122, a chain 2124, a sprocket 2126, and a cover plate 2128. The guide 2122 can generally be a. rigid or semi-rigid member made of one or more of metals, polymers, or the like. The guide 2122 can include or can define a chain track 2130 and an arm track 2132. The chain track 2130 can, at least partially, surround a portion of the chain 2124, The arm track 2132 can, at least partially, surround a portion of the arm 2106. The arm 2106 can be connected to the arm track 2132 and the chain 2124 can be connected to the chain track 2130.

The chain 2124 can be a belt, chain, or the like that is configured to drive the arm 2106*b*. The chain 2124 can be made of one or more of metal, polymer, or the like, In some examples, the chain 2124 can be an injection molded polymer chain. Alternatively, the chain 2124 can be a link chain (e.g., bike-type) or a bead and bar chain. The chain 2124 can be connected to the arm 2106*b* to drive the arm 2106 to move the pad assembly 2108 between the stored position and the cleaning position (and any other position on the trajectory of the pad assembly 2108).

The sprocket 2126 can be a pulley, gear, or the like that can be supported by the guide 2122 (and therefore to the body 2102) and can be rotatable in the guide 2122. At least a portion of the sprocket 2126 can be engageable with the chain 2124, The sprocket 2126 can also be connected to the cross-shaft 2118 such that rotation of the motor 2116 can drive rotation of the cross-shaft 2118 and therefore the sprocket 2126, which can drive the chain 2124 and therefore the arm 2106 to move along the arm track 2132 and the chain track 2130. Further details and operation of the chain drive systems 2120 are discussed below.

FIG. 23A illustrates an isometric view of a portion of the mobile cleaning robot 2100. HQ. 23B illustrates an isometric view of a portion of the mobile cleaning robot 2100. FIGS. 23A and 23B are discussed together below. The robot 2100 of FIGS. 23A and 23B can be consistent with the robot 2100 discussed above; additional details of the robot 2100 are discussed below with respect to FIGS. 23A and 23B. For example, FIG. 23B shows how the arm 2106 connects to the guide 2122.

The arm 2106 can include a boss 2134, which can be a pin, post, or the like. The boss 2134 can be located in the arm track 2132 and can be translatable therein along the arm track 2132, where the track 2132 can be substantially linear or straight. The arm track 2132 can be curved, arced, or can have other shapes in other examples. The track 2132 can be located above the chain track 2130, but can be located in the middle of the chain track 2130 or below the chain track 2130.

The arm 2106 can also include a pin 2136, which can be a post, boss, or the like. The pin 2136 can be connected to or engaged with a link of the chain 2124 such that movement of the chain 2124 in the chain track 2130 can move the pin 2136 and therefore the arm 2106 (or a portion thereof) along the chain track 2130. The chain track 2130 can be oval-shaped and can be continuous around a periphery (or portion of the periphery) of the guide 2122. Optionally, the chain track 2310 can be incomplete. The chain track 2130 can have other shapes in other examples.

FIGS. 23A and 23B also show more details of the cover plate 2128. In assembly of the arm 2106, the cover plate 2128 can be removed and the boss 2134 can be inserted into the arm track 2132 such as through a track bore 2138 shown in phantom in FIG. 23B. A head of the boss 2134 can be sized such that it is insertable through the track bore 2138 but is larger than the arm track 2132 so that once the head of the boss 2134 is inserted through the bore 2138, the boss 2134 can be moved into the arm track 2132 where the boss 2134 cannot back out. When the cover plate 2128 is installed, the boss 2134 cannot access the bore 2138 and is therefore captured in the arm track 2132. The cover plate 2128 can also, when installed, cover a portion of the chain track 2130 such that the pin 2136 of the arm 2106 (or its supporting chain link) can engage the cover plate 2128 to act as a travel stop in a top portion of the chain track 2130 or a lower portion of the chain track 2130.

In operation, the boss 2134 can be at a first end of the arm track 2132 and the pin 2136 can be in the upper portion of the chain track 2130 when the pad 2108 is in the stored position, as shown in FIG. 22. When it is desired to move the arm 2106 from the stored position to the cleaning position (shown in FIGS. 23A and 23B), the motor 2116 can be operated (such as by the controller 2111 or 220) to rotate the cross-shaft 2118 to drive the sprocket 2126 to move the chain 2124 within the chain track 2130. Movement of the chain 2124 along the chain track 2130 can cause the pin 2136 to move along the chain track 2130, such as from the upper portion, shown in FIG. 22, to the lower portion shown in FIG. 23B.

During movement of the arm 2106 and the pin 2136, the boss 2134 can translate in the arm track 2132 between the ends of the arm track 2132. Movement of the boss 2134 in the arm track 2132 and movement of the pin 2136 in the chain track 2130 can together define a movement profile or trajectory of the arm 2106 and the pad assembly 2108 with respect to the body 2102. To move the pad assembly 2108 to the stored position from the cleaning position, the motor 2116 can reverse directions to drive the arm 2106 around the chain track 2130 in the opposite direction (as guided by the boss 2134 and the arm track 2132), The guide 2122 and chain 2124 can thereby drive and guide movement of the arm 2106 and the pad assembly 2108 such that the arm track 2132 and the chain track 2130 can together, at least in part, define a trajectory of the pad assembly 2108 when the pad assembly 2108 moves between the cleaning position and the stored position. Optionally, the arm track 2132 can extend beyond the chain track 2130 to help define an efficient travel path of the arm 2106 and the pad assembly 2108, FIGS. 29A-29C below show how the arm 2106 can response to such movement.

Figure 24A:
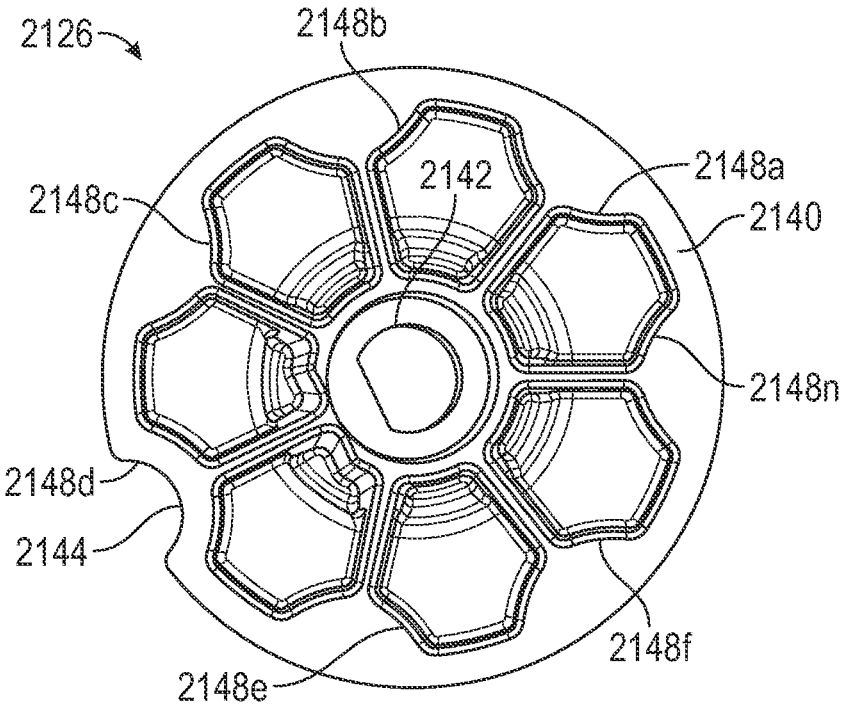
FIG. 24A illustrates a side view of a portion of a mobile cleaning robot.
Figure 24B:
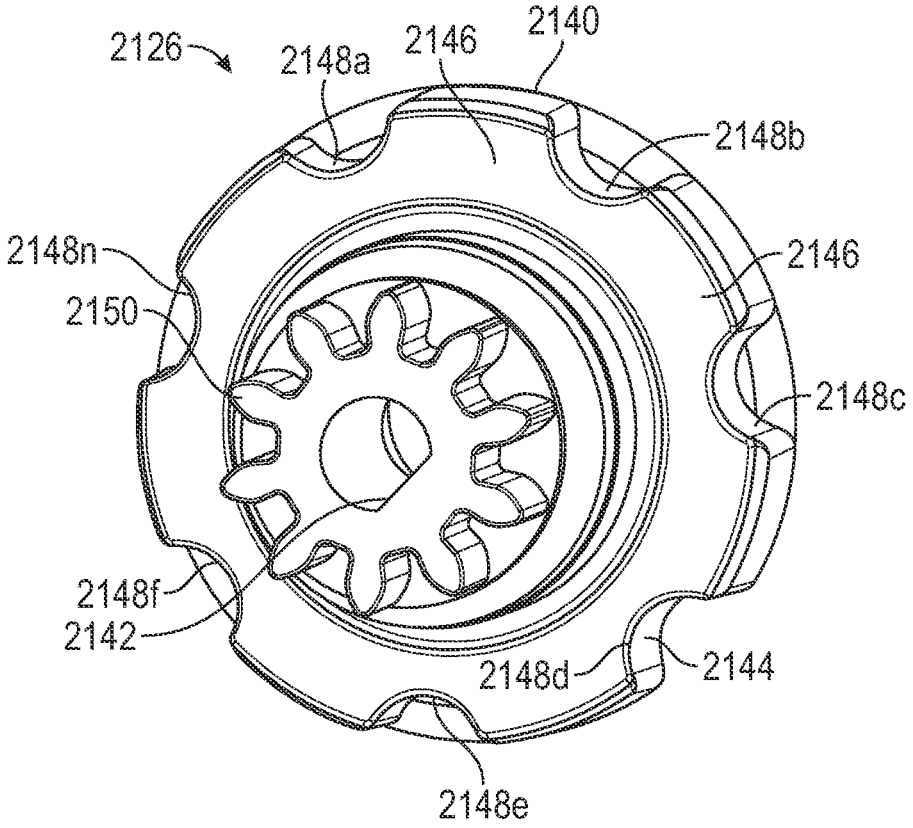
FIG. 24B illustrates an isometric view of a portion of a mobile cleaning robot.

FIG. 24A illustrates a side view of the sprocket 2126 of the mobile cleaning robot 2100. FIG. 24B illustrates an isometric view of a portion of the mobile cleaning robot 2100. The sprocket 2126 of FIGS. 24A and 23B can be consistent with the robot 2100 discussed above; additional details of the sprocket 2126 are discussed below with respect to FIGS. 24A and 24B.

For example, FIG. 24A shows that the sprocket 2126 can define an outer periphery 2140 and an inner bore 2142. The outer periphery 2140 can be configured (e.g., sized or shaped) to fit within the guide 2122 and to receive the chain 2124 thereon or therearound. The outer periphery 2140 can define a notch 2144 to receive a link of the chain 2124 that supports the pin 2136 (as discussed in further detail below). The inner bore 2142 can be configured (e.g., sized or shaped) to receive the cross-shaft 2118 therein, such as a D-shaft. The cross-shaft 2118 (or ends of the shaft 2118) can have a complimentary shape to the inner bore 2142, such as a D-shape, to mate with the inner bore 2142 and the help transmit rotation from the cross-shaft 2118 to the sprocket 2126 and to help limit relative rotation of the cross-shaft 2118 with respect to the sprocket 2126.

The sprocket 2126 can also include teeth 2146 defining gaps 2148*a*-2148*n* (collectively referred to as gaps 2148). The gaps 2148 can each be configured (e.g., sized and shaped) to receive teeth or projections of the chain 2124 therein, such as to transmit rotation of the sprocket 2126 to the chain 2124. The gap 2148*d* can be sized to receive either a tooth of the chain 2124 or the pin tooth, as discussed in further details below. However, the notch 2144 and the gap 2148*d* are the only gap 2148*d* that can receive the pin tooth of the chain 2124, which can help to ensure proper timing or movement of the chain 2124 and therefore of the arm 2106 and the pad assembly 2108. The sprocket 2126 can also include a drive gear 2150 that is operable to operate a suspension system of the robot 2100.

Figure 25A:
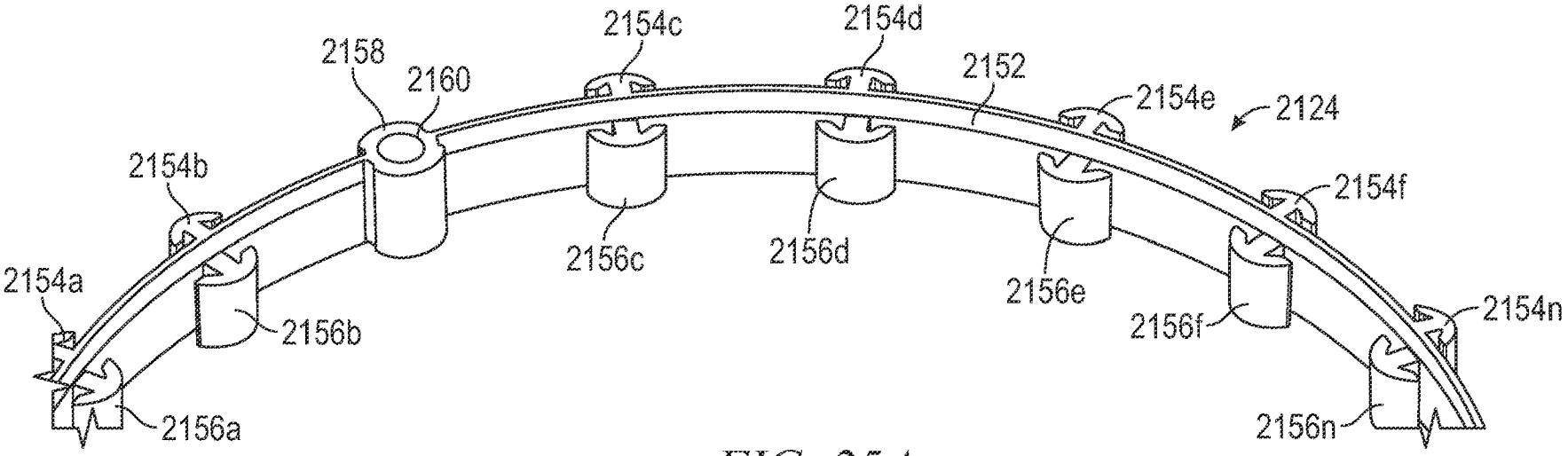
FIG. 25A illustrates an isometric view of a portion of a mobile cleaning robot.
Figure 25B:
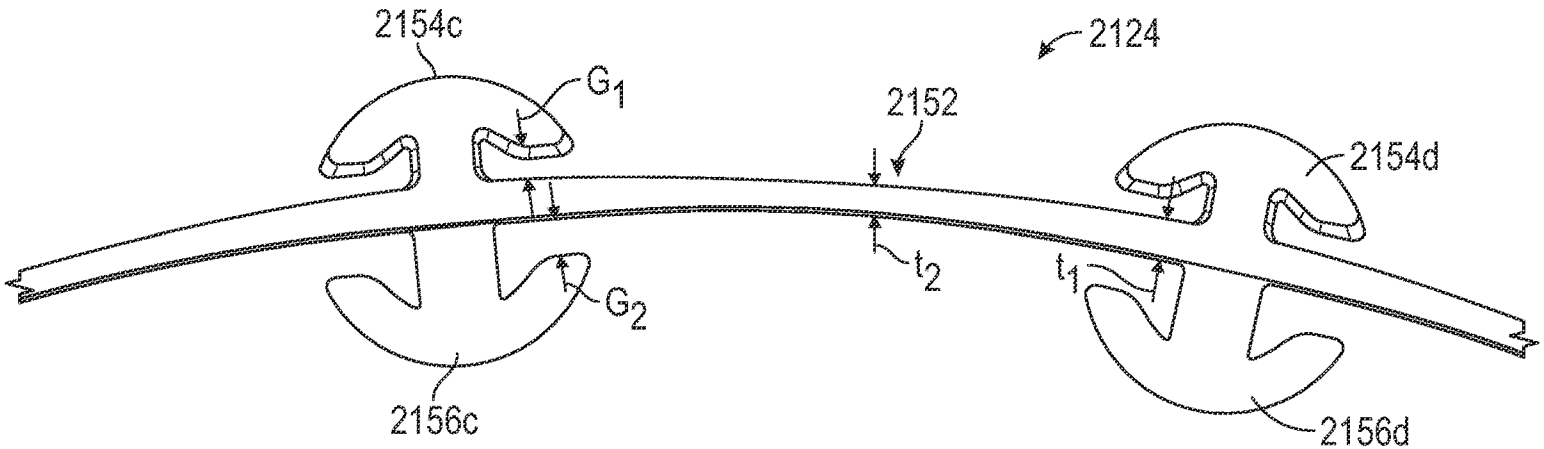
FIG. 25B illustrates an elevation view of a portion of a mobile cleaning robot.

FIG. 25A illustrates an isometric view of the chain 2124 of the mobile cleaning robot. FIG. 25B illustrates an elevation view of the chain 2124 of the mobile cleaning robot. The chain 2124 of FIGS. 25A and 25B can be consistent with the robot 2100 discussed above; additional details of the chain 2124 are discussed below with respect to FIGS. 25A and 25B.

For example, FIG. 25A shows that the chain 2124 can include a flexure 2152, which can be a belt, ribbon, backing, or the like configured to support a plurality of supports 2154*a*-2154*n* (collectively referred to as supports 2154) on an outer portion of the flexure 2152 and a plurality of teeth 2156*a*-2156*n* (collectively referred to as teeth 2156) on an inner portion of the flexure 2152. The flexure 2152 can also include an arm connector 2158 in place of one tooth and support where the arm connector 2158 can define a bore 2160. The bore 2160 can be configured to receive the pin 2136 of the arm 2106 therein to secure the arm 2106 to the chain 2124. The arm connector 2158 can define a cylinder or other shape configured to be received by the gap 2148*d* discussed above with respect to FIGS. 24A and 24B.

The teeth 2156 can each have a shape of a T with a curved top from a lateral perspective such that each of the teeth 2156 is engageable with recesses or gaps 2148 of the pulley or sprocket 2126. The supports 2154 can each have a shape of a T with a curved top from a lateral perspective to substantially match a profile of the teeth 2156, as shown in FIG. 25B. Because the curved portions of the teeth 2156 and the supports 2154 together form a relatively round profile, the supports 2154 and teeth 2156 can be limited from binding or bunching within the chain track 2130 of the guide 2122. Contact by the curved portions of the teeth 2156 and the supports 2154 with the chain track 2130 can also help to limit deflection of the flexure 2152 during operation.

FIG. 25B also shows that the supports 2154 can each define a gap G1 between the support 2154 and the flexure 2152 and the teeth 2156 can each define a gap G2 between the teeth 2156 and the flexure 2152. The gaps G1 and G2 can allow the flexure 2152 to be relatively longer, which can help to allow the flexure 2152 bend or flex to help the chain 2124 bend or flex and to help reduce stress concentrations as the chain 2124 moves around the shape of the chain track 2130 of the guide 2122. Reduction of such stress concentrations in the chain 2124 can help to reduce failure of the chain 2124.

The gaps G1 and G2 also allow for the flexure 2152 to have a varying thickness. More specifically, the flexure 2152 can have a thickness t1 (from a lateral perspective, as shown in FIG. 25B) near the supports 2154 and the teeth 2156, and the flexure 2152 can have a thickness t2 (from the lateral perspective) near a mid-point between each pair of the supports 2154 and teeth 2156, where the thickness t2 is smaller than the thickness ti. The reduced thickness t2 can help to allow the flexure 2152 to flex or bend to help the chain 2124 conform to and move around the chain track 2130 of the guide 2122.

Figure 26:
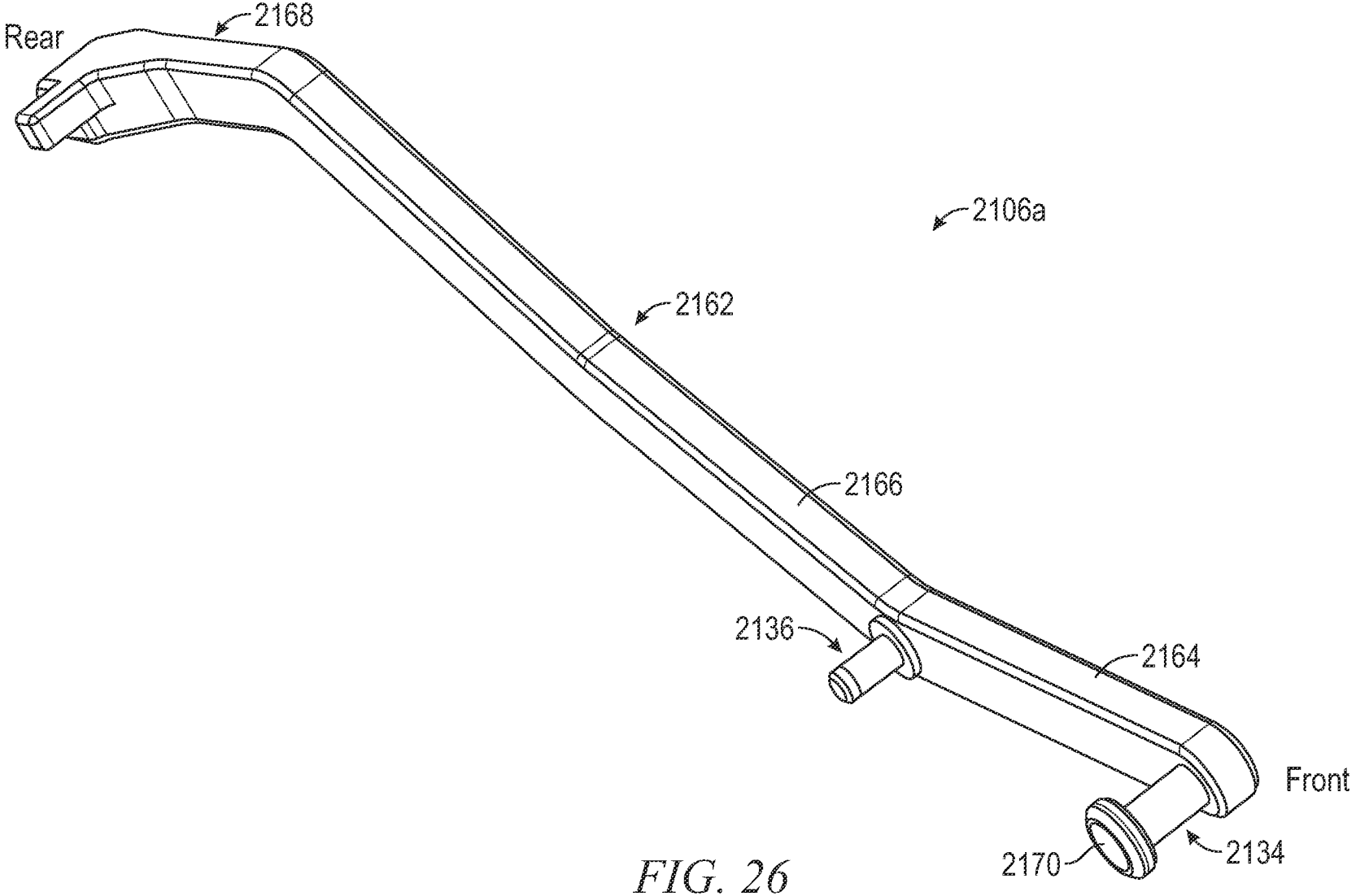
FIG. 26 illustrates an isometric view of a portion of a mobile cleaning robot.

FIG. 26 illustrates an isometric view of the arm 2106*a* of a mobile cleaning robot. The arm 2106*a* of FIG. 26 can be consistent with the robot 2100 discussed above; additional details of the arm 2106*a* are discussed below with respect to FIG. 26.

For example, FIG. 26 shows that the arm 2106*a* can include a body 2162 including a front portion 2164, a middle portion 2166, and a rear portion 2168. The pin 2136 can be connected to the body 2162 near the front portion 2164 and the boss 2134 can be connected to the front portion 2164, such as near a front end of the arm 2106*a*. The boss 2134 can include a head 2170 having a diameter larger than the boss 2134, where the head 2170 can be insertable through the track bore 2138, as discussed above with respect to FIG. 23B.

The front portion 2164 can be angled with respect to the middle portion 2166, which can be angled with respect to the rear portion 2168 to help to define a movement trajectory of the pad assembly 2108 and storage and cleaning positions of the arms 2106 and the pad assembly 2108. The rear portion 2168 can be configured to connect to the pad assembly 2108, as discussed in further detail below. The body 2162, the pin 2136, and the boss 2134 can all be rigid or semi-rigid members made of one or more of polymer, metals, or the like. In some examples, the arm 2106*a* (and its components) can be made of aluminum. In some examples, the pin 2135 or the boss 2134 can be made of a different material than the body 2162, such as low friction materials (e.g., polymer) or can have one or more coatings (e.g., Polytetrafluoroethylene) or finishes (e.g., high polish aluminum), such as to help reduce friction and wear between the arm 2106 and the guide 2122, Optionally, the pin 2136 can include a snap feature or projection for engaging with the bore 2160 of the arm connector 2158, such as to form a snap interface between the arm connector 2158 and the pin 2136 to help secure the arm 2106 to the chain 2124.

Figure 27:
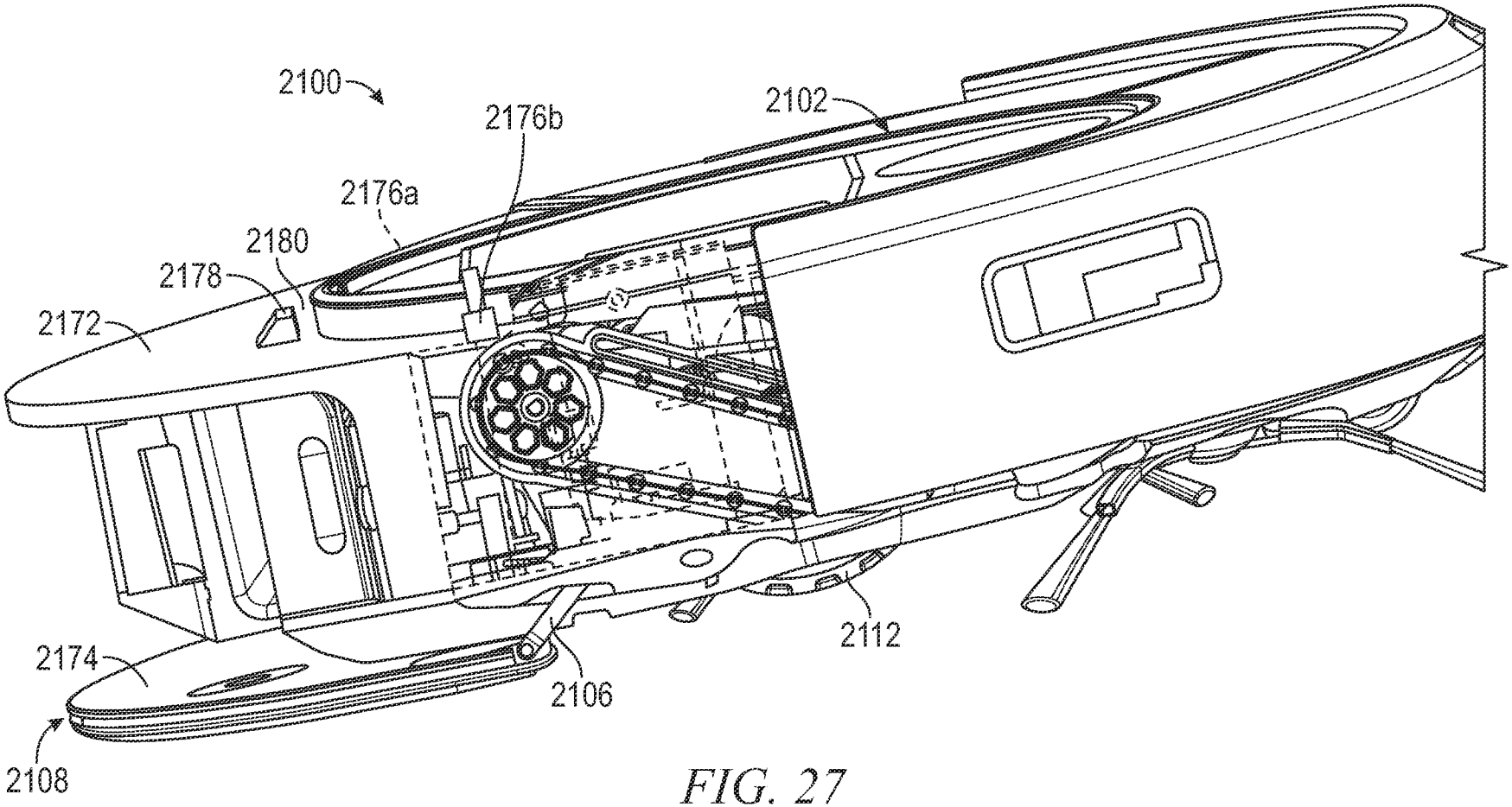
FIG. 27 illustrates an isometric view of a portion of a mobile cleaning robot.

FIG. 27 illustrates an isometric view of a portion of the mobile cleaning robot 2100. The mobile cleaning robot 2100 of FIG. 27 can be consistent with the robot 2100 discussed above; additional details of the robot 2100 are discussed below with respect to FIG. 27.

For example, FIG. 27 shows that the body 2102 of the robot 2000 can include a storage surface 2172 for the pad assembly 2108. The storage surface 2172 can include projections 2176*a* and 2176*b* positioned on opposing sides of the storage surface 2172. The storage surface 2172 can include a projection 2178 positioned or located near a center of the storage surface 2172. Together the projections 2178 and 2176 can engage a pad tray 2174 of the pad assembly 2108 to position a pad of the pad assembly 2108 when the pad assembly 2108 is in the stored position, such that the pad of the pad assembly 210$ does not dictate a position of the tray 2174 with respect to the body 2102 and the storage surface 2172.

In the stowed position, the pad assembly 2108 can be rotated, such as to allow a user change the cleaning pad of the pad assembly 2108. The guide 2122 can be modified to accommodate such movement of the pad assembly 2108 and the arms 2106, as discussed below with respect to FIGS. 28A and 28B.

When the pad assembly 2108 is rotated about the arms 2106 in the stowed position, such rotation relative to the arms can be limited by contact between the pad assembly 2108 and the arms 2106. The relative rotation can be limited to 60, 75, 80, or 85 degrees. In some examples, the rotation can be limited to 85 degrees, such as to allow the user to have clearance to change a pad of the pad assembly 2108, but to also limit the pad assembly 2108 from becoming stuck in a vertical position or a position where the pad faces upward.

Figure 28A:
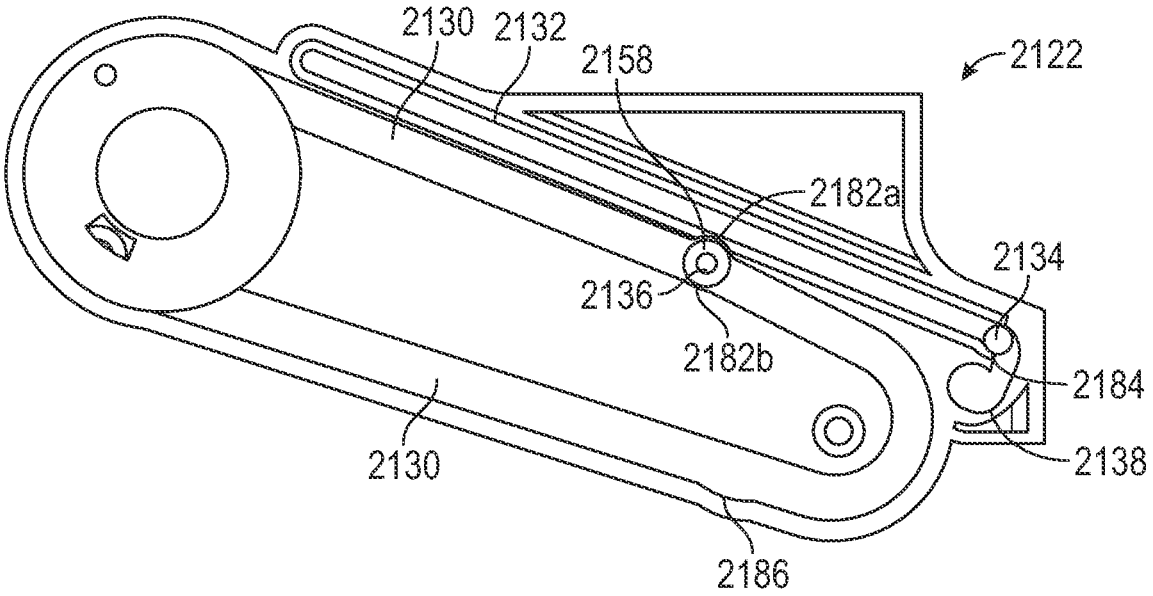
FIG. 28A illustrates an isometric view of a portion of a mobile cleaning robot.
Figure 28B:
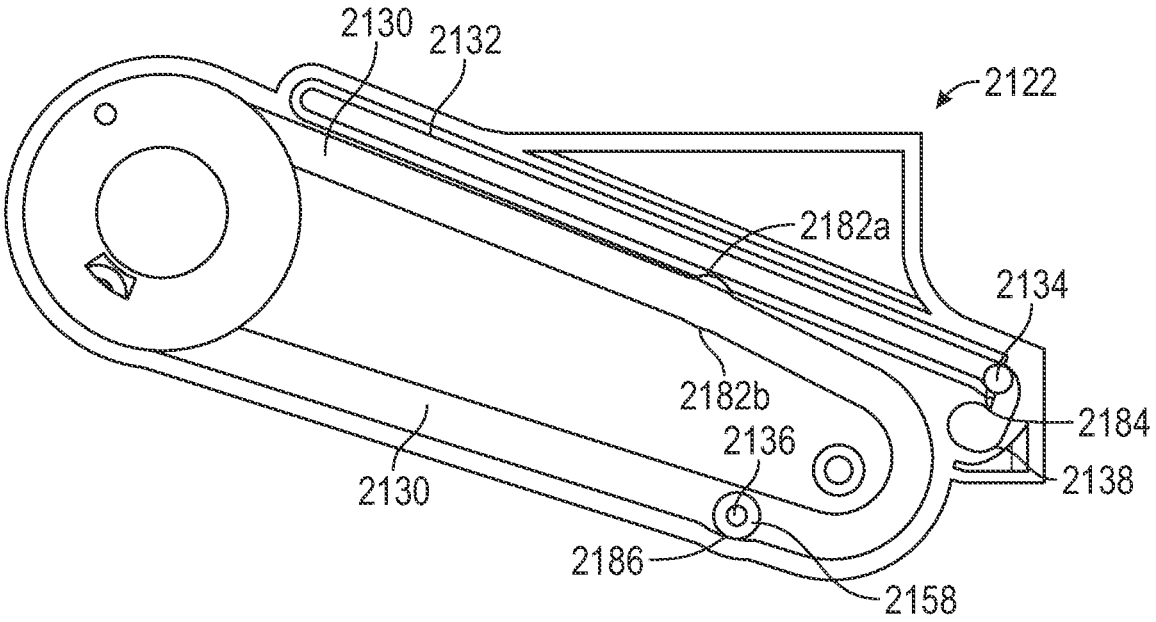
FIG. 28B illustrates an isometric view of a portion of a mobile cleaning robot.

FIG. 28A illustrates an isometric view of the guide 2122 of the mobile cleaning robot 2100. FIG. 28B illustrates an isometric view of the guide 2122 of the mobile cleaning robot 2100. FIGS. 28A and 28B are discussed together below. The guide 2122 of FIGS. 28A and 28B can be consistent with the guide 2122 discussed above; additional details of the guide 2122 are discussed below with respect to FIGS. 28A and 28B.

For example, FIGS. 2A and 28B show notches 2182*a* and 2182*b* in the chain track 2130 of the guide 2122. The notches 2182*a* and 2182*b* can receive at least a portion of the pin 2136 and the arm connector 2158 therein, such as to allow the pin 2136 and the arm connector 2158 of the chain 2124 to move within or with respect to the chain track 2130. Similarly, the arm track 2132 can include a notch 2184 configured to allow the boss 2134 to move within or with respect to the arm track 2132. Such movement of the boss 2134 and the pin 2136 can allow the arm 2106 to deviate from its trajectory and, more specifically, can allow the pad assembly 2108 to rotate or tilt with respect to the body 2102 and storage surface 2172, such as for replacement of a cleaning pad when the arms 2106 and the pad assembly 2108 are in the stored position and are tilted for replacement of a pad. The amount of travel of the arm 2106 enabled by the notches 2182 and 2184 can be between 1 millimeter (mm) and 10 mm. In some examples, the amount of travel can be 5 mm.

FIGS. 28A and 28B also show that the chain track 2130 can include a notch 2186 to receive at least a portion of the pin 2136 and the arm connector 2158 therein, such as to allow the pin 2136 and the arm connector 2158 of the chain 2124 to move within or with respect to the chain track 2130. Such movement of the pin 2136 can allow the arm 2106 to deviate from its trajectory and, more specifically, can allow the pad assembly 2108 to move slightly when the pad assembly 2108 is in the cleaning position. This movement of the pad assembly 2108 when in the cleaning or deployed position can allow the pad assembly 2108 to float vertically, to allow the pad assembly 2108 to respond to uneven surfaces or obstacles encountered by the pad assembly 2108 during cleaning routines. The amount of travel of the arm 2106 allowed by the notch 2186 can be between 1 millimeter (mm) and 10 mm. in sonic examples, the amount of travel can be 5 mm.

Also, a rear portion of the robot 2100 can be configured to sit on the pad assembly 2108, or have its load distributed at least partially to the pad assembly 2108, such that the location or ride height of the rear portion of the robot 2100 is at least partially defined by engagement between the pad assembly 108 and the floor. The above-described movement of the pad assembly 2108 when in the cleaning or deployed position can help to ensure that the position of the pad assembly 2108 is not over-constrained.

Figure 29A:
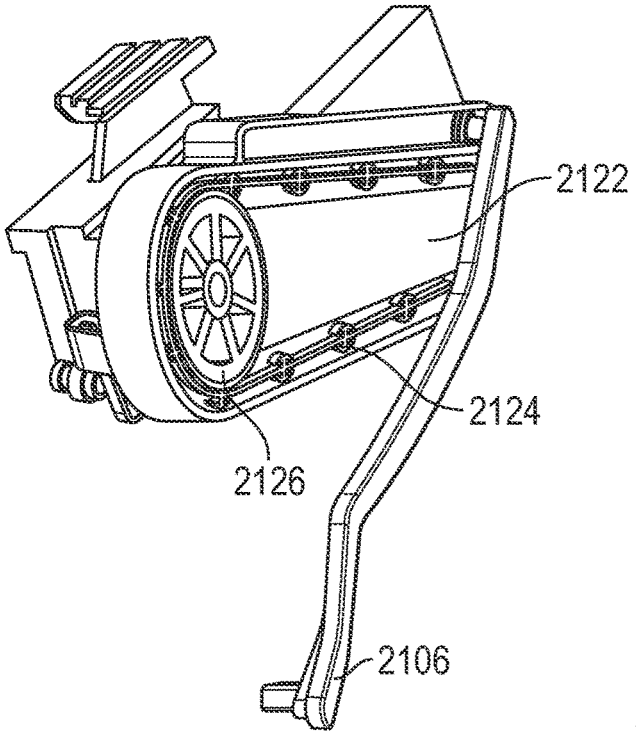
FIG. 29A illustrates an isometric view of a portion of a mobile cleaning robot.
Figure 29B:
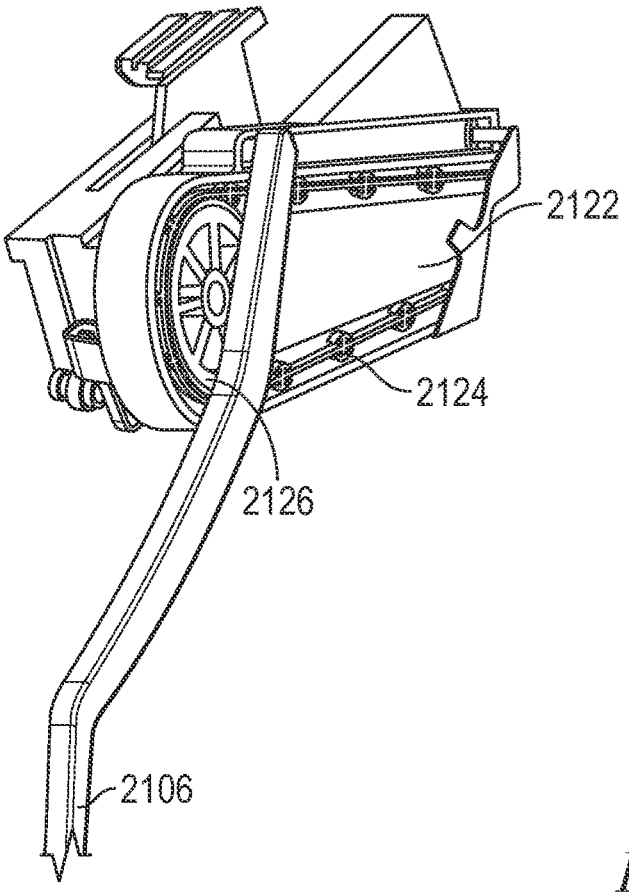
FIG. 29B illustrates an isometric view of a portion of a mobile cleaning robot.
Figure 29C:
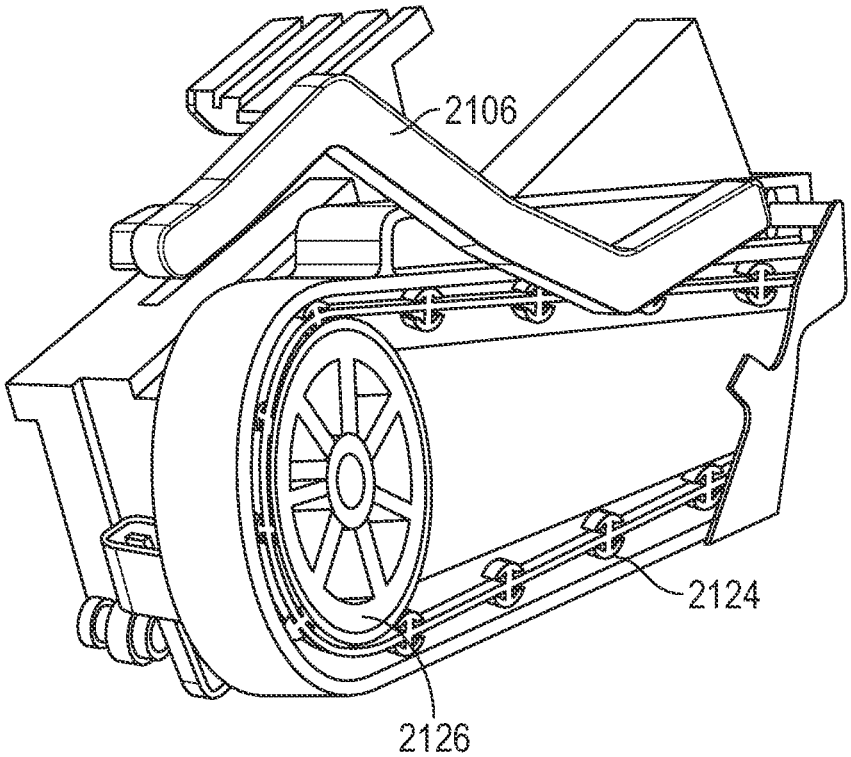
FIG. 29C illustrates an isometric view of a portion of a mobile cleaning robot.

FIG. 29A illustrates an isometric view of a portion of the mobile cleaning robot 2100. FIG. 29B illustrates an isometric view of a portion of the mobile cleaning robot 2100. FIG. 29C illustrates an isometric view of a portion of the mobile cleaning robot 2100. FIGS. 29A-29C show how when the sprocket 2126 is driven to rotate, the chain 2124 can be driven to move the arm 2106 from the deployed position, as shown in FIG. 29A to a stored position, as shown in FIG. 29C.

Figure 30:
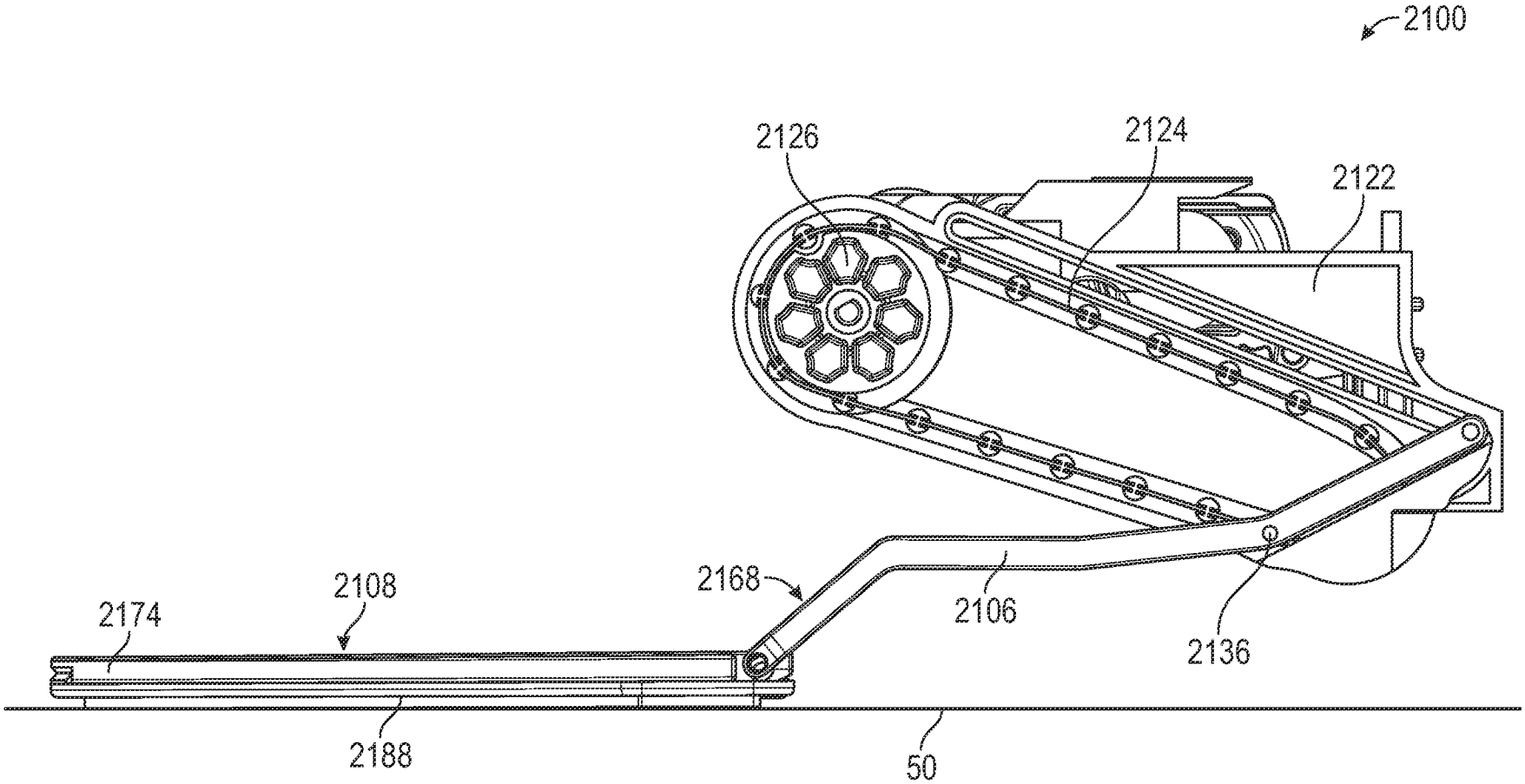
FIG. 30 illustrates a side view of a portion of a mobile cleaning robot.

FIG. 30 illustrates a side view of a portion of the mobile cleaning robot 2100. The robot 2100 of FIG. 30 can be consistent with the robot 2100 discussed above; FIG. 30 shows how a pad 2188 of the pad assembly 2108 can be engaged with a floor surface 50 when the pad assembly 2108 is in the deployed position. FIG. 30 also shows how the rear portion 2168 of the body 2162 of the arm 2106 can be oriented with respect to the pad assembly 2108 when the pad assembly 2108 is in the deployed or cleaning position, as discussed in further detail below with respect to FIGS. 31A and 31B.

Optionally, with the arm 2106 in the fully deployed position and the pad assembly 2108 in the cleaning position, the arm 2106 can be driven to over-rotate by the pad drive system 2114 intermittently. Such intermittent movement of the pad assembly 2108 can help to create a scrubbing motion or action of the pad 2188 on the floor surface 50, which can help to improve cleaning performance of the robot 2100.

Figure 31A:
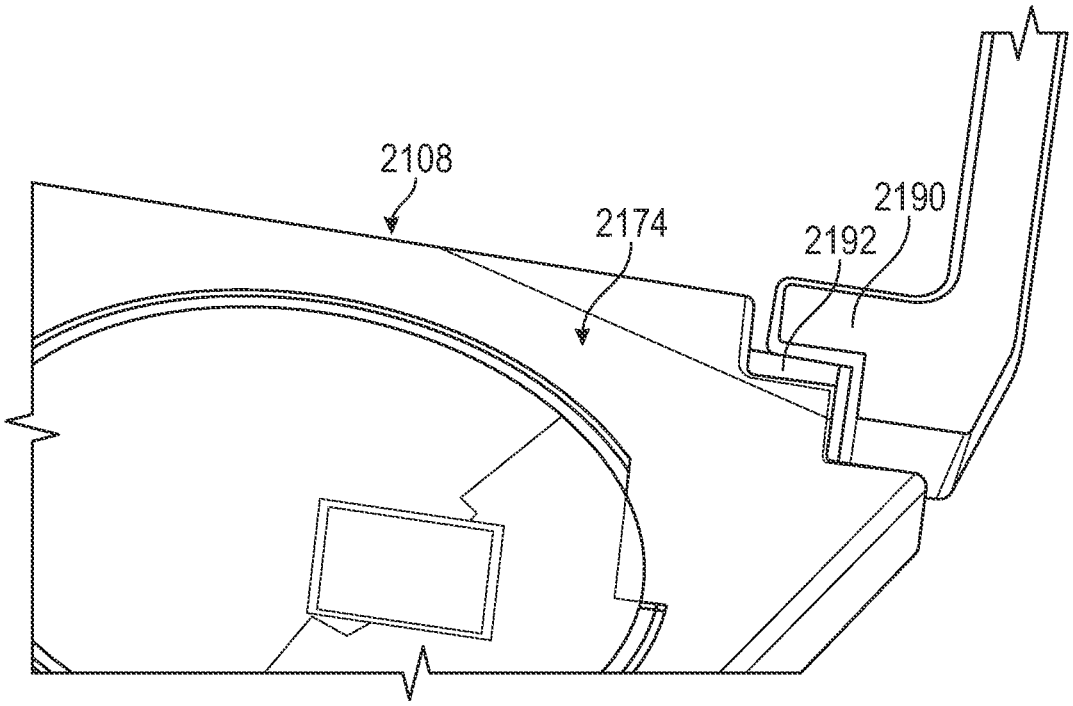
FIG. 31A illustrates an isometric view of a portion of a mobile cleaning robot.
Figure 31B:
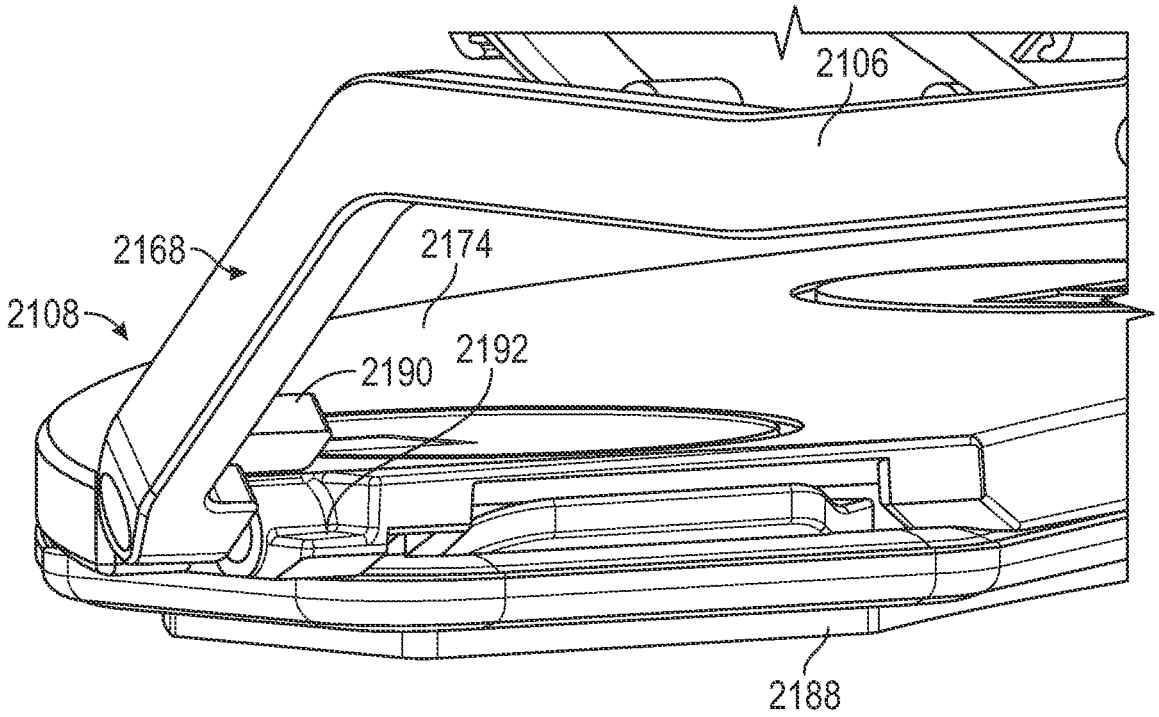
FIG. 31B illustrates an isometric view of a portion of a mobile cleaning robot.

FIG. 31A illustrates an isometric view of the arm 2106 and the pad assembly 2108 of the mobile cleaning robot 2100. FIG. 31B illustrates an isometric view of the arm 2106 and the pad assembly 2108 of the mobile cleaning robot 2100. FIGS. 31A and 31B are discussed together below. The arm 2106 and the pad assembly 2108 of the mobile cleaning robot 2100 of FIGS. 31A and 31B can be consistent with the robot 2100 discussed above; additional details of the arm 2106 and the pad assembly 2108 are discussed below with respect to FIGS. 31A and 31B.

For example, FIGS. 31A and 31B show that the rear portion 2168 of the body 2162 of the arm 2106 can include a stop 2190 and show that the tray 2174 of the pad assembly 2108 can include a recess 2192. The recess 2192 can be complimentary to the stop 2190 such that the recess 2192 is sized and shaped to receive the stop 2190 and engage the stop 2190 such as when the pad is not engaged with the floor surface 50.

In operation of some examples, when the arm 2106 is moved from the stored position to the cleaning position (shown in FIG. 30), the pad assembly 210$ can be free to rotate about the arms 2106*a* and 2106*b*. Without a limit to such rotation, the pad assembly 2108 could rotate about the arms 2106 to swing to a vertical orientation, potentially causing a failure to the pad assembly 2108 to deploy to the cleaning position. Engagement of the stop 2190 with the recess 2192 can help to limit rotation of the pad assembly 2108 with respect to the arm 2106 to help prevent over-rotation of the pad assembly 2108 with respect to the arm 2106, helping to ensure that the pad assembly 2108 deploys to the cleaning position reliably and correctly.

Figure 32:
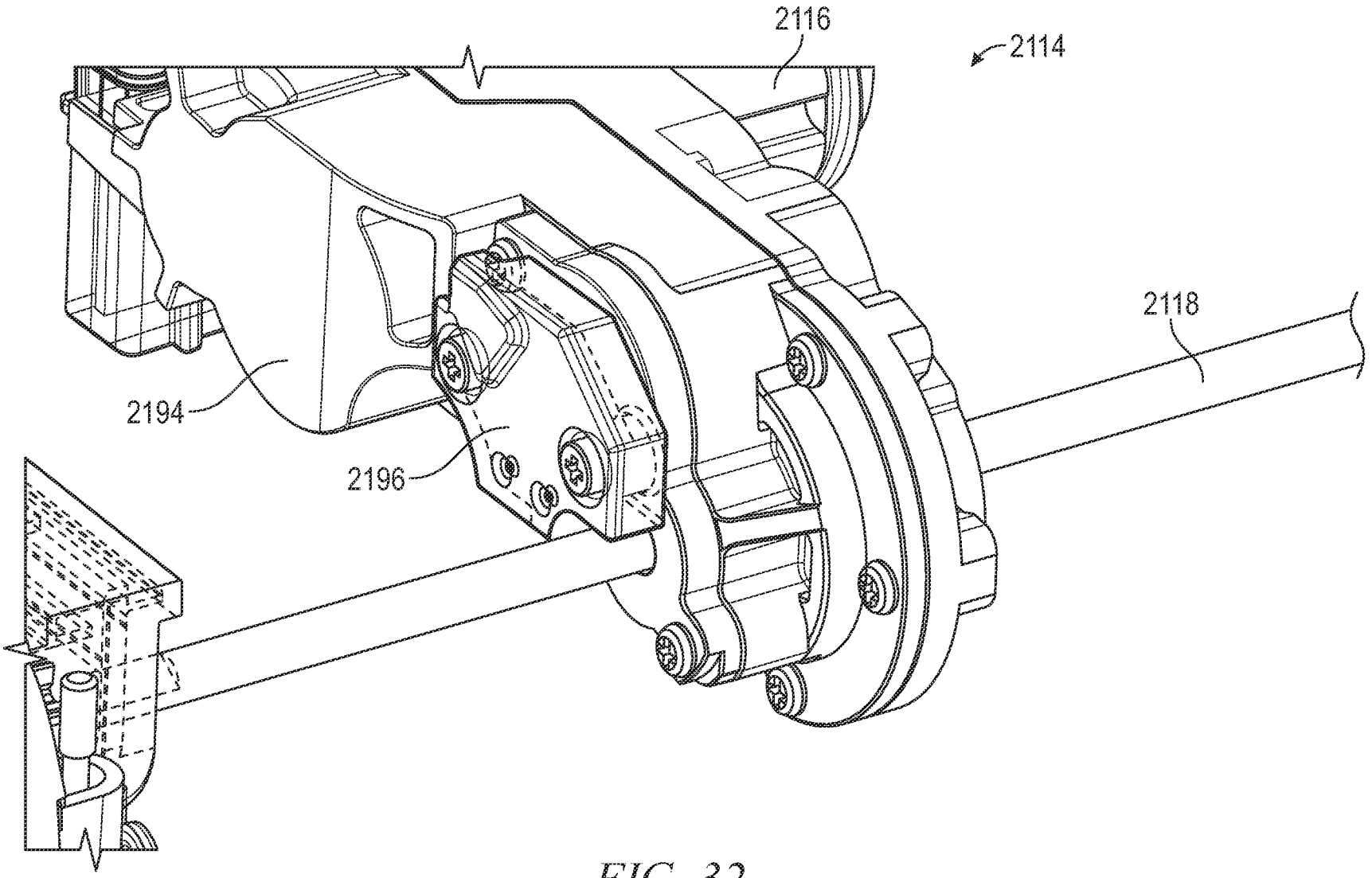
FIG. 32 illustrates an isometric view of a portion of a mobile cleaning robot.

FIG. 32 illustrates an isometric view of the drive system 2114 of the mobile cleaning robot 2100. FIG. 32 shows, more clearly that the motor 2116 can be connected to a gear box 2194, which can be connected to the cross-shaft 2118. The gear box 2194 can include one or more gears to obtain a desired rotational speed of the cross-shaft 2118 using the motor 2116.

FIG. 32 also shows an encoder 2196, which can be connected to the gear box 2194 and to the cross shaft 2118. As such, the encoder 2196 can monitor a position of the cross-shaft 2118 (or a shaft driving the cross-shaft 120) that can be transmitted through a position signal (or encoder signal) to the controller 2111. The controller 2111 can thereby determine a position of the pad assembly 2108 with respect to the robot 2100. The controller 2111 can use these positions to guide movement and actions of the robot 2100. For example, the controller 2111 can control a rotational speed of the motor to maintain a constant (or more consistent) movement speed of the pad assembly 2108 as the pad assembly 2108 moves from the stored position to the deployed or cleaning position. Also, the encoder 2196 can be an absolute encoder, which can allow the controller 2111 to know a position of the pad assembly 2108 at all times, even in the event of a power off. This can help to limit the need for calibration of the drive system 2114 upon restart or startup of the robot 2100.

More specifically, because the arms 2106 (and therefore the pad assembly 2108) are driven by the chain 2124 around the chain track 2130, movement of the arm 2106 and the pad assembly 2108 can be faster when the pin 2136 moves around. the sprocket 2126, for example. Because the controller 2111 can determine when the pin 2136 will pass around the sprocket 2126, the controller 2111 can slow a. rotational speed of the motor 2116 during this movement window to slow down movement of the pad assembly 2108 with respect to the body 2102. The rotational speed of the motor 2116 can then be increased once the pin 2136 has moved past the pulley. Such manipulation of the speed of the motor 2116 can help to provide a more consistent movement of the pad assembly 2108.

Figure 33:
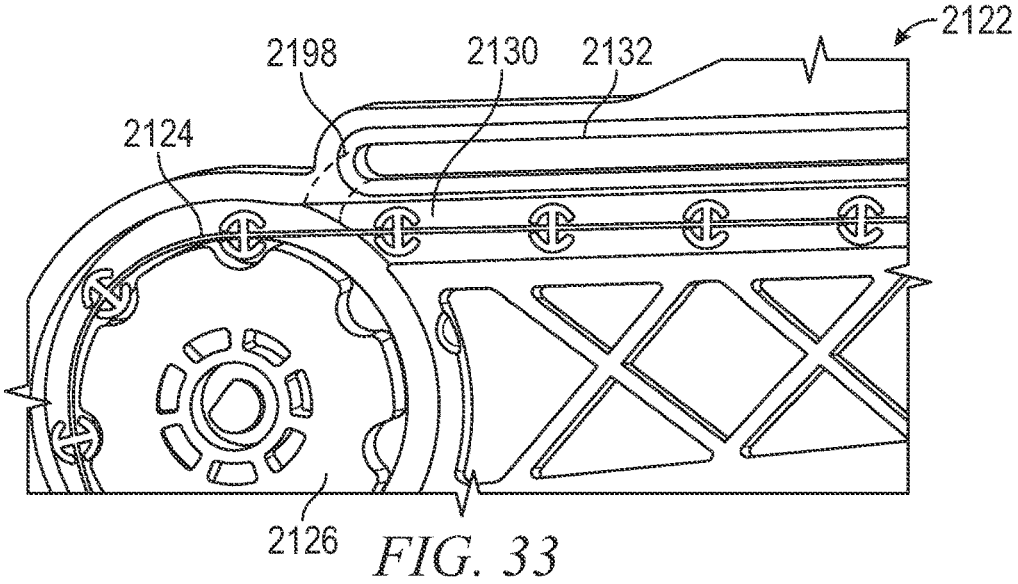
FIG. 33 illustrates an isometric view of a portion of a mobile cleaning robot.

FIG. 33 illustrates an isometric view of the chain drive system 2120 of the mobile cleaning robot 2100. The chain drive system 2120 of FIG. 33 can be consistent with the chain drive systems 2120 discussed above. FIG. 33 shows that the arm track 2132 can connect to a debris slot 2198 at one or more ends of the arm track 2132.

Because the robot 2100 can ingest debris during vacuuming operations, fine debris can build up within components of the robot, and can build up within the guide 2122. Such build up of debris within the arm track 2132 is undesirable because the arm track 2132, together with the boss 2134 and the pin 2136 and the chain track 2130, guide or define a trajectory of the arms 2106 and the pad assembly 2108. If debris builds up in the arm track 2132, a range of motion or movement of the arm 2106 and pad assembly 2108 can be limited. The debris slot 2198 can help limit buildup of debris within the arm track 2132 by allowing the boss 2134 to push debris within the arm track 2132 out of the debris slot 2198, helping to ensure that the pad assembly 2108 can move with respect to the body 2102 as intended.

Figure 34:
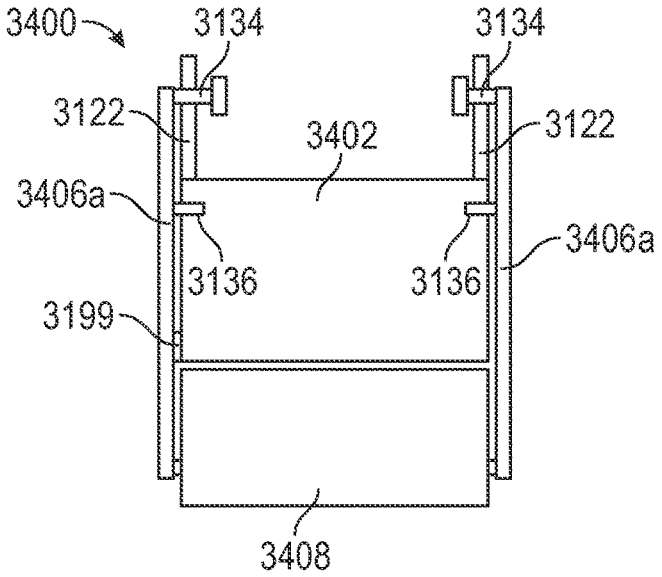
FIG. 34 illustrates a top view of a portion of a mobile cleaning robot.

FIG. 34 illustrates a top view of a portion of a mobile cleaning robot 3400. The robot 3400 can be similar to the robots discussed above, such as the robot 2100. FIG. 34 shows how lateral movement of arms 3406 is constrained.

More specifically, bosses 3134 of respective arms can be connected to guides 3122 and pins 3136 can be connected to chains within the guides 3122. The arms 3106 can also be connected to opposing sides of a pad assembly 3108. Because the arms 3106 are spaced away from the body 3402 by a gap 3199, lateral movement of the arm 3106*a* toward the arm 3106*b* is constrained by contact between the arm 3106*a* and the body 3102, limiting lateral movement of the pad assembly 3108. The arm 3106*b* can be similarly constrained by engagement with the body 3102 such that both of the arms 3106 and the pad assembly 3108 are relatively limited in an ability to move laterally.

Figure 35:
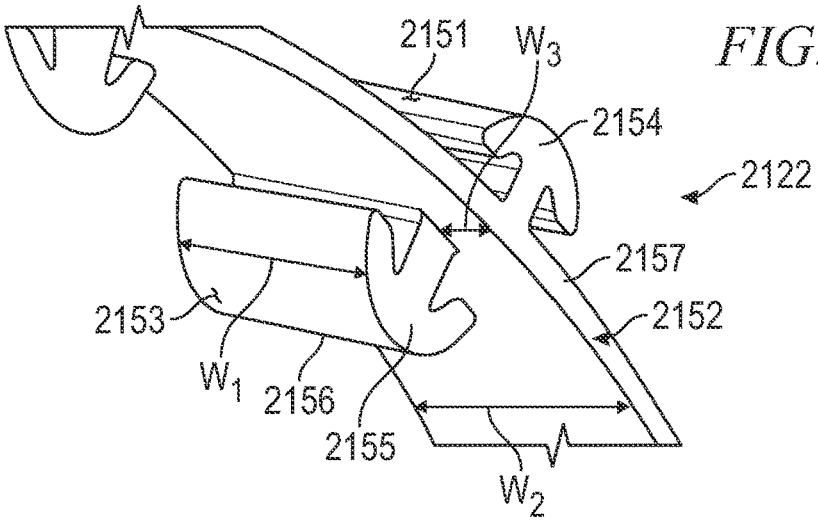
FIG. 35 illustrates an isometric view of a portion of a mobile cleaning robot.

FIG. 35 illustrates an isometric view of the chain or belt 2124 of the mobile cleaning robot 2100. The belt 2124 can be consistent with the chain or belt 2124 discussed above; FIG. 35 shows additional details of the chain or belt 2124.

For example, FIG. 35 shows that the support 2154 can define an outer surface 2151 and the tooth 2156 can define an inner surface 2153. The outer surface 2151 can be rounded such as to reduce pressure when engaging with the guide 2122. Similarly, the inner surface 2153 can be rounded such as to reduce pressure when engaging with the guide 2122. The inner surface 2153 can also be shaped to be complimentary to the gaps 2148 of the sprocket 2126, such as to help improve engagement between the sprocket 2126 and the chain 2124.

FIG. 35 also shows that the teeth 2156 can have a width W1 that is shorter than a width W2 of the flexure 2152 by a width W3 such that an end 2155 of the tooth 2156 can be set back from an end 2157 of the flexure 2152, which can help to keep the tooth 2156 positioned in the gap or gaps 2148 when the tooth 2156 engages the sprocket 2126, as discussed in further detail below with respect to FIGS. 36A and 36B.

Figure 36A:
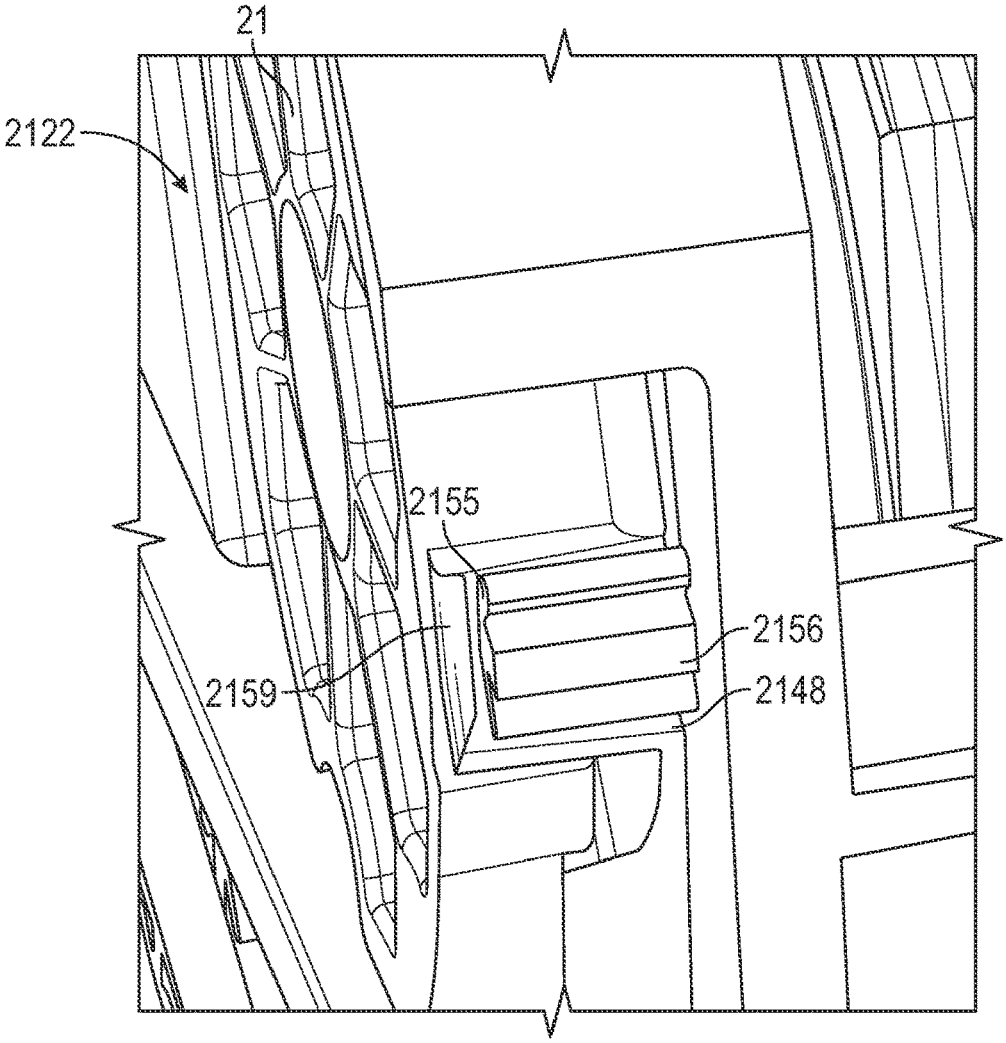
FIG. 36A illustrates an isometric view of a portion of a mobile cleaning robot.

FIG. 36A illustrates an isometric view of a portion of the mobile cleaning robot 2100. FIG. 36B illustrates an isometric view of a portion of the mobile cleaning robot 2100. FIGS. 36A and 36B are discussed together below.

Figure 36B:
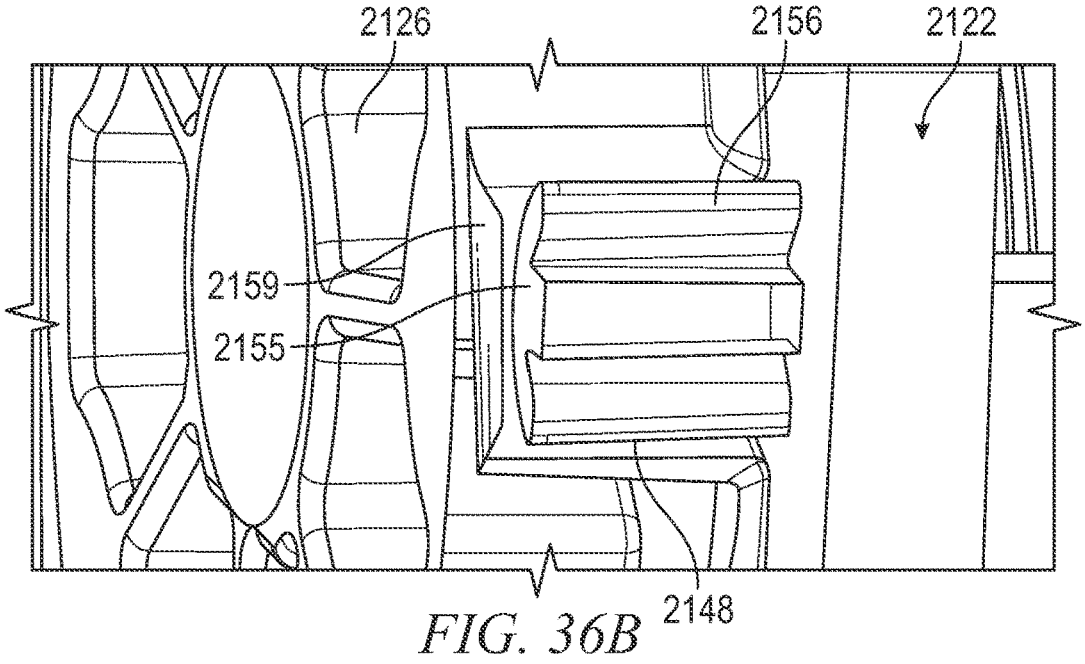
FIG. 36B illustrates an isometric view of a portion of a mobile cleaning robot.

FIGS. 36A and 36B show engagement of a tooth 2156 within a gap or recess 2148 of the sprocket 2126. FIGS. 36A and 36B also show that an outer portion of the gap 2148 can include or define a guide 2159. The guide 2159 can be a chamfer, radius, or surface with another shape that is angled or is not perpendicular to a rotational axis of the sprocket 2126. The guide 2159 can be configured (e.g., sized or shaped) to engage the end 2155 (or another portion) of the tooth 2156 (or another portion of the chain 2124) to help limit or prevent the tooth 2156 from moving or walking out of the gap 2148 during rotation of the sprocket 2126 and the chain 2124.

That is, when the chain 2124 (e.g., the tooth 2156 or any tooth) does begin to walk laterally outward (e.g., parallel to the rotational axis of the sprocket 2126), it can cause the chain 2124 to act incorrectly (e.g., becoming disengaged with the sprocket 2126). Because the guide 2159 is angled or shaped to control such walking, engagement of the end 2155 of the tooth 2156 with the guide 2159 can cause the tooth 2156 to move laterally back into the gap 2148 to help limit or prevent the tooth 2156 from walking out of the gap 2148 duffing rotation of the sprocket 2126 and the chain 2124.

NOTES AND EXAMPLES

The following non-limiting examples, detail certain aspects of the present subject matter to solve the challenges and provide the benefits discussed herein, among others.

Example 1 is a mobile cleaning robot operable to clean a floor surface of an environment, the mobile cleaning robot comprising: a body; a drive system connected to the body and operable to move the mobile cleaning robot about the floor surface; a vacuum system connected to the body and including an extractor operable to extract debris from the floor surface of the environment; and a cleaning system connected to the body, the cleaning system comprising: a mopping pad assembly engageable with the floor surface; a link connected to the mopping pad assembly; and a pad drive system connected to the link and to the body, the pad drive system operable to move the mopping pad assembly between cleaning position where the mopping pad is engageable with the floor surface and a stored position.

In Example 2, the subject matter of Example 1 optionally includes wherein the pad drive system comprises: a drive track connected to the body and connected to the link the drive track operable to move the link to move the mopping pad assembly between the cleaning position and the stored position.

In Example 3, the subject matter of Example 2 optionally includes wherein the body includes a first slot and a second slot located on opposite sides of the body, and wherein the link includes a first arm and a second arm at least partially located in the first slot and the second slot, respectively, the first slot and the second slot configured to guide movement of the first arm and the second arm to move the mopping pad assembly between the cleaning position and the stored position.

In Example 4, the subject matter of Example 3 optionally includes wherein the link includes a connecting member connected to the first arm and the second arm and engaged with the mopping pad assembly to transfer a downward force to the mopping pad assembly when the mopping pad assembly is in the cleaning position.

In Example 5, the subject matter of Example 4 optionally includes wherein the first arm, the second arm, and the connecting member are configured to flex in response to the downward force to distribute the downward force on the mopping pad assembly.

In Example 6, the subject matter of any one or more of Examples 4-5 optionally include wherein the first arm, the second arm, and the connecting member are configured to flex in response to the downward force to distribute the downward force on the mopping pad assembly.

In Example 7, the subject matter of any one or more of Examples 3-6 optionally include wherein the drive track includes a drive belt connected to the first arm and the second aim, the drive track driven to rotate about a pulley to move the link and the mopping pad between the cleaning position and the stored position.

In Example 8, the subject matter of any one or more of Examples 3-7 optionally include wherein the mopping pad is located at least partially below the body in the cleaning position and is located at least partially above the body in the stored position, In Example 9, the subject matter of Example 8 optionally includes wherein the body includes a storage slot engageable with the first arm of the link to guide the mopping pad assembly into and out of the stored position.

In Example 10, the subject matter of Example 9 optionally includes wherein the storage slot is located on a top portion of the body.

Example 11 is a mobile cleaning robot operable to clean a floor surface of an environment, the mobile cleaning robot comprising: a body; a drive system connected to the body and operable to move the mobile cleaning robot about the floor surface; a vacuum system connected to the body and including an extractor operable to extract debris from the floor surface of the environment; and a cleaning system connected to the body, the cleaning system comprising: a mopping pad assembly engageable with the floor surface; a pad drive system connected to the mopping pad assembly and to the body, the pad drive system operable to move the mopping pad assembly between a cleaning position where the mopping pad is engageable with the floor surface and a stored position.

In Example 12, the subject matter of Example 11 optionally includes wherein the pad drive system comprises: a drive track connected to the body and connected to the mopping pad assembly, the drive track operable to move the mopping pad assembly between the cleaning position and the stored position.

In Example 13, the subject matter of Example 12 optionally includes wherein the pad drive system comprises: a track connector connected to the drive track and connected to the mopping pad assembly, the track connector movable with the drive track to move the mopping pad assembly between the cleaning position and the stored position.

In Example 14, the subject matter of Example 13 optionally includes wherein the pad drive system comprises: a pulley engaged with the drive track and connected to the body, the pulley rotatable to allow the drive track to move the track connector.

In Example 15, the subject matter of Example 14 optionally includes wherein the pad connector includes a finger connected to the drive track and wherein the pulley includes a plurality of radial notches configured to receive the finger When the pad connector passes the pulley on the drive track.

In Example 16, the subject matter of any one or more of Examples 13-15 optionally include wherein the mopping pad assembly comprises: a mopping pad engageable with the floor surface; and a mopping tray connected to the mopping pad and connected to the track connector.

In Example 17, the subject matter of Example 16 optionally includes wherein the mopping tray includes a boss extending away from the pad and extending through a bore of the track connector, the boss and the bore configured to guide movement of the mopping tray with respect to the track connector when the mopping pad assembly is in the cleaning position.

In Example 18, the subject matter of Example 17 optionally includes wherein the boss is engageable with the body to limit movement of the mopping tray with respect to the track connector when the mopping pad assembly is in the cleaning position.

In Example 19, the subject matter of any one or more of Examples 12-18 optionally include wherein the drive track extends from a bottom portion of the body to a top portion of the body around an outer edge of the body.

In Example 20, the subject matter of any one or more of Examples 11-19 optionally include wherein the pad drive system comprises: a second drive track connected to the body and connected to the mopping pad assembly, the second drive track operable with the drive track to move the mopping pad assembly between the cleaning position and the stored position.

Example 21 is a mobile cleaning robot operable to clean a floor surface of an environment, the mobile cleaning robot comprising: a body; a drive system connected to the body and operable to move the mobile cleaning robot about the floor surface; a vacuum system connected to the body and including an extractor operable to extract debris from the floor surface of the environment; and a cleaning system connected to the body, the cleaning system comprising: a mopping pad assembly engageable with the floor surface; a pad drive system connected to the mopping pad assembly and to the body, the pad drive system operable to move the mopping pad assembly between a cleaning position where the mopping pad is engageable with the floor surface and a stored position.

In Example 22, the subject matter of Example 21 optionally includes wherein the mopping pad assembly comprises: a pad extending along a longitudinal axis and connected to the body, the pad rotatable with respect to the body between the cleaning position and the stored position.

In Example 23, the subject matter of Example 22 optionally includes wherein the mopping pad assembly comprises: a core extending along the longitudinal axis and connected to the body and to the pad, the core rotatable with the pad between the cleaning position and the stored position.

In Example 24, the subject matter of Example 23 optionally includes wherein the pad is connected to a radially outer portion of the core.

In Example 25, the subject matter of Example 24 optionally includes wherein the core includes a flat portion opposite the pad, wherein the flat portion is oriented toward the cleaning surface when the pad is rotated to the stored position, and wherein the flat portion is oriented away from the cleaning surface when the pad is rotated to the cleaning position.

In Example 26, the subject matter of Example 25 optionally includes wherein the pad extends around 180 degrees of a circumference of the core such that the pad is engageable with the floor through a range of rotation of the pad and the core of 180 degrees.

In Example 27, the subject matter of Example 26 optionally includes a motor connected to the core to rotate the core and the pad between the cleaning position and the stored position.

In Example 28, the subject matter of Example 27 optionally includes a controller in communication with the motor to rotate the core and the pad based on a. detected type of floor surface.

In Example 29, the subject matter of any one or more of Examples 27-28 optionally include a controller in communication with the motor to control rotation of the core throughout a cleaning mission of the mobile cleaning robot based on a time the pad is engaged with the cleaning surface at each position of the range of rotation where the pad is engageable with the floor.

In Example 30, the subject matter of any one or more of Examples 22-29 optionally include wherein the pad is a compliant pad.

Example 31 is a mobile cleaning robot operable to clean a floor surface of an environment, the mobile cleaning robot comprising: a body; a drive system connected to the body and operable to move the mobile cleaning robot about the floor surface; and a cleaning system connected to the body, the cleaning system comprising: a mopping pad assembly engageable with the floor surface; a link connected to the mopping pad assembly; and a pad drive system connected to the link and to the body, the pad drive system operable to move the mopping pad assembly between cleaning position where the mopping pad is engageable with the floor surface and a stored position.

In Example 32, the subject matter of Example 31 optionally includes wherein the pad drive system comprises: a drive track connected to the body and. connected to the link, the drive track operable to move the link to move the mopping pad assembly between the cleaning position and the stored position.

In Example 33, the subject matter of Example 32 optionally includes wherein the body includes a first slot and a second slot located on opposite sides of the body, and wherein the link includes a first arm and a second arm at least partially located in the first slot and the second slot, respectively, the first slot and the second slot configured to guide movement of the first arm and the second arm to move the mopping pad assembly between the cleaning position and the stored position.

In Example 34, the subject matter of Example 33 optionally includes wherein the link includes a connecting member connected to the first arm and the second arm and engaged with the mopping pad assembly to transfer a downward force to the mopping pad assembly when the mopping pad assembly is in the cleaning position.

In Example 35, the subject matter of Example 34 optionally includes wherein the first arm, the second arm, and the connecting member are configured to flex in response to the downward force to distribute the downward force on the mopping pad assembly.

Example 36 is a mobile cleaning robot operable to clean a floor surface of an environment, the mobile cleaning robot comprising: a body; a drive system connected to the body and operable to move the mobile cleaning robot about the floor surface; and a cleaning system connected to the body, the cleaning system comprising: a mopping pad assembly engageable with the floor surface; a pad drive system connected to the mopping pad assembly and to the body, the pad drive system operable to move the mopping pad assembly between a cleaning position where the mopping pad is engageable with the floor surface and a stored position.

In Example 37, the subject matter of Example 36 optionally includes wherein the pad drive system comprises: a drive track connected to the body and. connected to the mopping pad assembly, the drive track operable to move the mopping pad assembly between the cleaning position and the stored position.

In Example 38, the subject matter of Example 37 optionally includes wherein the pad drive system comprises: a track connector connected to the drive track and connected to the mopping pad assembly, the track connector movable with the drive track to move the mopping pad assembly between the cleaning position and the stored position.

In Example 39, the subject matter of Example 38 optionally includes wherein the pad drive system comprises: a pulley engaged with the drive track and connected to the body, the pulley rotatable to allow the drive track to move the track connector.

In Example 40, the subject matter of Example 39 optionally includes wherein the pad connector includes a finger connected to the drive track and wherein the pulley includes a plurality of radial notches configured to receive the finger When the pad connector passes the pulley on the drive track.

Example 41 is a mobile cleaning robot operable to clean a floor surface of an environment, the mobile cleaning robot comprising: a body; a drive system connected to the body and operable to move the mobile cleaning robot about the floor surface; and a cleaning system connected to the body, the cleaning system comprising: a mopping pad assembly engageable with the floor surface; a pad drive system connected to the mopping pad assembly and to the body, the pad drive system operable to move the mopping pad assembly between a cleaning position where the mopping pad is engageable with the floor surface and a stored position.

Example 42, the subject matter of Example 41 optionally includes wherein the mopping pad assembly comprises: a pad extending along a longitudinal axis and connected to the body, the pad rotatable with respect to the body between the cleaning position and the stored position.

In Example 43, the subject matter of Example 42 optionally includes wherein the mopping pad assembly comprises: a core extending along the longitudinal axis and connected to the body and to the pad, the core rotatable with the pad between the cleaning position and the stored position.

In Example 44, the subject matter of Example 43 optionally includes wherein the pad is connected to a radially outer portion of the core.

In Example 45, the subject matter of Example 44 optionally includes wherein the core includes a flat portion opposite the pad, wherein the flat portion is oriented toward the cleaning surface when the pad is rotated to the stored position, and wherein the flat portion is oriented away from the cleaning surface when the pad is rotated to the cleaning position.

Example 46 is a mobile cleaning robot comprising: a body; a pad assembly connected to the body and movable relative thereto; and a pad drive system connected to the body and operable to move the pad assembly relative to the body between a stored position and a cleaning position.

In Example 47, the subject matter of Example 46 optionally includes the pad assembly further comprising: a pad tray configured to support a cleaning pad engageable with a floor surface; one or more arms respectively connected to the pad tray and respectively connected to the pad drive system; and a drive belt or chain connected to an arm.

In Example 48, the subject matter of Example 47 optionally includes the drive system further comprising: a pulley or sprocket connected to the body and rotatable relative thereto, the pulley or sprocket engaged with the drive belt or chain and operable to drive the belt or chain to move the arm.

In Example 49, the subject matter of Example 48 optionally includes the drive system further comprising: a belt or chain guide connected to the body and defining at least a portion of a belt or chain track that at least partially surrounds at least a portion of the drive belt or chain.

In Example 50, the subject matter of Example 49 optionally includes a belt or chain cover connected to the belt or chain guide to cover at least a portion of the belt or chain track.

In Example 51, the subject matter of any one or more of Examples 49-50 optionally include wherein the guide defines an arm track supporting at least a portion of an individual one of the arms.

In Example 52, the subject matter of Example 51 optionally includes wherein the arm track extends beyond an end of the chain guide.

In Example 53, the subject matter of any one or more of Examples 51-52 optionally include wherein the arm track and the belt or chain guide together define a trajectory of the pad assembly when the pad assembly moves between the stored position and the cleaning position.

In Example 54, the subject matter of any one or more of Examples 48-53 optionally include wherein the belt or chain includes a flexure supporting a plurality of teeth, the teeth engageable with recesses of the pulley or sprocket.

In Example 55, the subject matter of Example 54 optionally includes wherein the belt or chain includes an arm connector in place of an individual tooth of the teeth of the belt or chain, the belt or chain connector connected to the arm, and wherein the pulley or sprocket includes a notch configured to receive the arm connector or a tooth therein.

In Example 56, the subject matter of Example 55 optionally includes wherein individual ones of the plurality of recesses of the pulley or sprocket are configured to receive individual ones of the teeth and not the arm connector.

In Example 57, the subject matter of any one or more of Examples 55-56 optionally include wherein an individual tooth of the plurality of teeth has a rounded T-shape from a lateral perspective.

In Example 58, the subject matter of Example 57 optionally includes wherein the belt or chain includes supports extending from the flexure respectively opposing an individual tooth of the plurality of teeth.

In Example 59, the subject matter of any one or more of Examples 54-58 optionally include wherein a thickness of the flexure is reduced between individual ones of the teeth.

Example 60 is a mobile cleaning robot comprising: a body; a pad tray configured to support a cleaning pad engageable with a floor surface; an arm connected to the pad tray; and a pad drive system connected to the body and connected to the arm, the pad drive system operable to move the arm and the pad tray relative to the body between a stored position and a cleaning position where the cleaning pad is engageable with the floor surface.

In Example 61, the subject matter of Example 60 optionally includes the pad drive system further comprising: a. drive belt or chain connected to the arm; and a pulley or sprocket connected to the body and rotatable relative thereto, the pulley or sprocket engaged with the drive belt or chain and operable to drive the belt or chain to move the arm.

In Example 62, the subject matter of Example 61 optionally includes the pad drive system further comprising: a belt or chain guide connected to the body and defining at least a portion of a belt or chain track that at least partially surrounds at least a portion of the drive belt or chain.

In Example 63, the subject matter of Example 62 optionally includes a belt or chain cover connected to the belt or chain guide to cover at least a. portion of the belt or chain track.

In Example 64, the subject matter of Example 63 optionally includes wherein the guide defines an arm track supporting at least a portion of an individual one of the arms.

Example 65 is a mobile cleaning robot comprising: a body; a pad tray configured to support a cleaning pad engageable with a floor surface; an arm connected to the pad tray; a pad drive system connected to the body and connected to the arm; and a controller operable to: instruct the pad drive system to move the arm and the pad tray relative to the body between a stored position and a cleaning position where the cleaning pad is engageable with the floor surface.

In Example 66, the subject matter of Example 65 optionally includes wherein the controller is further configured to: receive a drive position signal from an encoder connected to the drive system; and instruct the pad drive system based on the drive position signal.

In Example 67, the subject matter of Example 66 optionally includes wherein the controller is further configured to: adjust a speed of the drive system based on the drive position signal.

Example 68 is a method of operating a mobile cleaning robot, the method comprising: navigating the robot throughout an environment; moving a cleaning pad of the robot from a stored position to a cleaning position; and moving the cleaning pad of the robot from the stored position to the cleaning position.

In Example 69, the subject matter of Example 68 optionally includes producing a position signal based on a position of the cleaning pad; and instructing a pad drive system to move the cleaning pad based on the drive position signal.

In Example 70, the subject matter of Example 69 optionally includes adjusting a speed of the drive system based on the position signal.

In Example 71, the subject matter of any one or more of Examples 69-70 optionally include operating a vacuum system to remove debris from the environment, In Example 72, the subject matter of any one or more of Examples 69-71 optionally include mopping at least a portion of a floor surface of the environment when the pad is in the cleaning position.

In Example 73, the apparatuses or method of any one or any combination of Examples 1-72 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more," In this document, the term "or" is used to refer to a nonexclusive or, such that "A or B" includes "A but not B," "B but not A," and "A and. B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by. one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:

a body;

a pad assembly connected to the body and movable relative thereto, the pad assembly comprising:

a pad tray configured to support a cleaning pad engageable with a floor surface;

one or more arms respectively connected to the pad tray; and a drive belt or chain connected to an arm of the one or more arms; and a pad drive system connected to the body and connected to the one or more arms, the pad drive system operable to move the pad assembly relative to the body between a stored position located above a top surface of the body and a cleaning position located at least partially below a bottom surface of the body, the pad drive system comprising:

a pulley or sprocket connected to the body and rotatable relative thereto, the pulley or sprocket engaged with the drive belt or chain and operable to drive the belt or chain to move the arm; and a belt or chain guide connected to the body and defining at least a portion of a belt or chain track that at least partially surrounds at least a portion of the drive belt or chain, the belt or chain guide defining an arm track supporting at least a portion of the arm of the one or more arms at least partially within the arm track, the arm track configured to guide movement of the arm along the arm track to guide movement of the pad assembly between the stored position and the cleaning position.

2. The mobile cleaning robot of claim 1, further comprising:

a belt or chain cover connected to the belt or chain guide to cover at least a portion of the belt or chain track.

3. The mobile cleaning robot of claim 1, wherein the arm track extends beyond an end of the belt or chain guide.

4. The mobile cleaning robot of claim 1, wherein the arm track and the belt or chain guide together define a trajectory of the pad assembly when the pad assembly moves between the stored position and the cleaning position.

5. The mobile cleaning robot of claim 1, wherein the belt or chain includes a flexure supporting a plurality of teeth, the plurality of teeth engageable with recesses of the pulley or sprocket.

6. The mobile cleaning robot of claim 5, wherein the belt or chain includes an arm connector in place of an individual tooth of the plurality of teeth of the belt or chain, the arm connector connected to the arm, and wherein the pulley or sprocket includes a notch configured to receive the arm connector or a tooth therein.

7. The mobile cleaning robot of claim 6, wherein individual ones of the plurality of recesses of the pully pulley or sprocket are configured to receive individual ones of the plurality of teeth and not the arm connector.

8. The mobile cleaning robot of claim 6, wherein an individual tooth of the plurality of teeth has a rounded T-shape from a lateral perspective.

9. The mobile cleaning robot of claim 8, wherein the belt or chain includes supports extending from the flexure respectively opposing an individual tooth of the plurality of teeth.

10. The mobile cleaning robot of claim 5, wherein a thickness of the flexure is reduced between individual ones of the plurality of teeth.

11. A mobile cleaning robot comprising:

a body;

a pair of drive wheels connected to the body and operable to move the body about a floor surface;

a pad tray configured to support a cleaning pad engageable with the floor surface;

an arm connected to the pad tray; and a pad drive system connected to the body and connected to the arm, the pad drive system operable to move the arm and the pad tray relative to the body between a stored position located above a top surface of the body and a cleaning position located below the body where the cleaning pad is engageable with the floor surface, the pad drive system comprising:

a drive belt or chain connected to the arm;

a pulley or sprocket connected to the body and rotatable relative thereto, the pulley or sprocket engaged with the drive belt or chain and operable to drive the belt or chain to move the arm;

a belt or chain guide connected to the body and defining at least a portion of a belt or chain track that at least partially surrounds at least a portion of the drive belt or chain, the belt or chain guide defining an arm track supporting at least a portion of the arm; and a belt or chain cover connected to the belt or chain guide to cover at least a portion of the belt or chain track.

12. A mobile cleaning robot comprising:

a body;

a pad assembly connected to the body and movable relative thereto, the pad assembly comprising:

a pad tray configured to support a cleaning pad engageable with a floor surface;

one or more arms respectively connected to the pad tray; and a drive belt or chain connected to an arm of the one or more arms; and a pad drive system connected to the body and to the one or more arms, the pad drive system operable to move the pad assembly relative to the body between a stored position located above a top surface of the body and a cleaning position located at least partially below a bottom surface of the body, the pad drive system comprising:

a pulley or sprocket connected to the body and rotatable relative thereto, the pulley or sprocket engaged with the drive belt or chain and operable to drive the belt or chain to move the arm, the belt or chain including a flexure supporting a plurality of teeth, the plurality of teeth engageable with recesses of the pulley or sprocket, and the belt or chain including an arm connector in place of an individual tooth of the plurality of teeth of the belt or chain, the arm connector connected to the arm, and wherein the pulley or sprocket includes a notch configured to receive the arm connector or a tooth therein.

13. The mobile cleaning robot of claim 12, the pad drive system further comprising:

a belt or chain guide connected to the body and defining at least a portion of a belt or chain track that at least partially surrounds at least a portion of the drive belt or chain.

14. The mobile cleaning robot of claim 13, further comprising:

a belt or chain cover connected to the belt or chain guide to cover at least a portion of the belt or chain track.

15. The mobile cleaning robot of claim 13, wherein the belt or chain guide defines an arm track supporting at least a portion of the arm of the one or more arms at least partially within the arm track, the arm track configured to guide movement of the arm along the arm track to guide movement of the pad assembly between the stored position and the cleaning position.

16. The mobile cleaning robot of claim 15, wherein the arm track extends beyond an end of the belt or chain guide.

17. The mobile cleaning robot of claim 15, wherein the arm track and the belt or chain guide together define a trajectory of the pad assembly when the pad assembly moves between the stored position and the cleaning position.

18. The mobile cleaning robot of claim 12, wherein individual ones of the plurality of recesses of the pully pulley or sprocket are configured to receive individual ones of the plurality of teeth and not the arm connector.

19. The mobile cleaning robot of claim 12, wherein an individual tooth of the plurality of teeth has a rounded T-shape from a lateral perspective.

20. The mobile cleaning robot of claim 19, wherein the belt or chain includes supports extending from the flexure respectively opposing an individual tooth of the plurality of teeth.

21. The mobile cleaning robot of claim 12, wherein a thickness of the flexure is reduced between individual ones of the plurality of teeth.

* * * * *